US010119674B2

(12) United States Patent
Nakazato et al.

(10) Patent No.: US 10,119,674 B2
(45) Date of Patent: Nov. 6, 2018

(54) VEHICLE LIGHTING FIXTURE

(71) Applicant: Stanley Electric Co., Ltd., Tokyo (JP)

(72) Inventors: Yoshiaki Nakazato, Tokyo (JP); Tatsuma Saito, Tokyo (JP); Philip Rackow, Tokyo (JP); Naochika Horio, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 439 days.

(21) Appl. No.: 15/044,993

(22) Filed: Feb. 16, 2016

(65) Prior Publication Data

US 2016/0245471 A1 Aug. 25, 2016

(30) Foreign Application Priority Data

Feb. 17, 2015 (JP) ..... 2015-028778

(51) Int. Cl.
*F21V 9/00* (2018.01)
*F21S 8/10* (2006.01)
(Continued)

(52) U.S. Cl.
CPC ..... *F21S 48/1195* (2013.01); *F21S 41/14* (2018.01); *F21S 41/16* (2018.01); *F21S 41/18* (2018.01);
(Continued)

(58) Field of Classification Search
CPC ..... F21S 41/16; F21S 48/1195; F21S 41/14; F21S 41/18; F21S 41/285; F21S 41/24; F21S 43/13; F21S 43/235; F21Y 2115/30
(Continued)

(56) References Cited

U.S. PATENT DOCUMENTS 6,097,870 A 8/2000 Ranka et al.
6,611,643 B2 8/2003 Birk et al.
(Continued)

FOREIGN PATENT DOCUMENTS

DE 10 2013 008 075 A1 11/2014
EP 1 976 296 A1 10/2008
(Continued)

OTHER PUBLICATIONS

Alexandre Bozolan et al.; "Supercontinuum generation in a water-core photonic crystal fiber"; Optics Express; Jun. 23, 2008; vol. 16, No. 13; pp. 9671-9676.
Anonymous: "Supercontinuum—Wikipedia, the free encyclopedia"; Feb. 12, 2015; XP055284738; Retrieved from the Internet; URL: https://en.wikipedia.org/wiki/Supercontinuum [retrieved on Oct. 4, 2016].
(Continued)

*Primary Examiner* — Anh Mai
*Assistant Examiner* — Matthew Peerce
(74) *Attorney, Agent, or Firm* — Kenealy Vaidya LLP

(57) ABSTRACT

A vehicle lighting fixture can eliminate the use of a phosphor member that causes the reduced color rendering properties and the occurrence of color separation, specifically, can enhance the color rendering properties and suppress the occurrence of color separation more than a conventional white light source that use a semiconductor light emitting element such as an LD and a phosphor member (wavelength converting member). The vehicle lighting fixture includes: a supercontinuum light source configured to output supercontinuum light containing light in a visible wavelength region, and an optical system configured to control the supercontinuum light output from the supercontinuum light source.

17 Claims, 32 Drawing Sheets

(51) Int. Cl.

| | |
|---|---|
| ***F21S 41/14*** | (2018.01) |
| ***F21S 41/20*** | (2018.01) |
| ***F21S 41/24*** | (2018.01) |
| ***F21S 43/13*** | (2018.01) |
| ***F21S 43/235*** | (2018.01) |
| ***F21S 41/16*** | (2018.01) |
| *F21Y 115/30* | (2016.01) |
| *F21S 41/25* | (2018.01) |
| *F21S 41/32* | (2018.01) |
| *F21S 45/47* | (2018.01) |

(52) U.S. Cl.
CPC ..... *F21S 41/24* (2018.01); *F21S 41/285* (2018.01); *F21S 43/13* (2018.01); *F21S 43/235* (2018.01); *F21S 41/25* (2018.01); *F21S 41/32* (2018.01); *F21S 45/47* (2018.01); *F21Y 2115/30* (2016.08)

(58) Field of Classification Search
USPC ..... 362/511
See application file for complete search history.

(56) References Cited

U.S. PATENT DOCUMENTS

| | | | |
|---|---|---|---|
| 2002/0009260 | A1 | 1/2002 | Birk et al. |
| 2009/0212698 | A1 | 8/2009 | Bailey |
| 2013/0223092 | A1 | 8/2013 | Wurster et al. |
| 2014/0153888 | A1 | 6/2014 | Knight et al. |
| 2014/0254188 | A1 | 9/2014 | Masuda et al. |

FOREIGN PATENT DOCUMENTS

| | | | |
|---|---|---|---|
| FR | 2 670 562 | A1 | 6/1992 |
| JP | 2003-317515 | A | 11/2003 |
| JP | 2009-169041 | A | 7/2009 |
| JP | 2010-36835 | A | 2/2010 |
| JP | 2010-92747 | A | 4/2010 |
| JP | 2014-17096 | A | 1/2014 |

OTHER PUBLICATIONS

The extended European search report for the related European Patent Application No. 16156117.0 dated Jul. 11, 2016.

Output spectra for waist diameters and average powers of (a) 2.5 μm and 430 mW, (b) 2.0 μm and 380 mW, (c) 1.8 μm and 300 mW, (d) 1.5 μm and 70 mW. The dashed curves are the (vertically scaled) input spectra.

| | Comparative Example 1 White LED Light Source | Comparative Example 2 White LED Light Source (Luminance: 100 Mnit) | Comparative Example 2 White LED Light Source (Luminance: 400 Mnit) | Example SC Light Source (NA: 0.2 Luminance: 400 Mnit) |
|---|---|---|---|---|
| Luminance Flux from Transmission Optical Fiber | - | 5 lm | 20 lm | 400 lm |
| MAX Light Intensity | 62,000 cd | 63,000 cd | 66,000 cd | 155,000 cd |
| Average Detection Distance to Obstacle | 132 m | 132 m | 134 m | 177 m |

VEHICLE LIGHTING FIXTURE

This application claims the priority benefit under 35 U.S.C. § 119 of Japanese Patent Application No. 2015-028778 filed on Feb. 17, 2015, which is hereby incorporated in its entirety by reference.

TECHNICAL FIELD

The presently disclosed subject matter relates to vehicle lighting fixtures, and in particular, to a vehicle lighting fixture utilizing a supercontinuum light source.

BACKGROUND ART

Conventionally, vehicle lighting fixtures utilizing a semiconductor light emitting element such as a laser diode (LD) have been proposed. Examples thereof may include those described in Japanese Patent Application Laid-Open No. 2014-017096.

FIG. 1 illustrates a schematic diagram illustrating the configuration of a vehicle lighting fixture 200 described in Japanese Patent Application Laid-Open No. 2014-017096.

As illustrated in the drawing, the vehicle lighting fixture 200 is configured to include semiconductor laser elements 202, condenser lenses 203, a phosphor member 228, optical fibers 241 configured to receive the laser light that is emitted from the semiconductor laser element 202 and condensed by the condenser lens 203 and transfer the received laser light to the phosphor member 228, and a reflecting mirror 229 configured to control white light emitted by the phosphor member 228.

The vehicle lighting fixture 200 described in Japanese Patent Application Laid-Open No. 2014-017096 has problems due to the phosphor member 228. Specifically, since the light emitted from the phosphor member 228 shows two spectrum peaks, meaning that the spectrum has a deep valley between the two peaks. Accordingly, the light emitted from the phosphor member 228 does not have continuity similar to that of natural sunlight. Therefore, the resulting light has reduced color rendering properties and the color of light emitted from the phosphor member may change depending on the observing angle with respect to the emission surface, resulting in occurrence of color separation.

SUMMARY

The presently disclosed subject matter was devised in view of these and other problems and features in association with the conventional art. According to an aspect of the presently disclosed subject matter, a vehicle lighting fixture can eliminate the use of a phosphor member that causes the reduced color rendering properties and the occurrence of color separation, specifically, can enhance the color rendering properties and suppress the occurrence of color separation more than a conventional white light source that use a semiconductor light emitting element such as an LD and a phosphor member (wavelength conversion member).

According to another aspect of the presently disclosed subject matter, a vehicle lighting fixture can include: a supercontinuum light source having any of a pulse laser light source and a continuous wave (CW) laser light source, and a nonlinear optical medium configured to convert corresponding one of pulse laser light output from the pulse laser light source and continuous wave laser light output from the continuous wave laser light source into supercontinuum light for output, the supercontinuum light source having a directivity characteristic narrower than Lambertian light; and an optical system configured to control light emitted from the supercontinuum light source to form a predetermined light distribution pattern for a vehicle, wherein the light controlled by the optical system can mainly contain coherent light.

According to still another aspect of the presently disclosed subject matter, the vehicle lighting fixture of the above-mentioned aspect can be configured such that the optical system can include an incoherent device configured to reduce coherency of the light emitted from the supercontinuum light source.

According to still another aspect of the presently disclosed subject matter, the vehicle lighting fixture of the above-mentioned aspect can be configured to further include: a first light source configured to mainly emit incoherent light; and a first optical system configured to control the light emitted from the first light source to form a basic light distribution pattern. In this vehicle lighting unit, the vehicle lighting fixture can form an additional light distribution pattern by the light mainly containing coherent light, the basic light distribution pattern can be wider than the additional light distribution pattern, and the basic light distribution pattern and the additional light distribution pattern can be overlaid on each other to form a predetermined light distribution pattern.

According to further another aspect of the presently disclosed subject matter, a vehicle lighting fixture can be configured to form a predetermined light distribution by overlaying a basic light distribution pattern and an additional light distribution pattern narrower than the basic light distribution pattern. The vehicle lighting fixture can include a first light source configured to mainly emit incoherent light, a first optical system configured to control the light emitted from the first light source to form the basic light distribution pattern; a second light source configured to mainly emit coherent light having a higher luminance and a narrower directivity angle than those of the first light source; and a second optical system configured to control the light emitted from the second light source to form the additional light distribution pattern.

With this configuration, the vehicle lighting fixture can eliminate the use of a phosphor member that causes the reduced color rendering properties and the occurrence of color separation, specifically, can enhance the color rendering properties and suppress the occurrence of color separation more than a conventional white light source that uses a semiconductor light emitting element such as an LD and a phosphor member (wavelength conversion member).

Furthermore, the vehicle lighting fixture can form the basic light distribution pattern with the light mainly containing incoherent light and the additional light distribution pattern with the light mainly containing coherent light overlaid with each other. The resulting predetermined light distribution can be formed with an excellent distant visibility as a low-beam or high-beam light distribution pattern.

The excellent distant visibility of the predetermined light distribution pattern can be achieved due to the additional light distribution pattern formed by the light from the second light source having a higher luminance and a narrower directivity angle than those of the light from the first light source, so that the light intensity of the additional light distribution pattern relatively becomes high. In addition to this, this is due to the additional light distribution pattern formed by the light mainly containing coherent light. Specifically, the light mainly containing coherent light can be light rays with a uniform phase when compared with the light mainly containing incoherent light and thus can be diverged less and can have a high straightness. Therefore, the additional light distribution pattern formed by the light mainly containing coherent light can be irradiated at a farther place.

According to another aspect of the presently disclosed subject matter, the vehicle lighting fixture of the above-mentioned aspect can be configured such that the first light source can be selected from the group consisting of an incandescent bulb, a halogen bulb, an HID bulb, and a light source configured by a combination of a semiconductor light emitting element and a wavelength converting member, and the second light source can be a supercontinuum light source configured to output supercontinuum light including light in a visible wavelength region.

This configuration can provide the same advantageous effects as mentioned above.

Furthermore, the second light source can eliminate the use of a phosphor member. This is because the supercontinuum light output from the supercontinuum light source is already white light.

The resulting vehicle lighting fixture can provide the more enhanced color rendering properties than the conventional white light source that uses a semiconductor light emitting element such as an LD and a phosphor member (wavelength conversion member) because of the continuity of supercontinuum light similar to that of natural sunlight.

Furthermore, the occurrence of color separation can be prevented due to the elimination of a phosphor member, resulting in less change (or no change) in color depending on the observing angle with respect to the supercontinuum light.

According to another aspect of the presently disclosed subject matter, the vehicle lighting fixture of the above-mentioned aspect can be configured such that the supercontinuum light source can include any one of a pulse laser light source and a CW laser light source, and a nonlinear optical medium configured to convert a pulse laser light output from the pulse laser light source or a CW laser light output from the CW laser light source into the supercontinuum light for output.

This configuration can provide the same advantageous effects as mentioned above.

According to still another aspect of the presently disclosed subject matter, the vehicle lighting fixture of the previous aspect can be configured such that the nonlinear optical medium can be a conversion optical fiber configured to convert the pulse laser light output from the pulse laser light source or the CW laser light output from the CW laser light source into the supercontinuum light for output.

This configuration can provide the same advantageous effects as mentioned above.

According to still another aspect of the presently disclosed subject matter, the vehicle lighting fixture of any of the above-mentioned aspects can be configured to further include a transmission optical fiber configured to transmit the supercontinuum light from the supercontinuum light source to the second optical system and have an emission end face, and the second optical system can control the supercontinuum light exiting through the emission end face of the transmission optical fiber.

With this configuration, an optical fiber suitable for a vehicle lighting fixture can be used as the transmission optical fiber. Furthermore, the separate transmission optical fiber can be easily replaced with a new one even when the transmission optical fiber is damaged or so.

According to still another aspect of the presently disclosed subject matter, the vehicle lighting fixture of the aforementioned aspect can be configured such that the conversion optical fiber has an emission end face and the second optical system can control the supercontinuum light exiting through the emission end face of the conversion optical fiber.

With this configuration, there is no need to provide a transmission optical fiber.

According to still another aspect of the presently disclosed subject matter, the vehicle lighting fixture of any one of the aforementioned aspects can be configured to include a removal member configured to remove from the supercontinuum light light other than light in a predetermined visible wavelength region, such that the second optical system can control the light that is the supercontinuum light excluding the light other than light in the predetermined visible wavelength region.

With this configuration, for example, the UV region and/or IR region light rays can be removed from the supercontinuum light, so that the degradation of common components constituting vehicle lighting fixtures (for example, an outer lens, a projector lens, etc.) and also peripheral members (for example, a housing, an extension, etc.) due to such light rays can be suppressed.

According to still another aspect of the presently disclosed subject matter, the vehicle lighting fixture of the previous aspect can be configured such that the removal member can be any one of an optical filter and a dichroic mirror.

With this configuration, the same or similar advantageous effects can be obtained.

According to still another aspect of the presently disclosed subject matter, the vehicle lighting fixture of any of the aforementioned aspects can be configured such that the predetermined light distribution pattern is a low-beam light distribution pattern.

With this configuration, the vehicle lighting fixture that can eliminate the use of a phosphor member that causes the reduced color rendering properties and the occurrence of color separation, specifically, that can enhance the color rendering properties and suppress the occurrence of color separation more than a conventional white light source that use a semiconductor light emitting element such as an LD and a phosphor member (wavelength conversion member) can form a suitable low-beam light distribution pattern.

Furthermore, the vehicle lighting fixture can form the basic light distribution pattern with the light mainly containing incoherent light and the additional light distribution pattern with the light mainly containing coherent light overlaid with each other to form the resulting low-beam light distribution with an excellent distant visibility.

According to still another aspect of the presently disclosed subject matter, the vehicle lighting fixture of any of the aforementioned aspects can be configured such that the predetermined light distribution pattern is a high-beam light distribution pattern.

With this configuration, the vehicle lighting fixture that can eliminate the use of a phosphor member that causes the reduced color rendering properties and the occurrence of color separation, specifically, that can enhance the color rendering properties and suppress the occurrence of color separation more than a conventional white light source that use a semiconductor light emitting element such as an LD and a phosphor member (wavelength conversion member) can form a suitable high-beam light distribution pattern.

Furthermore, the vehicle lighting fixture can form the basic light distribution pattern with the light mainly containing incoherent light and the additional light distribution pattern with the light mainly containing coherent light overlaid with each other to form the resulting high-beam light distribution with an excellent distant visibility.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lights of the presently disclosed subject matter with reference to the accompanying drawings in accordance with exemplary embodiments.

Figure 1:
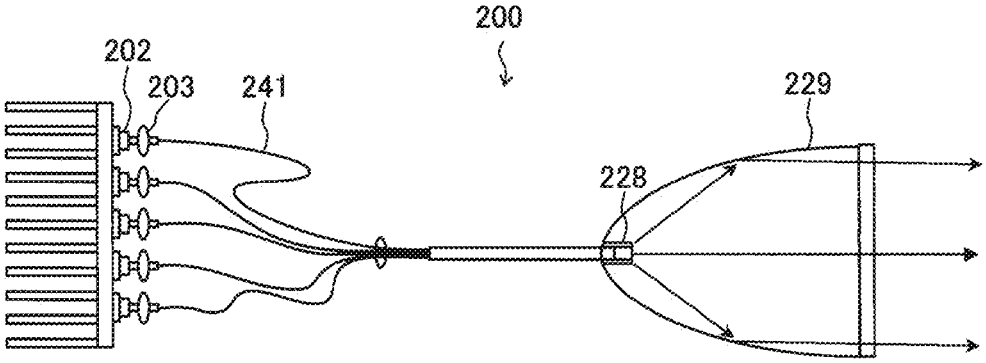
FIG. 1 Conventional Art
FIG. 1 is a schematic diagram illustrating a conventional vehicle lighting fixture 200 described in Japanese Patent Application Laid-Open No. 2014-017096.
Figure 2:
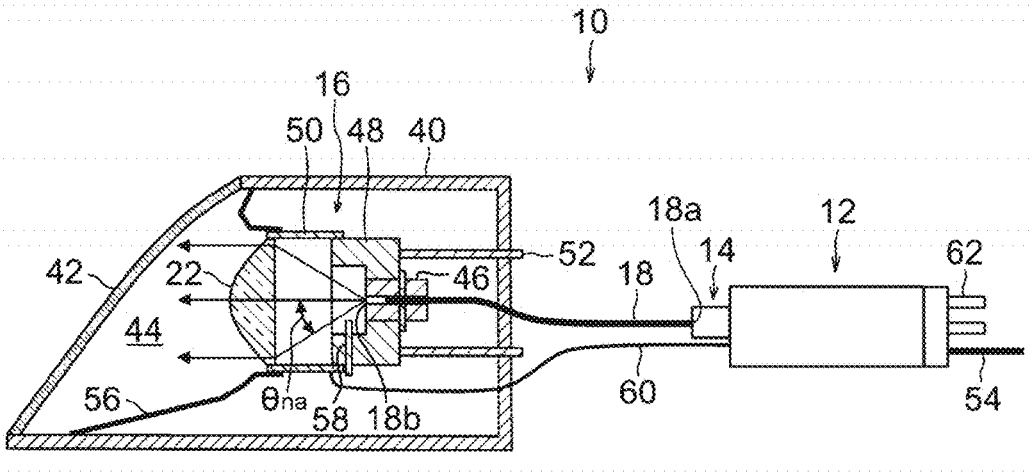
FIG. 2 is a vertical cross-sectional view of a vehicle lighting fixture 10 made in accordance with principles of the presently disclosed subject matter as an exemplary embodiment.
Figure 3:
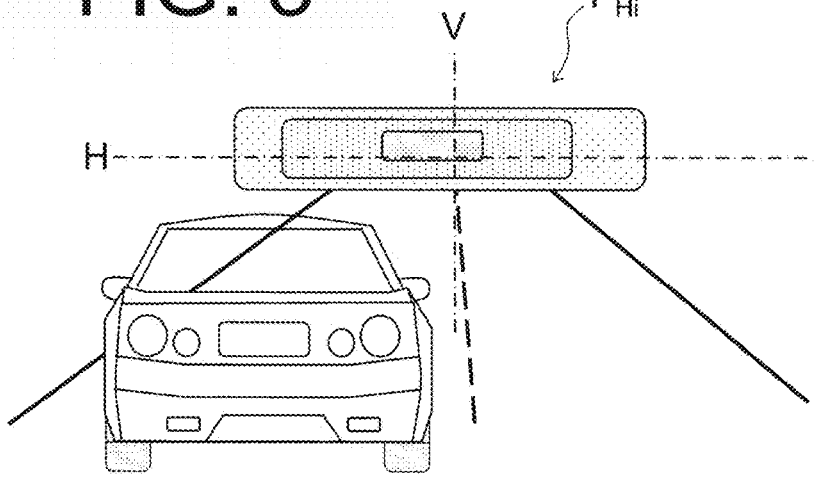
FIG. 3 is a diagram illustrating an example of a high-beam light distribution pattern $P_{Hi}$.

FIG. 2 is a vertical cross-sectional view of a vehicle lighting fixture 10 made in accordance with the principles of the presently disclosed subject matter as a first exemplary embodiment. FIG. 3 is a diagram illustrating an example of a high-beam light distribution pattern $P_{Hi}$ formed by the vehicle lighting fixture 10.

As illustrated in FIG. 2, the vehicle lighting fixture 10 can include a supercontinuum light source 12 (hereinafter, referred to simply as an SC light source), a removal member 14, an optical system 16, and a transmission optical fiber 18, for example. The SC light source 12 can be configured to output supercontinuum light (hereinafter referred to simply as SC light) containing light in a visible wavelength region. The removal member 14 can be configured to remove (cut) light other than the light in a predetermined visible wavelength region (for example, 450 nm to 700 nm) from the SC light output from the SC light source 12. The optical system 16 can be configured to control the SC light output from the SC light source 12 and serve as a high-beam lighting unit 16, for example. The transmission optical fiber 18 can transmit the SC light output from the SC light source 12 to the high-beam lighting unit 16.

In the high-beam lighting unit 16, the transmission optical fiber 18 can include an emission end face 18*b* serving as a light source installed therewithin. The high-beam lighting unit 16 can include a projector lens 22 and the emission end face 18*b* as the light source. The vehicle lighting fixture 10 can further include a housing 40 and an outer lens 42 together defining a lighting chamber 44. The high-beam lighting unit 16 can be disposed in the lighting chamber 44. The SC light source 12 may be disposed in the lighting chamber 44.

The vehicle lighting fixture 10 can further include a lamp housing 48 and a sleeve 46 attached to the lamp housing 48 and having an optical fiber insertion hole. The transmission optical fiber 18 can be inserted into the optical fiber insertion hole of the sleeve 46 so as to be held by the sleeve 46 while the emission end face 18*b* of the inserted transmission optical fiber 18 is disposed at or near a rear-side focal point of the projector lens 22. Note that the transmission optical fiber 18 has an incident end face that can be detachably attached to the removal member 14.

The projector lens 22 can be a convex lens having a front convex lens surface and a rear flat lens surface, and held by a lens holder 50 installed within the lighting chamber 44, so that the projector lens 22 can be disposed in front of the emission end face 18*b* of the transmission optical fiber 18. Reference number 52 denotes an optical axis adjustment mechanism, 54 a power/signal line, 56 an extension, 58 a light-receiving sensor, 60 a light-receiving sensor signal line, and 62 a heat dissipation plate.

From the SC light that is output from the SC light source 12 and includes light in the visible wavelength region, light other than light in a predetermined visible wavelength region (for example, 450 nm to 700 nm) can be removed by the removal member 14, and then, the remaining SC light can be condensed by the condenser lens 20 (which will be described later with reference to FIG. 17). The condensed SC light can be introduced into the transmission optical fiber 18 through the incident end face 18*a* thereof and transmitted therethrough to the emission end face 18*b*. The SC light can exit through the emission end face 18*b* to pass through the projector lens 22 and be projected thereby forming a high-beam light distribution pattern $P_{Hi}$ as illustrated in FIG. 3.

The term "supercontinuum" means a phenomenon in which when laser light (pulse laser light) output from a pulse laser light source such as ultra short light pulse or laser light (CW laser light or continuous light) output from a continuous wave (CW) laser light source is made to enter a nonlinear optical material, the spectrum thereof is continuously, rapidly broaden due to nonlinear optical effects such as self-phase modulation, cross-phase modulation, four wave mixing, Raman scattering, etc. The light having the broadened spectrum due to this phenomenon may be called SC light. The SC light is multi-wavelength coherent light, and therefore, the SC light has very weak speckle noise (which is not sensed by naked eyes). The SC light source can thus be used as an illumination light source without taking countermeasures for speckle noise.

The SC light source 12 or the emission end face 18*b* of the transmission fiber 18 (virtual light source) can be used as a light source for a vehicle lighting fixture such as for the high-beam lighting unit 16. Advantageous effects derived therefrom will be discussed below.

Figure 4A:
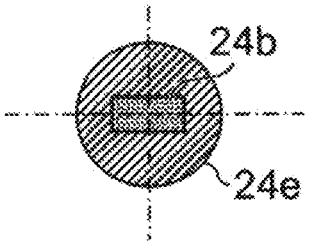
FIGS. 4A and 4B are a front view and a side view (cross-sectional view) of a white LD light source 24 including a blue LD element 24*a* and a yellow phosphor member 24*b* (wavelength converting member) used in combination, respectively.
Figure 4B:
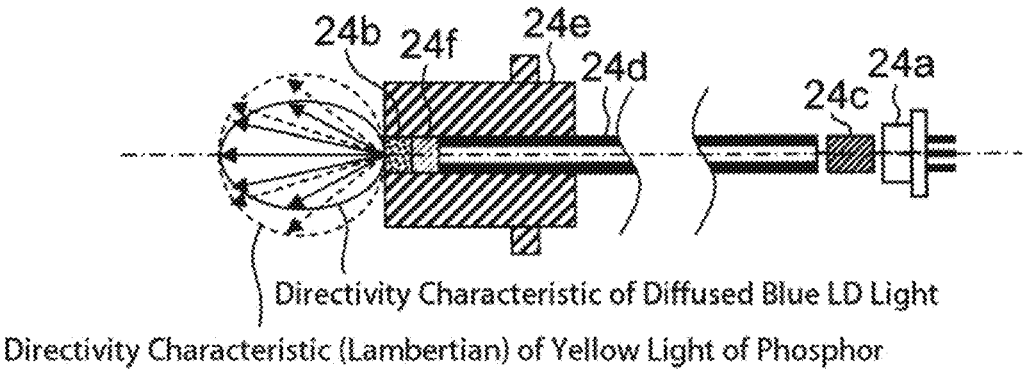

FIGS. 4A and 4B are a front view and a side view (cross-sectional view) of a white LD light source 24 including a blue LD element 24*a* and a yellow phosphor member 24*b* (wavelength converting member) used in combination. First, as illustrated in these drawings, the SC light source 12 does not need any wavelength converting member like the yellow phosphor member 24*b*.

In the white LD light source 24 including the blue LD element 24*a* and the yellow phosphor member 24*b* (wavelength converting member) used in combination, blue laser light emitted from the blue LD element 24*a* can excite the yellow phosphor member 24*b* to make the yellow phosphor member 24*b* emit yellow light. Then, the passing blue laser light and the emitted yellow light from the yellow phosphor member 24*b* can be mixed together to emit white light (pseud white light). On the contrary to this, the SC light source 12 can emit the SC light that is white light. Therefore, the SC light source 12 does not need any wavelength converting member for emitting white light.

Note that in FIG. 4B, reference number 24*c* denotes a condenser lens, 24*d* an optical fiber, 24*e* a sleeve, and 24*f* a diffusing member. The sleeve 24*e* can be configured to hold the yellow phosphor member 24*d*, the diffusing member 24*f*, and the emission end portion of the optical fiber 24*d*. The diffusing member 24*f* can diffuse laser light that is emitted from the blue LD element 24*a* and transmitted through the optical fiber 24*d* and exits through the emission end portion of the optical fiber 24*d*.

Second, the SC light source 12 can have improved color rendering properties when compared with the white LD light source 24 including the blue LD element 24*a* and the yellow phosphor member 24*b* (wavelength converting member) used in combination.

Figure 5:
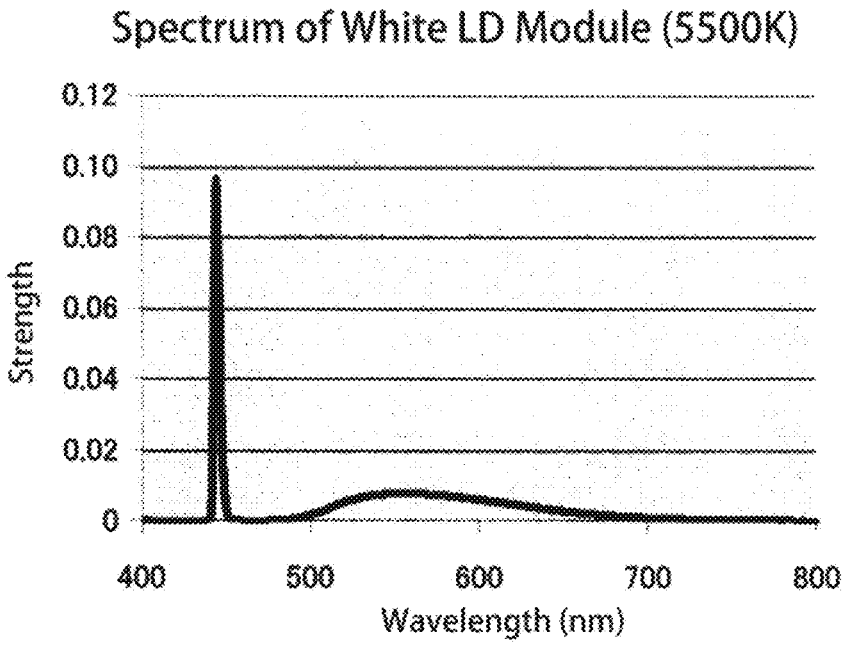
FIG. 5 is a graph showing a spectrum of light output from the white LD light source.

As illustrated in FIG. 5, the white LD light source 24 including the blue LD element 24*a* and the yellow phosphor member 24*b* (wavelength converting member) used in combination can emit light having a spectrum with two peaks between which a deep valley is formed. On the contrary, the SC light source 12 can emit the SC light having a spectrum with the continuity similar to that of natural sunlight, as illustrated in FIGS. 7 and 9 to 16.

Third, the SC light source 12 can emit the ES light with the directivity characteristic narrower than the white LD light source 24 including the blue LD element 24*a* and the yellow phosphor member 24*b* (wavelength converting member) used in combination. The narrower directivity characteristic of the SC light source 12 can allow a much amount of light to enter a smaller projector lens. The use of a smaller projector lens as the projector lens 22 can miniaturize the entire dimension of the vehicle lighting fixture 10.

Figure 6A:
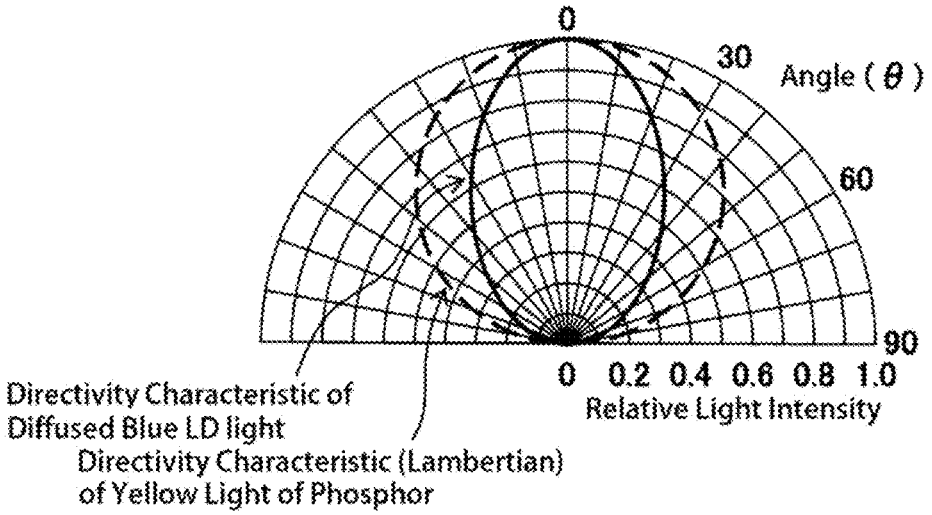
FIGS. 6A and 6B are a diagram showing the directivity characteristic of the white LD light source, and a diagram showing the directivity characteristic of the SC light source (specifically, the emission end face 18*b* of the transmission optical fiber 18)
Figure 6B:
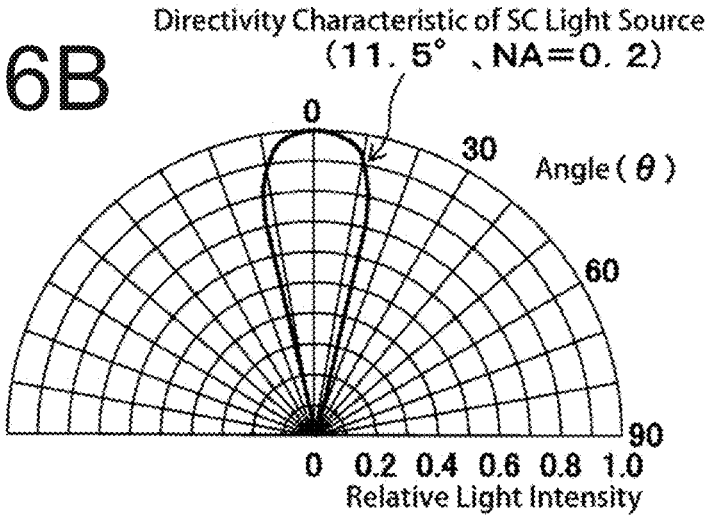
Figure 7A:
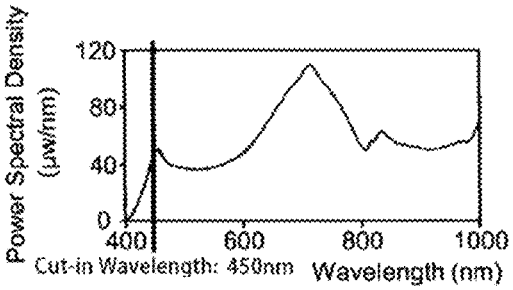
FIGS. 7A, 7B, 7C, 7D, and 7E are each an exemplary spectrum of SC light output from an apparatus with a type name "WhiteLase Micro," "SC400," "SCUV-3," "SC450," and "SC480"
Figure 7B:
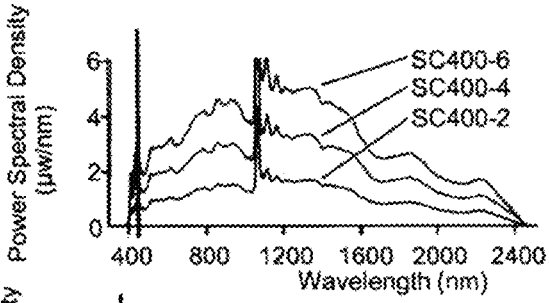
Figure 7C:
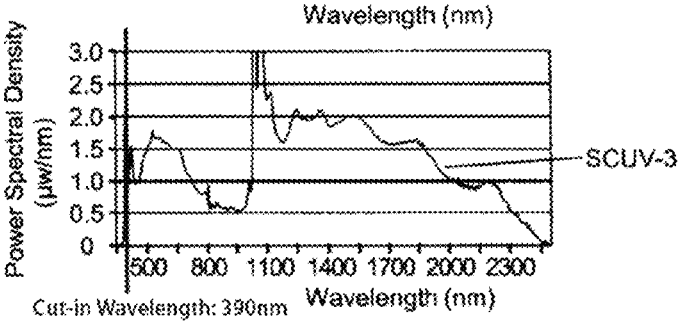
Figure 7D:
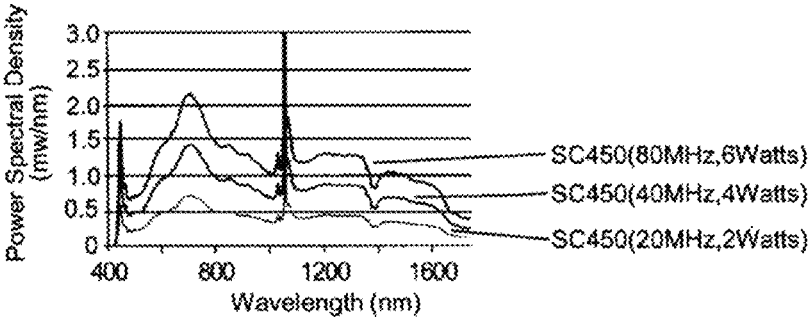
Figure 7E:
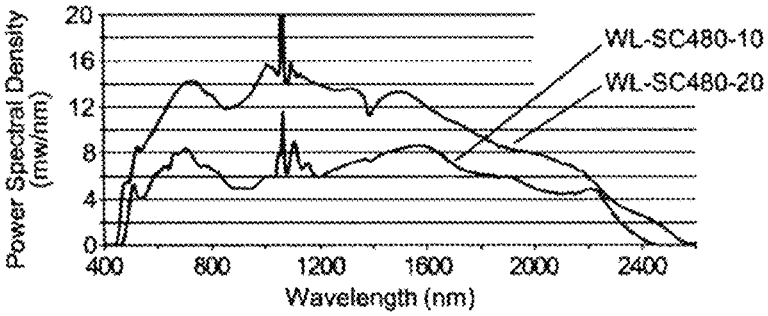

FIG. 6A is a diagram showing the directivity characteristic of the white LD light source 24 including the blue LD element 24*a* and the yellow phosphor member 24*b* (wavelength converting member) used in combination, and FIG. 6B is a diagram showing the directivity characteristic of the SC light source 12 (or the emission end face 18*b* of the transmission optical fiber 18). As illustrated in FIG. 6A, the directivity characteristic of the white LD light source 24 is always Lambertian. On the contrary, the SC light source 12 can provide the narrower directivity characteristic. For example, when an optical fiber having an NA of 0.2 is used as the transmission optical fiber 18, the directivity characteristic of $\theta_{na}$=11.5° can be imparted. Thus, the adjustment of NA can narrow the directivity characteristic more. This is advantageous for the presently disclosed subject matter when compared with the use of the conventional white LD light source 12.

Examples of the SC light source 12 configured to output SC light including light in the visible wavelength region may include supercontinuum white light sources "WhiteLase series" available from Fianium Ltd., such as "WhiteLase Micro," "SC400," "SCUV-3," "SC450," and "SC480."

These white light sources each includes a pulse laser light source (for example, pulse width: 6 ps, repeated frequency: 20 to 100 MHz) and a linear optical medium such as an optical fiber. As illustrated in FIGS. 7A to 7E, they can output SC light including light in the visible wavelength region. (see http://www.tokyoinst.co.jp/product_file/file/FI01_cat01_ja.pdf, http://forc-photonics.ru/data/files/sc-450-450-pp.pdf, and http://www.fianium.com/pdf/WhiteLase_SC480_BrightLase_v1.pdf.) FIGS. 7A, 7B, 7C, 7D, and 7E are each an exemplary spectrum of SC light output from an apparatus with a type name "WhiteLase Micro," "SC400," "SCUV-3," "SC450," and "SC480."

Figure 8A:
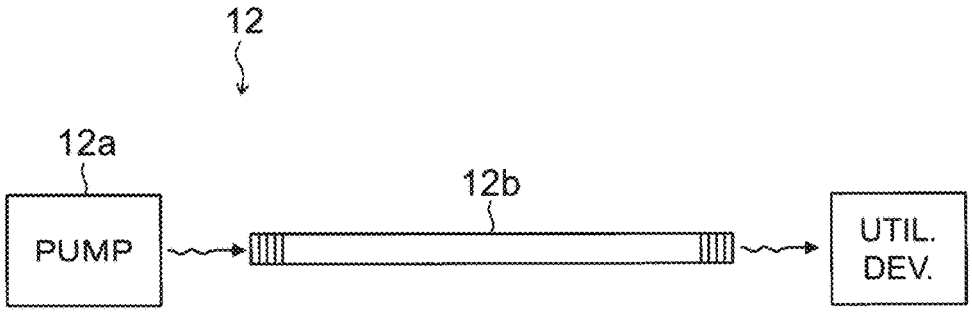
FIGS. 8A and 8B are each a diagram illustrating a configuration example of an SC light source 12 configured to output the SC light containing light in a visible wavelength region.
Figure 8B:
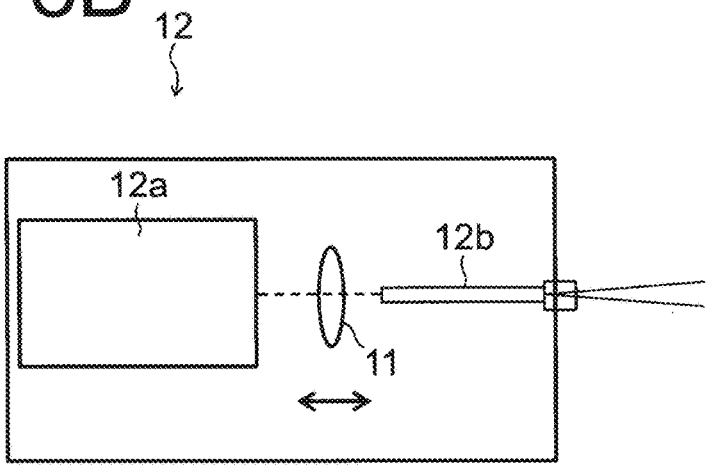

A general SC light source that can output SC light including light in the visible wavelength region can be configured to include a pulse laser light source (or a CW laser light source), and a nonlinear optical medium configured to receive the pulse laser light output from the pulse laser light source (or CW laser light output from the CW laser light source) and convert the same to the SC light. FIG. 8A illustrates a configuration example of an SC light source configured to output the SC light containing light in a visible wavelength region described in U.S. Pat. No. 6,097,870, and FIG. 8B illustrates a configuration example of an SC light source configured to output the SC light containing light in a visible wavelength region described in U.S. Pat. No. 6,611,643. In FIG. 8B, reference number 11 denotes a focusing optical system.

Examples of the pulse laser light source 12*a* may include a mode locked laser light source such as a titanium-sapphire laser light source (see, for example, Optics Letters, Oct. 1, 2000, Vol. 25, No. 19, pp. 1415-1417; http://www.n-lo.hw.ac.uk/node/8; and U.S. Pat. No. 6,611,643), a fiber laser light source such as a ring-type laser light source using an erbium-doped fiber (see, for example, Japanese Patent Application Laid-Open No. 2009-169041), and a Q-switched laser light source (see, for example, U.S. Patent Application Laid-Open No. 2014/0153888A1).

Examples of the CW laser light source may include a fiber laser light source such as an yttrium-doped fiber laser light source (see, for example, http://cdn.intechopen.com/pdfs-wm/26780.pdf).

Examples of the nonlinear optical medium 12*b* may include converting optical fibers configured to convert pulse laser light output from the pulse laser light source 12*a* (or CW laser light output from the CW laser light source) into SC light for output, such as a microstructured optical fiber and a tapered fiber. The microstructured optical fiber 12*b* is known as a photonic crystal fiber (PCF), a holey fiber, or a hole-assisted fiber.

Figure 9:
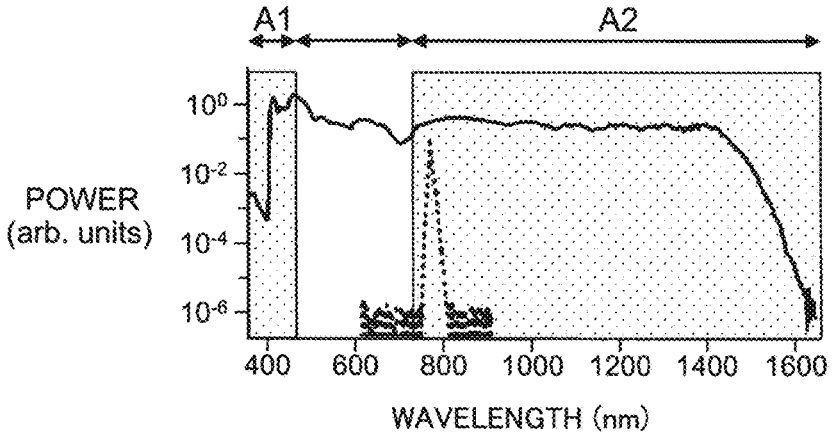
FIG. 9 is a diagram showing an exemplary spectrum of an SC light containing light in a visible wavelength region.

Examples of the microstructured optical fiber 12*b* used may include those described in U.S. Pat. No. 6,097,870 (for example, those having a core diameter of 0.5 to 7 μm). In this case, the SC light containing light in a visible wavelength region as illustrated in FIG. 9 can be output.

Figure 10:
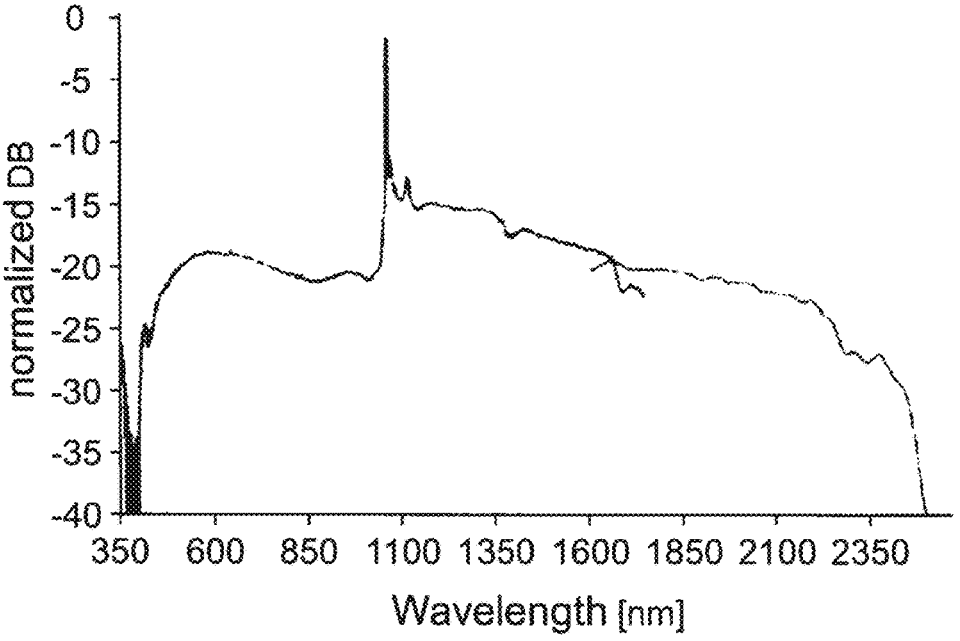
FIG. 10 is a diagram showing an exemplary spectrum of an SC light containing light in a visible wavelength region.
Figure 11:
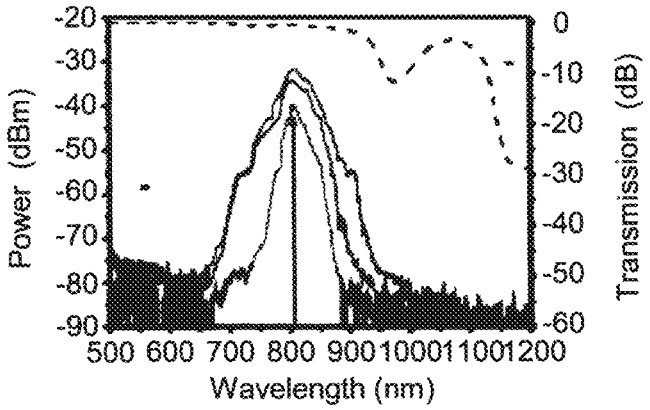
FIG. 11 is a diagram showing an exemplary spectrum of an SC light containing light in a visible wavelength region.

Further examples of the microstructured optical fiber 12*b* used may include those described in U.S. Patent Application Laid-Open No. 2014/0153888A1 (for example, those having a core diameter of 1 to 5 μm). In this case, the SC light containing light in a visible wavelength region as illustrated in FIG. 10 can be output.

Further examples of the microstructured optical fiber 12*b* used may include those described in OPTICS EXPRESS, 23 Jun. 2008, Vol. 16, No. 13, pp. 9671-9676. In this case, the SC light containing light in a visible wavelength region as illustrated in FIG. 10 can be output.

Figure 12:
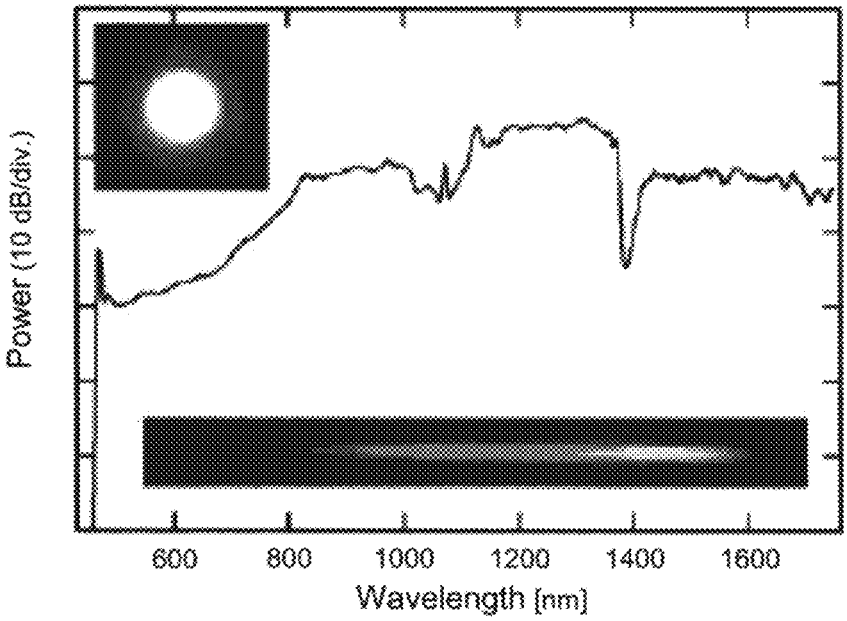
FIG. 12 is a diagram showing an exemplary spectrum of an SC light containing light in a visible wavelength region.

Further examples of the microstructured optical fiber 12*b* used may include those described in http://cdn.intechopen.com/pdfs-wm/26780.pdf. In this case, the SC light containing light in a visible wavelength region as illustrated in FIG. 12 can be output.

Figure 13:
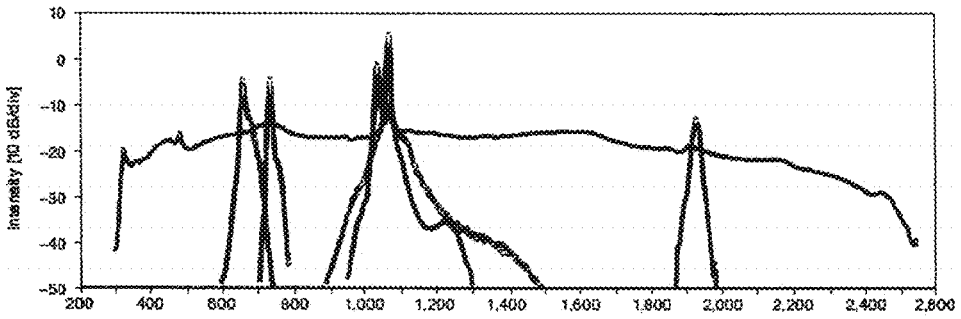
FIG. 13 is a diagram showing an exemplary spectrum of an SC light containing light in a visible wavelength region.

Further examples of the microstructured optical fiber 12*b* used may include those described in http://www.osa-opn.org/home/articles/volume_23/issue_3/features/of-the-art_photonic_crystal fiber/#.VIbBOMkorpI. In this case, the SC light containing light in a visible wavelength region as illustrated in FIG. 13 can be output.

Figure 14:
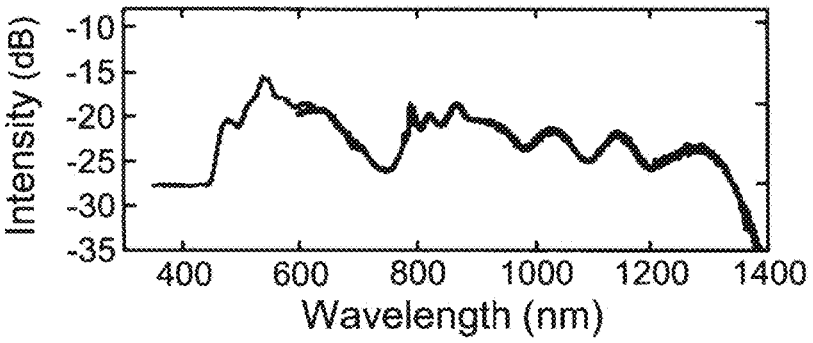
FIG. 14 is a diagram showing an exemplary spectrum of an SC light containing light in a visible wavelength region.

Further examples of the microstructured optical fiber 12*b* used may include those described in Japanese Patent Application Laid-Open No. 2009-169041. In this case, the SC light containing light in a visible wavelength region as illustrated in FIG. 14 can be output.

Further examples of the microstructured optical fiber 12*b* used may include those described in U.S. Pat. No. 6,611,643. In this case, the SC light containing light in a visible wavelength region can be output.

Figure 15A:
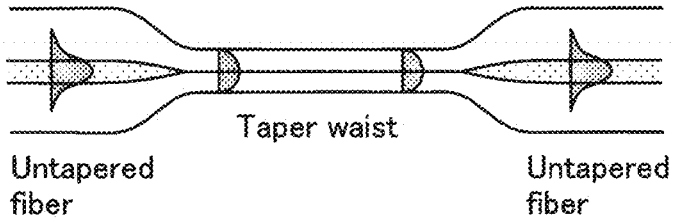
FIGS. 15A and 15B are a diagram illustrating an example of a tapered fiber, and a diagram showing an exemplary spectrum of an SC light containing light in a visible wavelength region, respectively.
Figure 15B:
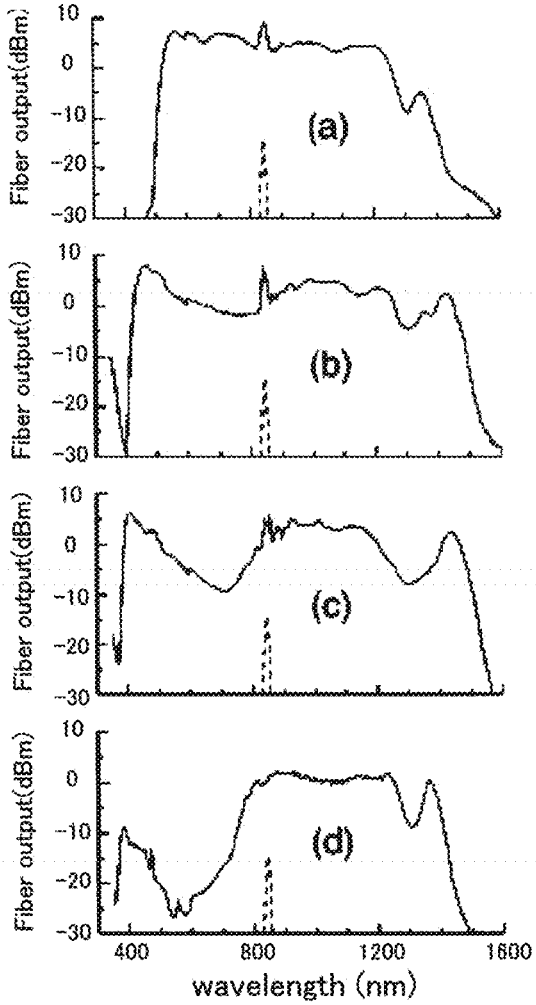

Further examples of the microstructured optical fiber 12*b* used may include those described in Optics Letters, Oct. 1, 2000, Vol. 25, No. 19, pp. 1415-1417 (for example, those having a core diameter of 8.2 μm and a waist diameter of 1.5 to 2.0 μm, see FIG. 15A). In this case, the SC light containing light in a visible wavelength region as illustrated in FIG. 15B can be output.

Figure 16:
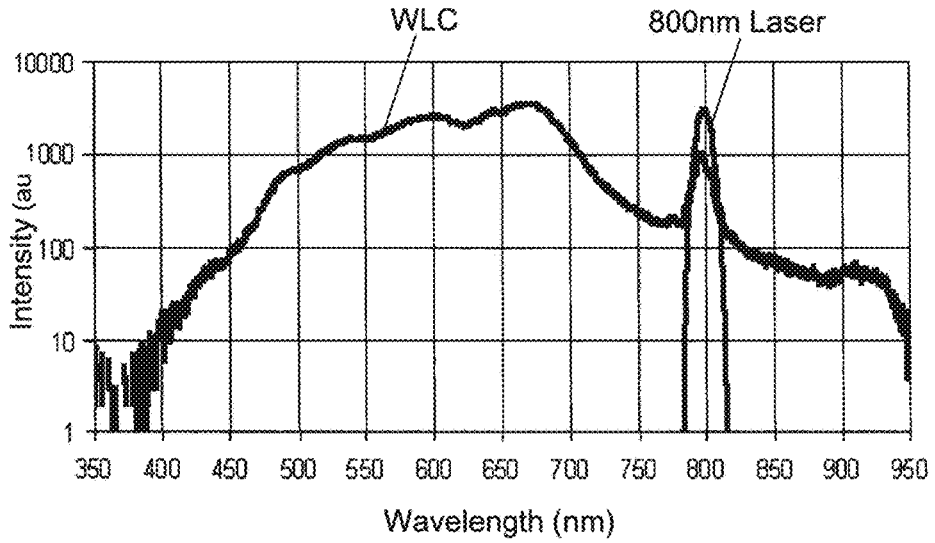
FIG. 16 is a diagram showing an exemplary spectrum of an SC light containing light in a visible wavelength region.

Further examples of the nonlinear optical medium used include those described in http://www.nlo.hw.ac.uk/node/8. In this case, the SC light containing light in a visible wavelength region as illustrated in FIG. 16 can be output.

Figure 17:
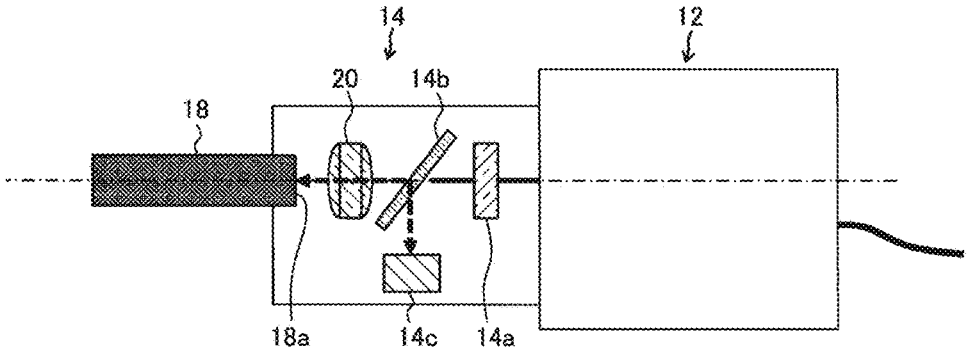
FIG. 17 is a cross-sectional view illustrating an internal structure of a removal member 14.

FIG. 17 is a cross-sectional view illustrating an internal structure of the removal member 14.

As illustrated in FIG. 17, the removal member 14 can be configured to remove (cut) light other than the light in a predetermined visible wavelength region from the SC light output from the SC light source 12, for example, remove the regions denoted by A1 and A2 in FIG. 9. In consideration of the spectral luminous efficiency (or CIE standard spectral luminous efficiency) the preferable predetermined visible wavelength region may be 450 nm to 700 nm although the upper limit and the lower limit thereof may be appropriately changed, such as 460 nm to 630 nm.

By using the removal member 14, the UV region and/or IR region light rays can be removed from the SC light, so that the degradation of common components constituting the vehicle lighting fixture 10 (for example, the outer lens 42 and the projector lens 22) and/or peripheral members (for example, the housing 40 and the extension 56) due to such light rays can be suppressed.

The removal member 14 can be located between the SC light source 12 and the incident end face 18*a* of the transmission optical fiber 18. This is not restrictive, and the removal member 14 may be located in the middle of the transmission optical fiber 18 or on the emission end face 18*b* side of the transmission optical fiber 18.

The removal member 14 can include a first removal member 14*a* and a second removal member 14*b*. The first removal member 14*a* can be configured to remove (cut) light having wavelengths shorter than the lower limit of the predetermined visible wavelength region (for example, shorter than 450 nm corresponding to the region A1 in FIG. 9). The second removal member 14*b* can be configured to remove (cut) light having wavelengths longer than the upper limit of the predetermined visible wavelength region (for example, longer than 700 nm corresponding to the region A2 in FIG. 9).

The first removal member 14*a* can be an optical filter disposed on the optical path of SC light output from the SC light source 12. The optical filter can be configured to cut the light having wavelengths shorter than the lower limit (for example, 450 nm) of the predetermined visible wavelength region (cut the light in the region A1 in FIG. 9) while passing the light other than this cut light therethrough. Another example of the first removal member 14*a* can be a dichroic mirror configured to reflect the light having wavelengths shorter than the lower limit (for example, 450 nm) of the predetermined visible wavelength region sideward (for example, toward an UV absorbing material disposed sideward) while passing the light other than this cut light therethrough.

The second removal member 14*b* can be a dichroic mirror disposed on the optical path of SC light having passed through the first removal member 14*a*. The dichroic mirror can be configured to reflect the light having wavelengths longer than the upper limit (for example, 700 nm) of the predetermined visible wavelength region (cut the light in the region A2 in FIG. 9) sideward (for example, toward an IR absorbing material 14*c* disposed sideward) while passing the light other than this cut light therethrough. Another example of the second removal member 14*b* can be an optical filter configured to cut the light having wavelengths longer than the upper limit (for example, 700 nm) of the predetermined visible wavelength region while passing the light other than this cut light therethrough.

Figure 18A:
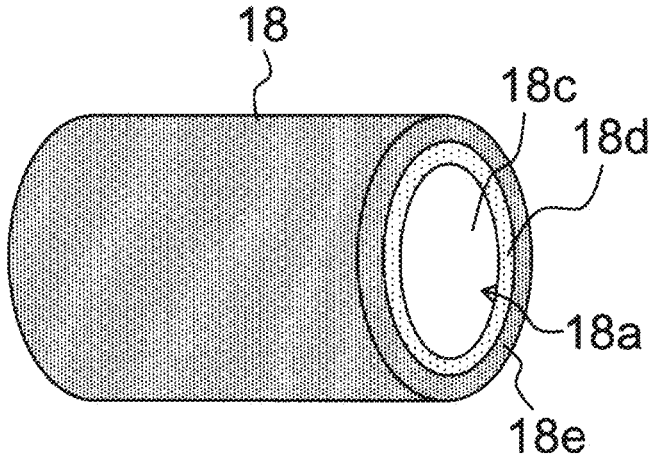
FIGS. 18A and 18B are each a diagram illustrating an example of a transmission optical fiber 18.
Figure 18B:
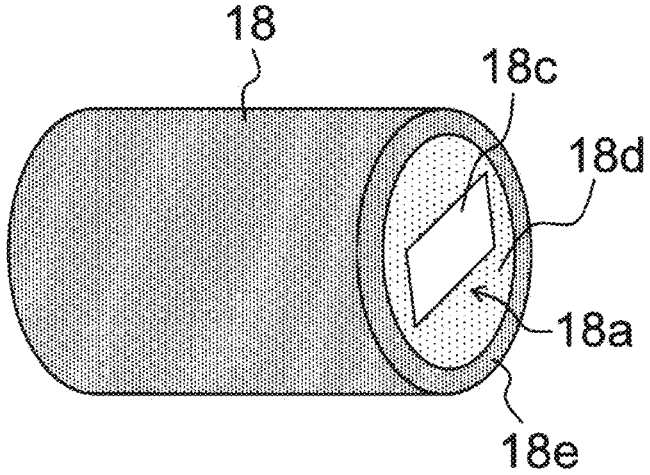

FIGS. 18A and 18B are each a diagram illustrating an example of the transmission optical fiber 18.

As illustrated in FIG. 18A, the transmission optical fiber 18 can be configured to include a core 18*c*, a clad 18*d* surrounding the core 18*c*, and a sheath 18*e* covering the clad 18. The core 18*c* can include the incident end face 18*a* for receiving the SC light and the emission end face 18*b* for outputting the SC light. The materials of the core 18*c* and the clad 18*d* may be any optical materials, such as quartz glass, synthetic resin, and other suitable materials.

The transmission optical fiber 18 may be a single mode optical fiber, a multimode optical fiber, a step-index optical fiber, or a graded index optical fiber. Among them, in order to reduce the coherency of the SC light, the multimode optical fiber may preferably be used as the transmission optical fiber 18.

The transmission optical fiber 18 can be formed to have a circular cross section as illustrated in FIG. 18A or can be formed to have a rectangular cross section of the core 18*c* as illustrated in FIG. 18B. It is desired for a transmission optical fiber to have a rectangular cross section when used in a light source of a vehicle lighting fixture because the end face strength becomes a top hat type.

Examples of the transmission optical fiber 18 suitably used for the vehicle lighting fixture 10 may include a circular optical fiber having a circular core with a core diameter of 100 μm to 800 μm, and an optical fiber having a rectangular core with a rectangular cross section of 100 μm×100 μm to 200 μm×400 μm. The transmission optical fiber 18 can be detachably attached to the SC light source 12, which can facilitate the replacing work when the transmission optical fiber 18 has defects.

The SC light exiting through the emission end face 18*b* of the transmission optical fiber 18 can be reduced in coherency by an incoherent device to be described next. The incoherent device can change the SC light having the laser light characteristics to be incoherent, thereby achieving eye-safe. Note that the incoherent device is not essential.

For example, when a multimode optical fiber is used as the transmission optical fiber 18, spatial coherency can be reduced and temporal coherency can be slightly reduced. This is because the intensity distribution is made uniform during the propagation of SC light. Furthermore, the spatial coherency can be further reduced by lengthening the transmission optical fiber 18 (multimode optical fiber), adding a twist (kink) to the transmission optical fiber 18 (multimode optical fiber), or increasing the number of loops of the transmission optical fiber 18 (multimode optical fiber). The use of the transmission optical fiber 18 with a rectangular core like in FIG. 18B can reduce the spatial coherency more effectively than the optical fiber having a circular cross section.

The coherency of the SC light exiting through the emission end face 18*b* of the transmission optical fiber 18 can be reduced by applying high frequency vibration to the transmission optical fiber 18.

Figure 19A:
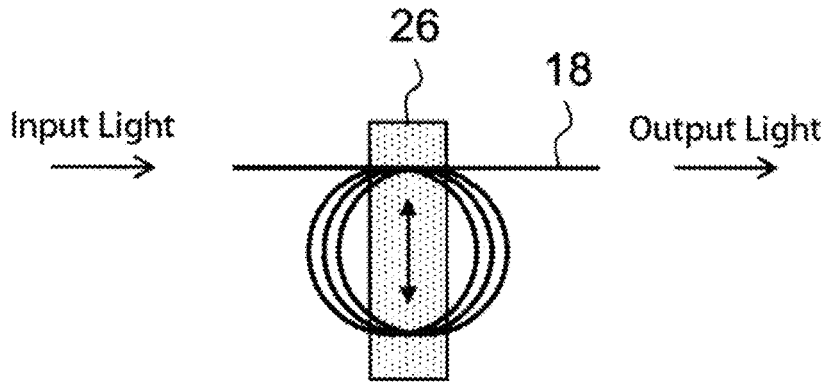
FIGS. 19A and 19B are each a diagram illustrating an example of an incoherent device.
Figure 19B:
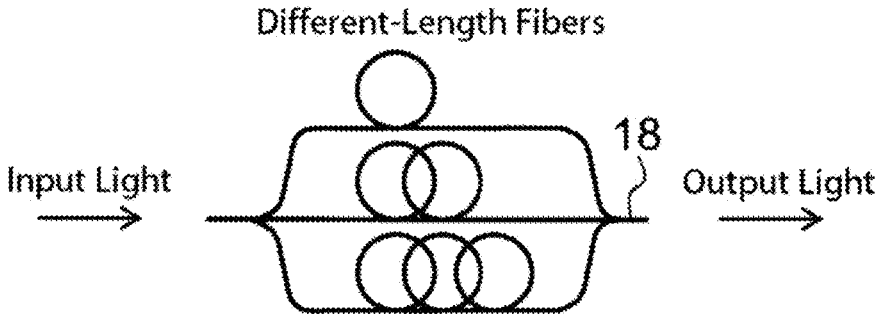

For example, as illustrated in FIG. 19A, the looped transmission fiber 18 is applied with high frequency vibration of about 1.2 MHz by a vibrator 26 in a radial direction or a circumferential direction to thereby reduce the spatial coherency and the temporal coherency. This is because the index of refraction of the transmission optical fiber 18 is temporally varied.

Alternatively, the temporal coherency of the SC light exiting through the emission end face 18*b* of the transmission optical fiber 18 can be reduced by providing a plurality of branched optical fibers with mutually different lengths in the mid of the transmission optical fiber 18 arranged side by side. In this case, if a multimode optical fiber is used as the transmission optical fiber 18, the spatial coherence can be simultaneously reduced.

Furthermore, the coherency of the SC light exiting through the emission end face 18*b* of the transmission optical fiber 18 can be reduced by an incoherent device 28.

Figure 20A:
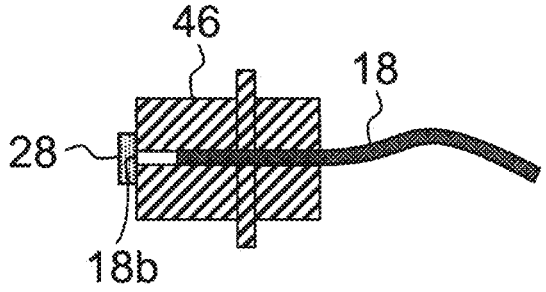
FIGS. 20A and 20B are each a diagram illustrating an example of an incoherent device.

For example, as illustrated in FIG. 20A, the incoherent device 28 can be disposed on the side closer to the emission end face 18*b* of the transmission optical fiber 18, thereby reducing the coherency.

As the incoherent device 28, a light-transmitting member in which a scattering agent is dispersed can be used. In this case, the spatial coherency can be reduced.

Figure 20B:
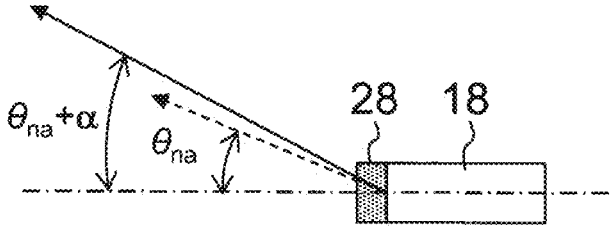

When a scattering and diffraction plate is used as the incoherent device, the coherency can be reduced without deteriorating the narrow directivity characteristics. Examples of the scattering and diffraction plate may include a scattering and diffraction plate composed of a light-transmitting glass in which air is dispersed to form pores having a pore diameter of 1 μm to 5 μm, and a scattering and diffraction plate composed of a light-transmitting low refractive glass (n=1.4 or less) in which a light-transmitting high refractive material with a particle diameter 1 μm to 5 μm is dispersed, the high refractive material being selected from the group consisting of silicon carbide (SiC), alumina ($Al_2O_3$), aluminum nitride (AlN), and titanium oxide ($TiO_2$). If the particle diameter is 1 μm to 5 μm, then the narrow directivity characteristics can be maintained because any wide diffusion like Rayleigh scattering does not occur but forward diffusion occurs (see $\theta_{na}+\alpha$ in FIG. 20B). In FIG. 20B, the $\theta_{na}$ represents the directivity characteristics when any incoherent device is not used.

Furthermore, as the incoherent device 28, a diffraction optical element (DOE) such as a grating cell array and a holographic optical element (HOE) can be used.

As another example of the incoherent device 28, a phosphor scattering plate can be used. The phosphor scattering plate may be configured such that a phosphor capable of being excited by UV rays to emit blue, blue green, green, yellow, orange, or red light is dispersed in a substrate body formed from a light-transmitting resin, glass, or crystal. The phosphor may be added with a scatting material having different index of refraction from that of the substrate body. When the phosphor scattering plate is used as the incoherent device 28, the first removal member 14*a* may be omitted. The amount of the phosphor may be desirably set such that the resulting visible light spectrum of the SC light approaches visible light spectrum of sunlight.

A description will now be given of an example of a system configuration configured to control the vehicle lighting fixture 10 with reference to FIG. 21.

Figure 21:
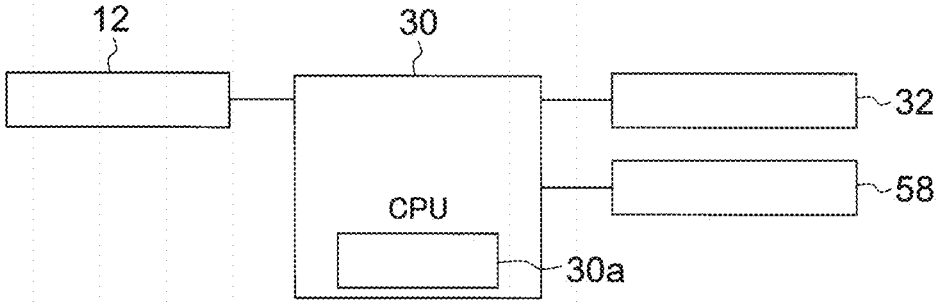
FIG. 21 is a block diagram illustrating a system configuration configured to control the vehicle lighting fixture 10.

FIG. 21 is a block diagram illustrating the system configuration configured to control the vehicle lighting fixture 10.

As illustrated, the system can include an arithmetic and control unit 30 (CPU) configured to control the entire operation thereof. The arithmetic and control unit 30 can be connected to a headlamp switch 32, a light-receiving sensor 58, the SC light source 12, a program storing unit (not illustrated) configured to store various programs to be executed by the arithmetic and control unit 30, a RAM (not illustrated) serving as a working area, etc. Further, the control unit 30 can include a failure recorder (or storage device) 30*a* configured to store failure records of the headlamp, criteria for failure, or the like. The light-receiving sensor 58 can be configured to monitor the output state of the SC light and detect the abnormal output of the SC light. On the basis of the resulting data from the light-receiving sensor 58, the output of the SC light can be adjusted or stopped when the output is abnormal. Furthermore, the abnormal state of the transmission optical fiber 18 can be detected.

A description will next be given of an operation example of the vehicle lighting fixture 10 with the above-described configuration serving as a high-beam lighting unit 16, with reference to FIG. 22.

Figure 22:
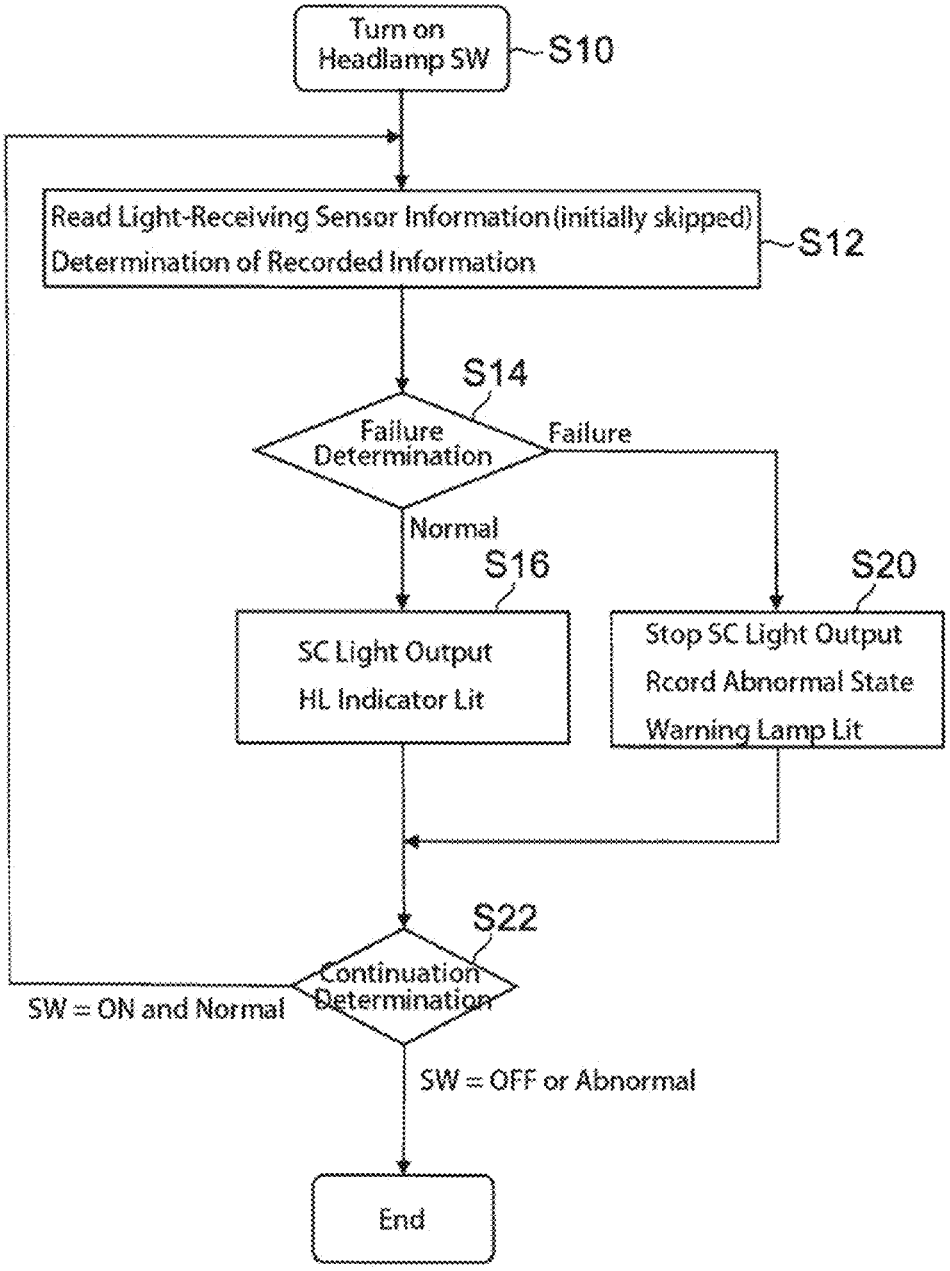
FIG. 22 is a flow chart showing an operation example of a vehicle lighting fixture 10 (high-beam lighting unit 16)

FIG. 22 is a flow chart showing the operation example of the vehicle lighting fixture 10 (high-beam lighting unit 16).

The following processing can be achieved by making the arithmetic and control unit 30 read out a predetermined program stored in the program storing unit into the RAM and execute the same.

First, when the headlamp switch 32 is turned on (step S10), the information (signal) from the light-receiving sensor 58 is read and the determination of recorded information is executed (step S12). Then, whether the SC light source 12 is normal or not is determined on the basis of the read information (read signal) (step S14). As a result, when it is normal is determined (step S14: NORMAL), the arithmetic and control unit 30 controls the SC light source 12 to output the SC light (step S16). In this case, a vehicle body on which the vehicle lighting fixture 10 is installed can include an instrumental panel including an HL indicator. At the same time as step S16, the HL indicator can be turned on to notify of the SC light source 12 being normal to output the SC light.

From the SC light containing light in the visible wavelength region output from the SC light source 12, the light other than the light in the predetermined visible wavelength region (for example, 450 nm to 700 nm) can be removed in advance by the removal member 14. Then, the SC light can be condensed by the condenser lens 20 and allowed to be incident on the incident end face 18*a* of the transmission optical fiber 18. The SC light then can be transmitted through the transmission optical fiber 18 to reach and exit through the emission end face 18*b*. At least part of the SC light can be made incoherent by the incoherent member and allowed to pass through the projector lens 22 to be projected forward, thereby forming the high-beam light distribution pattern $P_{Hi}$ illustrated in FIG. 3A. The incoherent process of the SC light may be performed before exiting through the emission end face 18*b*.

On the other hand, if it is determined that the SC light source 12 is in an abnormal state in step S14 (step S14: FAILURE), the arithmetic and control unit 30 controls the SC light source 12 not to output the SC light (step S20). At the same time as step S20, the abnormal state is recorded and a warning lamp or the like provided to the instrumental panel can be turned on to notify of the SC light source 12 being abnormal.

The processing from step S12 to step S16 is repeatedly performed until the headlamp switch 32 is turned off or it is determined that the SC light source 12 is failed in step S14.

According to the present exemplary embodiment, there can be provided the vehicle lighting fixture 10 that is capable of eliminating the use of a phosphor member that causes the reduced color rendering properties and the occurrence of color separation, specifically, and of enhancing the color rendering properties and suppressing the occurrence of color separation more than a conventional white light source that use a semiconductor light emitting element such as an LD and a phosphor member (wavelength conversion member).

The reason why the vehicle lighting fixture 10 can eliminate the use of a phosphor member is because the SC light output from the SC light source 12 is already white light.

The resulting vehicle lighting fixture 10 can provide the more enhanced color rendering properties than the conventional white light source that uses a semiconductor light emitting element such as an LD and a phosphor member (wavelength conversion member) because of the continuity of the spectrum of the SC light similar to that of natural sunlight.

Furthermore, the occurrence of color separation can be prevented due to the elimination of a phosphor member, resulting in less change (or no change) in color depending on the observing angle with respect to the SC light.

A modified example will now be described.

The previous exemplary embodiment has been described with reference to the example in which the presently disclosed subject matter is applied to a vehicle lighting fixture utilizing a direct projection type high-beam lighting unit.

Other examples of the lighting fixtures to which the presently disclosed subject matter can be applied may include, in addition to the vehicle lighting fixture utilizing a direct projection type high-beam lighting unit, a vehicle lighting fixture utilizing a direct projection type low-beam lighting unit, a vehicle lighting fixture utilizing a projection type high-beam lighting unit a vehicle lighting fixture utilizing a projection type low-beam lighting unit, a vehicle lighting fixture utilizing a reflector type high-beam lighting unit, a vehicle lighting fixture utilizing a reflector type low-beam lighting unit, and a vehicle lighting fixture having a lens member including a cut-offline formation reflector (for example, Japanese Patent Application Laid-Open No. 2003-317515). Furthermore, the exemplary kinds of the vehicle lighting fixture may include a headlamp, an exterior illumination device, interior illumination device such as a cabin lamp, and a signal indicator such as a clearance lamp.

In the vehicle lighting fixture 10, the transmission optical fiber 18 may be eliminated and at least part (e.g., emission end side part) of the conversion optical fiber 12*b* (nonlinear optical medium) may be used to serve as the transmission optical fiber 18.

A description will now be given of a vehicle lighting fixture according to a second exemplary embodiment.

Figure 23:
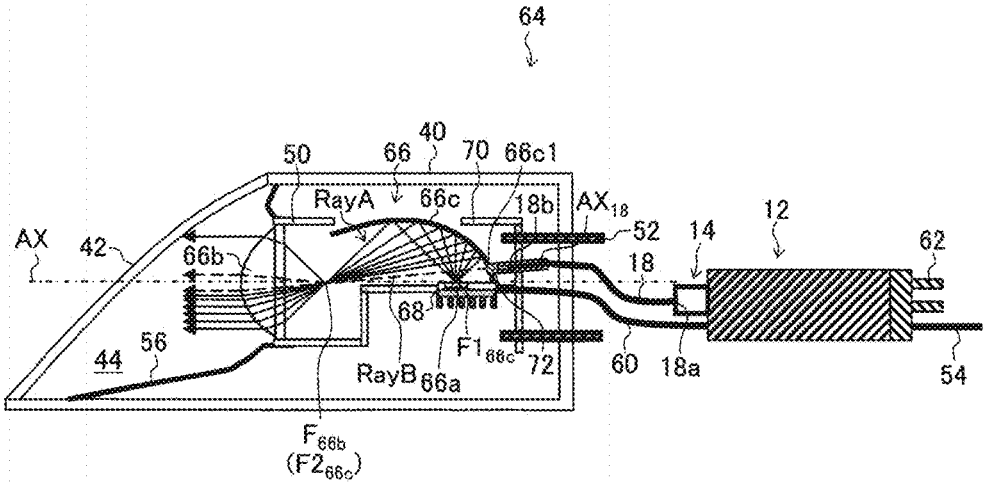
FIG. 23 is a vertical cross-sectional view illustrating a vehicle lighting fixture 64 according to a second exemplary embodiment of the presently disclosed subject matter.

FIG. 23 is a vertical cross-sectional view illustrating a vehicle lighting fixture 64 according to the second exemplary embodiment of the presently disclosed subject matter.

Hereinafter, points of the second exemplary embodiment different from those of the vehicle lighting fixture 10 of the first exemplary embodiment will be mainly described, and the same or similar components of the second exemplary embodiment as or to those of the vehicle lighting fixture 10 of the first exemplary embodiment will be denoted by the same reference numbers and descriptions therefor will be omitted as appropriate.

As illustrated in FIG. 23, the vehicle lighting fixture 64 can include a lighting unit 66, an SC light source 12 configured to output SC light containing light in a visible wavelength region, a removal member 14 configured to remove (cut) light other than the light in a predetermined visible wavelength region (for example, 450 nm to 700 nm) from the SC light output from the SC light source 12, a transmission optical fiber 18 configured to transmit the SC light output from the SC light source 12 to the lighting unit 66, etc.

Figure 24A:
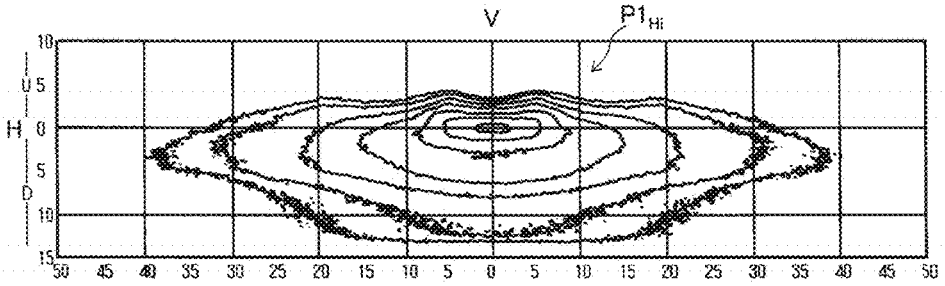
FIGS. 24A, 24B, and 24C are a diagram illustrating an example of a basic light distribution pattern $P1_{Hi}$ formed on a virtual vertical screen (assumed to be disposed about 25 m away from a front face of a vehicle body in front of the vehicle body) by the vehicle lighting fixture 64, a diagram illustrating an example of an additional light distribution pattern $P2_{Hi}$, and a diagram illustrating an example of a high-beam light distribution pattern $P_{Hi}$.
Figure 24B:
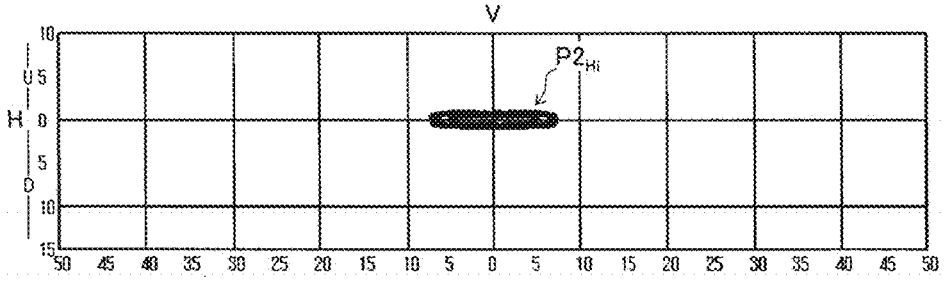
Figure 24C:
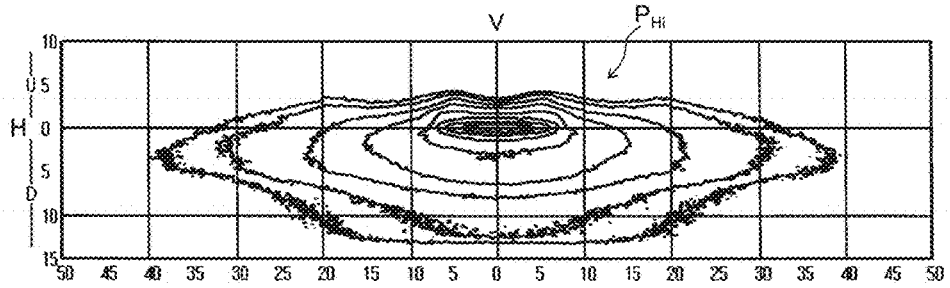

The lighting unit 66 can be configured to form a high-beam light distribution pattern $P_{Hi}$ (corresponding to the predetermined light distribution pattern of the presently disclosed subject matter) by overlaying a basic light distribution pattern $P1_{Hi}$ and an additional light distribution pattern $P2_{Hi}$ as illustrated in FIGS. 24A to 24C. The vehicle lighting fixture 64 can further include a housing 40 and an outer lens 42 together defining a lighting chamber 44. The high-beam lighting unit 66 can be disposed in the lighting chamber 44. The SC light source 12 may be disposed within the lighting chamber 44.

Specifically, the lighting unit 66 can be configured as a projector type lighting unit including a first light source 66*a*, a projector lens 66*b*, a reflector 66*c*, etc.

The first light source 66*a* can be a white LED light source configured to emit light mainly composed of incoherent light. The white LED light source can be configured to include a blue LED element (for example, an LED element having a light emission face of 1 mm square) and a yellow wavelength converting member (for example, a YAG phosphor) in combination. The white light emitted from the first light source 66*a* can be produced by mixing the light (blue light) emitted from the semiconductor light emitting element passing through the wavelength converting member and the light (yellow light) resulting from the excitation of the wavelength converting member by the light (excitation blue light) from the semiconductor light emitting element, and thus be pseud white light. The number of the semiconductor light emitting element may be 1 or more.

The vehicle lighting fixture 64 can have a reference axis AX (or referred to as an optical axis) extending in a front-rear direction of a vehicle body. The first light source 66*a* can be disposed to face upward (the light emission face faces upward) and be fixed to a holding member 68 such as a heat dissipation plate at or near the reference axis AX and at or near a first focal point $F1_{66c}$ of the reflector 66*c*.

The first light source 66*a* can be any light source as long as the first light source 66*a* can emit light mainly containing incoherent light. Furthermore the first light source 66*a* is not limited to the white LED light source using a semiconductor light emitting element and a wavelength converting member in combination, but may be a white LED light source using R, G, and B color LED elements in combination, a white LD light source using a blue LD element and a yellow wavelength converting member in combination, or the like. Furthermore, the first light source 66*a* may be a light source selected from an incandescent bulb, a halogen bulb, and an HID bulb.

The reflector 66*c* can be a spheroidal reflector having the first focal point F1 at or near the first light source 66*a* and a second focal point $F2_{66c}$ at or near a rear-side focal point F66*b* of the projector lens 66*b*, the spheroidal reflector having a spheroidal reflecting surface or a free curved surface equivalent to such a spheroidal reflecting surface.

The surface shape of the reflector 66*c* can be adjusted so that the light from the first light source 66*a* is reflected by the reflector 66*c* and projected through the projector lens 66*b* to form the basic light distribution pattern $P1_{Hi}$ on a virtual vertical screen.

The reflector 66*c* can be shaped as a dome shape to cover the first light source 66*a* from its side to its top so as to receive the light emitted upward (in the radial direction) from the first light source 66*a* except for the area where the reflected light from the reflector 66*c* passes. The reflector 66*c* can be fixed to the holding member 68 at its lower peripheral edge.

The projector lens 66*b* can be a convex lens having a convex front surface and a flat rear surface, and disposed on the reference axis AX while being held by a lens holder 50.

In this manner, the reflector 66*c* and the projector lens 66*b* can constitute the first optical system of the presently disclosed subject matter. Specifically, the light rays RayA emitted from the first light source 66*a* mainly containing incoherent light can be reflected by the reflector 66*c* to be converged at or near the rear-side focal point $F_{66b}$ of the projector lens 66*b* and then projected through the projector lens 66*b* forward to form the basic light distribution pattern $P1_{Hi}$ on the virtual vertical screen.

The reflector 66*c* can have a through hole 66*c*1 formed in an area near the reference axis AX. The transmission optical fiber 18 can be held by a holding member 70 such as a bracket while the emission end portion of the transmission optical fiber 18 faces to the through hole 66*c*1. The transmission optical fiber 18 can have an optical axis $AX_{18}$ tilted forward and obliquely downward with respect to the reference axis AX, for example, by an inclined angle of about 5 degrees.

Figure 25:
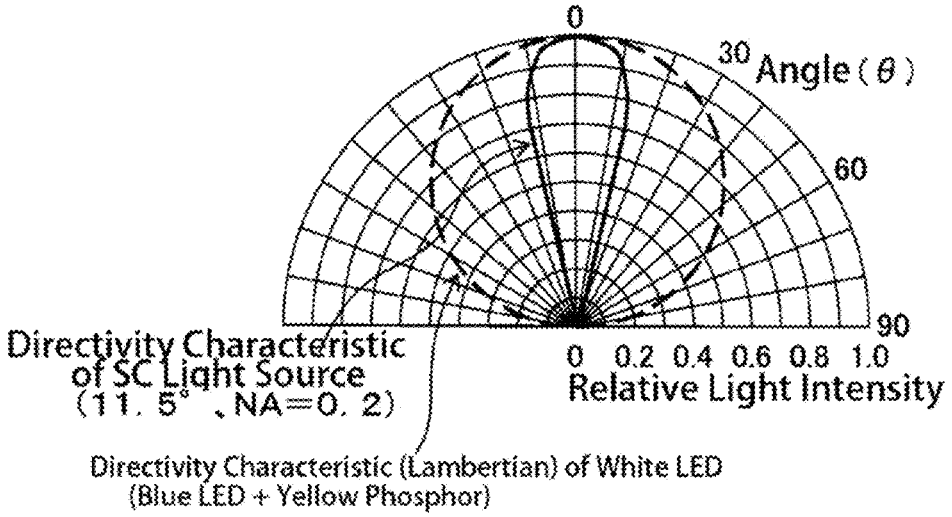
FIG. 25 is a diagram illustrating directivity characteristic of a white LED light source (first light source 66*a*) and an SC light source (second light source 18*b*)
Figure 26:
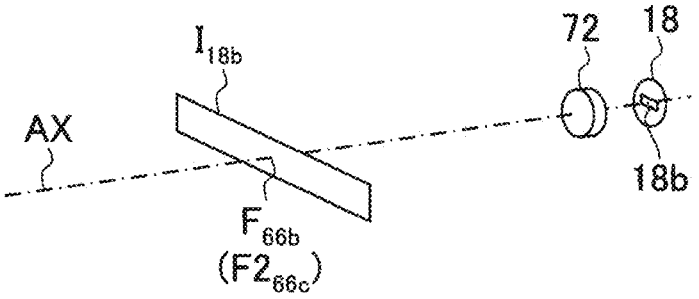
FIG. 26 is a perspective view illustrating a state in which an enlarged light source image $I_{18b}$ of the second light source 18*b* can be formed by the action of a condenser lens 72.

The transmission optical fiber 18 can be formed to have a rectangular cross section, for example, with an aspect ratio of 1:2. The emission end face 18*b* of the transmission optical fiber 18 can emit light mainly containing coherent light having a higher luminance than the first light source 66*a* and a narrower directivity angle than the first light source 66*a* (see FIG. 25). Hereinafter, the emission end face 18*b* of the transmission optical fiber 18 may be referred to as a second light source 18*b*.

A condenser lens 72 can be disposed between the second light source 18*b* and the through hole 66*c*1 (see FIG. 23).

The condenser lens 72 can be configured to form an enlarged light source image of the second light source 18*b* (for example, the core cross section with the aspect ratio of 1:2 magnified a 5 times in the vertical direction and a 15 times in the horizontal direction) at or near the rear-side focal point $F_{66b}$, of the projector lens 66*b*.

From the SC light containing light in the visible wavelength region output from the SC light source 12, the light other than the light in the predetermined visible wavelength region (for example, 450 nm to 700 nm) can be removed in advance by the removal member 14. Then, the SC light can be condensed by the condenser lens 20 (see FIG. 17) and allowed to be incident on the incident end face 18*a* of the transmission optical fiber 18. The SC light then can be transmitted through the transmission optical fiber 18 to reach and exit through the emission end face 18*b*. The trajectory of the exiting light is shown by a dotted line as RayB in FIG. 23. Then, an enlarged light source image $I_{18b}$ of the emission end face 18*b* of the transmission optical fiber 18 (for example, the core cross section with the aspect ratio of 1:2 magnified a 5 times in the vertical direction and a 15 times in the horizontal direction) can be formed by the action of the condenser lens 72 at or near the rear-side focal point $F_{66b}$ of the projector lens 66*b*. The enlarged light source image $I_{18b}$ can be projected through the projector lens 66*b* to form an additional light distribution pattern $P2_{Hi}$. The additional light distribution pattern $P2_{Hi}$ can be overlaid on the basic light distribution pattern $P1_{Hi}$ to form the high-beam light distribution pattern $P_{Hi}$ as a synthetic light distribution pattern. Here, the condenser lens 72 and the projector lens 66*b* can constitute the second optical system of the presently disclosed subject matter.

The resulting high-beam light distribution pattern $P_{Hi}$ can have a relatively high center light intensity (near the crossing point of H line and V line on the virtual vertical screen) and be formed with an excellent distant visibility.

In order to confirm the advantageous effects, the present inventors have conducted experiments using a predetermined simulation software program. Simulation results derived therefrom will next be described as Example 1 and Comparative Examples 1 to 3.

Figures 27A, 27B:
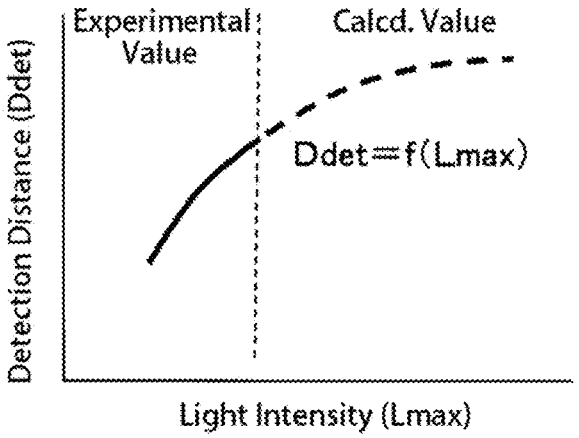
FIG. 27A is a table showing simulation results.
FIG. 27B is a graph showing the relationship between the light intensity and the detection distance.

FIG. 27A is a table showing the simulation results.

EXAMPLE

Figure 28:
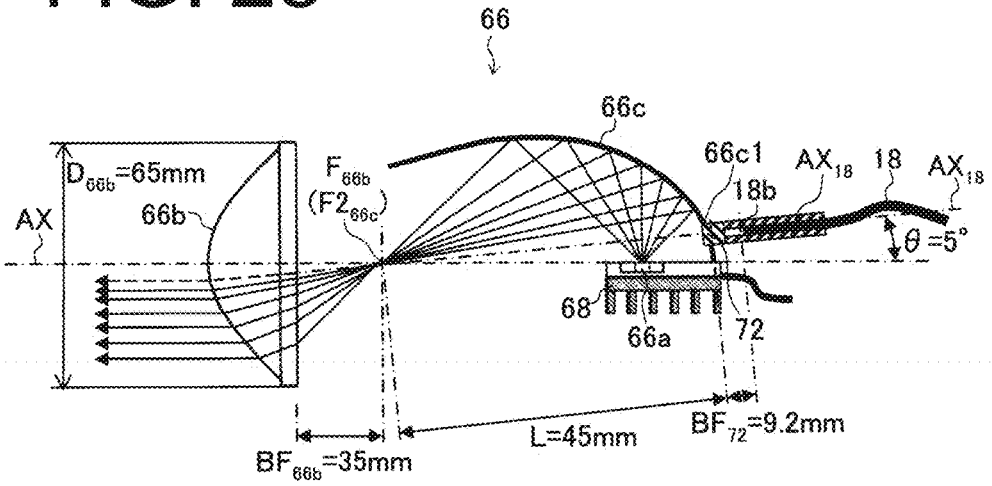
FIG. 28 is a vertical cross-sectional view illustrating a lighting unit 66 used for a simulation example.

Experiment simulation was conducted using a lighting unit 66 illustrated in FIG. 28. The set dimensions were as follows:

Diameter $D_{66b}$ of the projector lens 66*b*: 65 mm

Diameter of the condenser lens 72: 6 mm

Diameter of the through hole 66*c*1: 5 mm

Angle θ between the optical axis AX18 and the reference axis AX: 5 degrees

Back focus $BF_{86b}$ of the projector lens 66*b*: 35 mm

Back focus $BF_{72}$ of the condenser lens 72: 9.2 mm

Distance L between the lens end of the condenser lens 72 and the rear-side focus $F_{86b}$ of the projector lens 66*b*: 45 mm Emission face of the first light source 66*a*: 1.3 mm×7 mm (7 mm in a direction perpendicular to the paper surface of the drawing)

Luminous flux of the first light source 66*a*: 1700 lm

Emission face of the second light source 18*b* (core cross section): 0.2 mm×0.4 mm (0.4 mm in the direction perpendicular to the paper surface of the drawing)

NA of the transmission optical fiber 18: 0.2

The simulation results were evaluated in terms of the emission luminous flux, maximum light intensity, and average detection distance (Ddet).

The average detection distance (Ddet) can be a distance (average distance) measured in the following manner. Specifically, when an obstacle (dimension: 20 cm×20 cm, reflectance: 10%) in front of a headlamp is irradiated with headlamp light beam having a certain directivity and reflects the light, the average detection distance (Ddet) can be determined as a distance at which an observer (driver) can detect the reflected light (Lambertian distribution) from the obstacle to identify the obstacle in terms of a predefined size and a predefined reflectance. It has been known that the relationship between the average detection distance (Ddet) and the maximum light intensity can be represented by the following formula 1 (function) as a result of several experiments to a number of subjects as illustrated in FIG. 27B. The experiments were performed using respective light sources shown in FIG. 27A attached to a vehicle body at a height of 0.75 m and a width of 1.2 m and an obstacle (dimension: 20 cm×20 cm, reflectance: 10%) disposed on a road surface in front of the vehicle body without surrounding objects.

$$Ddet=f(Lmax) \quad \text{(Formula 1)}$$

where Ddet is an average detection distance and Lmax is a maximum light intensity (in a direction to the obstacle.

As a result of the simulation, it was revealed that the light emitted from the second light source 18*b*, or the light emitted from the emission end face 18*b* of the transmission optical fiber 18 mainly containing coherent light (luminance: 8000 Mnit), had luminance flux of 400 lm and the maximum light intensity of 155,000 cd.

Figure 29:
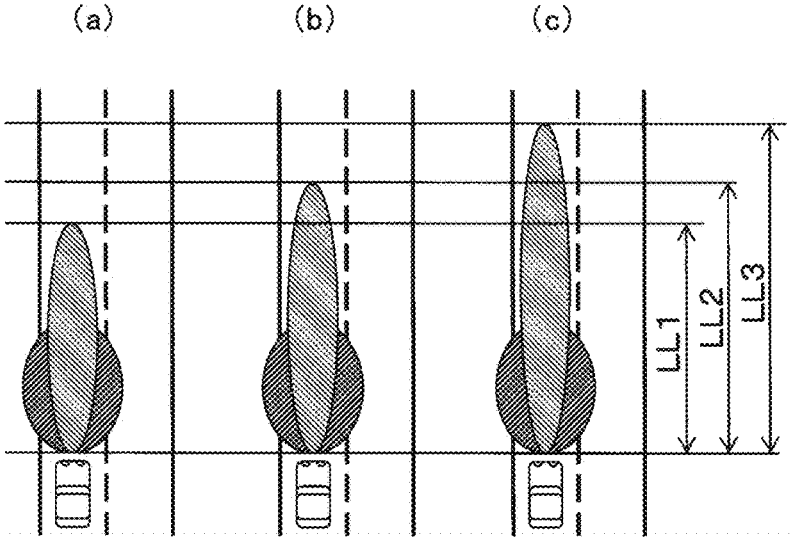
FIG. 29 is a diagram illustrating light distribution images on a road surface, (a) showing a basic light distribution formed by light mainly containing incoherent light, (b) showing a case where an additional light distribution pattern formed by light mainly containing incoherent light is overlaid on the basic light distribution pattern formed by the light mainly containing incoherent light, and (c) showing a case where an additional light distribution pattern formed by light mainly containing coherent light is overlaid on the basic light distribution pattern formed by the light mainly containing incoherent light.

When the obstacle (dimension: 20 cm×20 cm, reflectance: 10%) disposed in front of the lighting unit 66 was irradiated with the light that was emitted from the second light source 18*a* mainly containing coherent light and projected through the projector lens 66*b*, the average detection distance (Ddet) between the obstacle and the lighting unit 66 was calculated where an observer (driver) could determine the obstacle (i.e., when the distance exceeds the average detection distance, the obstacle cannot be detected). In this case, the average detection distance was calculated on the basis of the formula (1) to be 177 meters (for example, see Table of FIG. 27A and the distance LL3 in (c) of FIG. 29). Specifically, the (c) of FIG. 29 shows a light distribution image on a road surface where an additional light distribution pattern formed by light mainly containing coherent light (for example, SC light) is overlaid on the basic light distribution pattern formed by the light mainly containing incoherent light.

Comparative Example 1

In Comparative Example 1, a simulation was performed using the lighting unit 66 illustrated in FIG. 28 as in Example.

The simulation results revealed that the light from the first light source 66*a*, i.e., a white LED light source having a structure including an LED element and a wavelength converting member used in combination mainly containing incoherent light had a maximum light intensity of 62,000 cd.

Furthermore, when the obstacle disposed in front of the lighting unit 66 was irradiated with the light that was emitted from the first light source 66*a* mainly containing incoherent light and projected through the projector lens 66*b*, the average detection distance (Ddet) between the obstacle and the lighting unit 66 was calculated on the basis of the formula (1) to be 132 meters (for example, see Table of FIG. 27A and the distance LL1 in (a) of FIG. 29). Specifically, the (a) of FIG. 29 shows a light distribution image which is formed by projecting a basic light distribution pattern formed by light mainly containing incoherent light (for example, SC light) on a road surface.

Comparative Example 2

In Comparative Example 2, a simulation was performed using the lighting unit 66 illustrated in FIG. 28 as in Example, except that a white LED light source having a structure including a blue LED element and a yellow wavelength converting member used in combination (luminance: 100 Mnit) was used in place of the SC light source 12.

The simulation results revealed that the light from the white LED light source, i.e., the light emitted from the emission end face 18*b* of the transmission optical fiber 18 mainly containing incoherent light had luminance flux of 5 lm and the maximum light intensity of 63,000 cd.

Furthermore, when the obstacle disposed in front of the lighting unit 66 was irradiated with the light that was emitted from the white LED light source mainly containing incoherent light and projected through the projector lens 66*b*, the average detection distance (Ddet) between the obstacle and the lighting unit 66 was calculated on the basis of the formula (1) to be 132 meters (for example, see Table of FIG. 27A and the distance LL1 in (a) of FIG. 29).

Comparative Example 3

In Comparative Example 3, a simulation was performed using the lighting unit 66 illustrated in FIG. 28 as in Example, except that a white LD light source having a structure including a blue LD element and a yellow wavelength converting member used in combination (luminance: 400 Mnit) was used in place of the SC light source 12.

The simulation results revealed that the light from the white LED light source, i.e., the light emitted from the emission end face 18*b* of the transmission optical fiber 18 mainly containing incoherent light had luminance flux of 20 lm and the maximum light intensity of 66,000 cd.

Furthermore, when the obstacle disposed in front of the lighting unit 66 was irradiated with the light that was emitted from the white LD light source mainly containing incoherent light and projected through the projector lens 66*b*, the average detection distance (Ddet) between the obstacle and the lighting unit 66 was calculated on the basis of the formula (1) to be 134 meters (for example, see Table of FIG. 27A and the distance LL2 in (b) of FIG. 29).

According to the results obtained in Example and Comparative Examples 1 to 3, the average detection distance to an obstacle, i.e., the maximum distance to detect the obstacle was 177 meters by Example using light mainly containing coherent light as compared with the distances by Comparative Examples 1 to 3 using light mainly containing incoherent light. Thus, the additional light distribution pattern $P2_{Hi}$ formed by the light mainly containing coherent light is overlaid on the basic light distribution pattern $P1_{Hi}$ formed by the light mainly containing incoherent light to form the high-beam light distribution pattern $P_{Hi}$ with the excellent distant visibility.

The excellent distant visibility of the high-beam light distribution pattern $P_{Hi}$ can be achieved due to the additional light distribution pattern $P2_{Hi}$ formed by the light from the second light source 12*b* having a higher luminance and a narrower directivity angle than those of the light from the first light source 66*a*, so that the light intensity of the additional light distribution pattern $P2_{Hi}$ relatively become high. In addition to this, this is due to the additional light distribution pattern $P2_{Hi}$ formed by the light mainly containing coherent light. Specifically, the light mainly containing coherent light can be light rays with a uniform phase when compared with the light mainly containing incoherent light and thus can be diverged less and can have a high straightness. Therefore, the additional light distribution pattern $P2_{Hi}$ formed by the light mainly containing coherent light can irradiate a farther place, as illustrated in (c) of FIG. 29.

With this configuration of the present exemplary embodiment, the vehicle lighting fixture can eliminate the use of a phosphor member that causes the reduced color rendering properties and the occurrence of color separation, specifically, can enhance the color rendering properties and suppress the occurrence of color separation more than a conventional white light source that uses a semiconductor light emitting element such as an LD and a phosphor member (wavelength conversion member).

The reason why the vehicle lighting fixture 64 can eliminate the use of a phosphor member is because the SC light output from the SC light source 12 is already white light.

The resulting vehicle lighting fixture 10 can provide the more enhanced color rendering properties than the conventional white light source that uses a semiconductor light emitting element such as an LD and a phosphor member (wavelength conversion member) because of the continuity of the spectrum of the SC light similar to that of natural sunlight.

Furthermore, the occurrence of color separation can be prevented due to the elimination of a phosphor member, resulting in less change (or no change) in color depending on the observing angle with respect to the SC light.

The vehicle lighting fixture according to the present exemplary embodiment can form the basic light distribution pattern $P1_{Hi}$ with the light mainly containing incoherent light and the additional light distribution pattern $P2_{Hi}$ with the light mainly containing coherent light overlaid with each other. The resulting predetermined light distribution can be formed with an excellent distant visibility as a high-beam light distribution pattern $P_{Hi}$.

Figure 30:
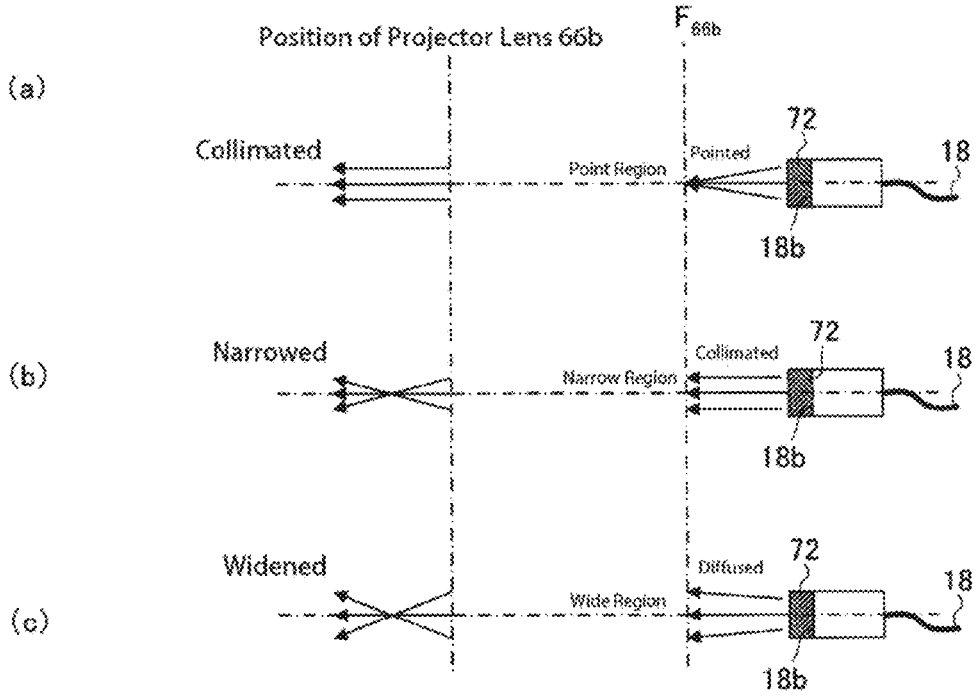
FIG. 30 is a schematic top plan view illustrating how the light from the second light source 18*b* is controlled, (a) showing a state in which the light from the second light source 18*b* is condensed by the action of the condenser lens 72, (b) showing a state in which the light from the second light source 18*b* is collimated by the action of the condenser lens 72, and (c) showing a state in which the light from the second light source 18*b* is diffused by the action of the condenser lens 72.

When a lens that can converges the light from the second light source 18*b* to the rear-side focal point $F_{66b}$ of the projector lens 66*b* (see (a) of FIG. 30) is used as the condenser lens 72, the light intensity of the additional light distribution pattern $P2_{Hi}$ can be increased more and the distant visibility can further be improved.

When a lens that can collimate the light from the second light source 18*b* (see (b) of FIG. 30) is used as the condenser lens 72, the vertical and/or horizontal width of the additional light distribution pattern $P2_{Hi}$ can be increased more and the wider area can be illuminated with light.

When a lens that can diffuse the light from the second light source 18*b* (see (c) of FIG. 30) is used as the condenser lens 72, the vertical and/or horizontal width of the additional light distribution pattern $P2_{Hi}$ can be increased more than the case of (b) of FIG. 30 and the much wider area can be illuminated with light.

In the present exemplary embodiment, the single lighting unit 66 can achieve the basic light distribution pattern $P1_{Hi}$ and the additional light distribution pattern $P2_{Hi}$. However, this is not restrictive. For example, the basic light distribution pattern $P1_{Hi}$ may be formed by one lighting unit, such as a projector-type lighting unit, reflector-type lighting unit, direct projection-type lighting unit, or light-guiding lens-type lighting unit, and the additional light distribution pattern $P2_{Hi}$ may be formed by another lighting unit, such as a projector-type lighting unit, reflector-type lighting unit, direct projection-type lighting unit, or light-guiding lens-type lighting unit.

Next, a vehicle lighting fixture 64A (or lighting unit 66A) as a modified example will be described with reference to the drawings.

Figure 31:
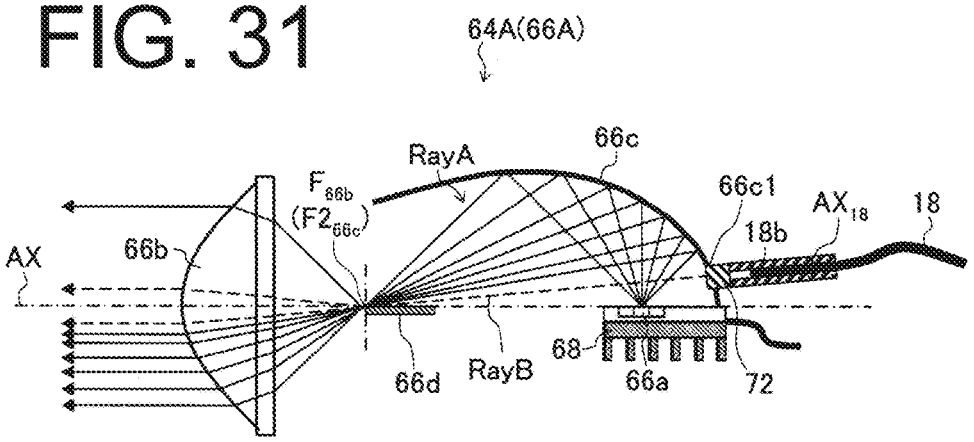
FIG. 31 is a vertical cross-sectional view illustrating a vehicle lighting fixture 64A (lighting unit 66A) as a modified example.

FIG. 31 is a vertical cross-sectional view illustrating the vehicle lighting fixture 64A (lighting unit 66A) as the modified example.

Figure 32:
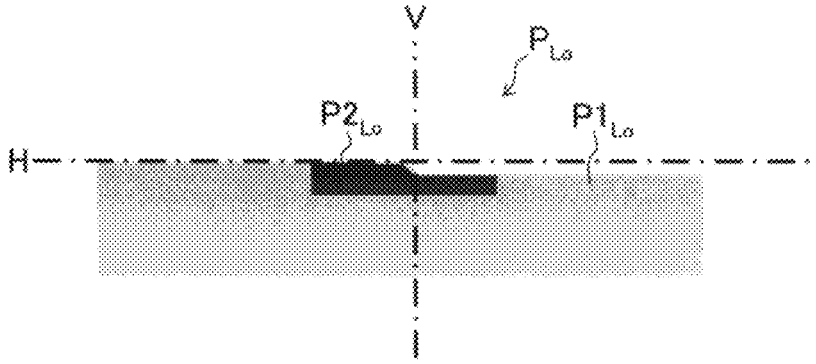
FIG. 32 is a diagram showing a low-beam light distribution pattern $P_{Lo}$ formed on a virtual vertical screen by the vehicle lighting fixture 64A (lighting unit 66A)

The lighting unit 66A can be configured to form a low-beam light distribution pattern $P_{Lo}$ (corresponding to the predetermined light distribution pattern of the presently disclosed subject matter) by overlaying a basic light distribution pattern $P1_{Lo}$ and an additional light distribution pattern $P2_{Lo}$ as illustrated in FIG. 32. The vehicle lighting fixture 64A can further include a light-shielding member 66*d* in addition to the components of the vehicle lighting fixture 64 of the second exemplary embodiment.

Hereinafter, points of the modified example different from those of the vehicle lighting fixture 64 of the second exemplary embodiment will be mainly described, and the same or similar components of the modified example as or to those of the vehicle lighting fixture 64 of the second exemplary embodiment will be denoted by the same reference numbers and descriptions therefor will be omitted as appropriate.

The light-shielding member 66*d* can be configured as a reflecting surface extending substantially horizontally from the position at or near the rear-side focal point $F_{66b}$ of the projector lens 66*b* rearward.

The light rays RayA that are emitted from the first light source 66*a* mainly containing incoherent light and reflected by the reflector 66*c* can be shielded by the light-shielding member 66*d* in part and reflected by the same in part, and then projected through the projector lens 66*b* forward to form a basic light distribution pattern $P1_{Lo}$ that includes a cut-off line at its upper edge defined by the front edge of the light-shielding member 66*d*.

The light rays RayB that are emitted from the second light source 18*b* mainly containing coherent light can be shielded by the light-shielding member 66*d* in part and reflected by the same in part, and then projected through the projector lens 66*b* forward to form an additional light distribution pattern $P2_{Lo}$ that includes a cut-off line at its upper edge defined by the front edge of the light-shielding member 66*d*. The additional light distribution pattern $P2_{Lo}$ can be overlaid on the basic light distribution pattern $P1_{Lo}$ to form the low-beam light distribution pattern $P_{Lo}$ as a synthetic light distribution pattern.

The resulting low-beam light distribution pattern $P_{Lo}$ can have a relatively high center light intensity (near the crossing point of H line and V line on the virtual vertical screen) and be formed with an excellent distant visibility because of the same reason as that in the second exemplary embodiment.

In the present modified example, the single lighting unit 66A can achieve the basic light distribution pattern $P1_{Lo}$ and the additional light distribution pattern $P2_{Lo}$. However, this is not restrictive. For example, the basic light distribution pattern $P1_{Lo}$ may be formed by one lighting unit, such as a projector-type lighting unit, reflector-type lighting unit, direct projection-type lighting unit, or light-guiding lens-type lighting unit, and the additional light distribution pattern $P2_{Lo}$ may be formed by another lighting unit, such as a projector-type lighting unit, reflector-type lighting unit, direct projection-type lighting unit, or light-guiding lens-type lighting unit.

A description will now be given of another modified example of the vehicle lighting fixture with reference to the drawings.

Figure 33:
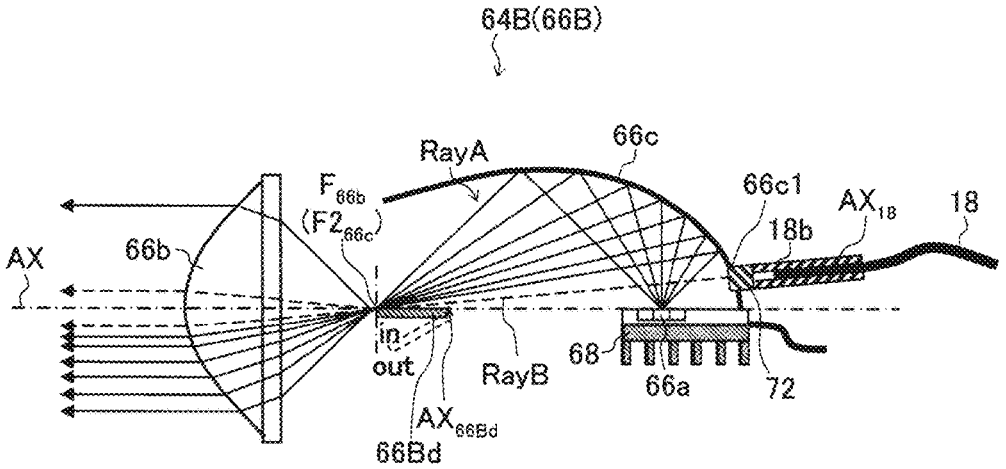
FIG. 33 is a vertical cross-sectional view illustrating a vehicle lighting fixture 64B (lighting unit 66B) as another modified example.

FIG. 33 is a vertical cross-sectional view illustrating a vehicle lighting fixture 64B (lighting unit 66B) as another modified example.

As illustrated, the lighting unit 66B can be configured to selectively project high-beam light rays and low-beam light rays, and include a movable light-shielding member 66Bd in addition to the components of the vehicle lighting fixture 64 (lighting unit 66) of the second exemplary embodiment.

Hereinafter, points of the modified example different from those of the vehicle lighting fixture 64 of the second exemplary embodiment will be mainly described, and the same or similar components of the modified example as or to those of the vehicle lighting fixture 64 of the second exemplary embodiment will be denoted by the same reference numbers and descriptions therefor will be omitted as appropriate.

The light-shielding member 66*d* can be configured as a reflecting surface rotatably supporting around a rotational axis $AX_{66Bd}$ extending in a direction perpendicular to the paper surface of the drawing of FIG. 33.

Rotation of the light-shielding member 66Bd can be controlled by an actuator such as a stepping motor so that the light-shielding member 66Bd can be rotated and stopped at a high-beam position "out" in FIG. 33 when the lighting unit 66B projects high-beam light rays while the light-shielding member 66Bd can be rotated and stopped at a low-beam position "in" in FIG. 33 when the lighting unit 66B projects low-beam light rays.

The high-beam position can be set such that the light-shielding member 66Bd does not shield the light that is emitted from the first light source 66*a* and reflected by the reflector 66*c* and the light that is emitted from the second light source 18*b*. The low-beam position can be set such that the light-shielding member 66Bd does shield the light that is emitted from the first light source 66*a* and the light that is emitted from the second light source 18*b*, specifically, the light-shielding member 66Bd extends substantially horizontally from the position at or near the rear-side focal point $F_{66b}$ of the projector lens 66*b* rearward.

When the light-shielding member 66Bd is rotated and stopped at the high-beam position, the light rays RayA that are emitted from the first light source 66*a* mainly containing incoherent light and reflected by the reflector 66*c* can be projected through the projector lens 66*b* forward to form a basic light distribution pattern $P1_{Hi}$ on a virtual vertical screen.

The light rays RayB that are emitted from the second light source 18*b* mainly containing coherent light can be projected through the projector lens 66*b* forward to form an additional light distribution pattern $P2_{Hi}$ on the virtual vertical screen. The additional light distribution pattern $P2_{Hi}$ can be overlaid on the basic light distribution pattern $P1_{Hi}$ to form the high-beam light distribution pattern $P_{Hi}$ as a synthetic light distribution pattern.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

On the other hand, when the light-shielding member 66Bd is rotated and stopped at the low-beam position, the light rays RayA that are emitted from the first light source 66*a* mainly containing incoherent light and reflected by the reflector 66*c* can be shielded by the light-shielding member 66Bd in part and reflected by the same in part, and then projected through the projector lens 66*b* forward to form a basic light distribution pattern $P1_{Lo}$ that includes a cut-off line at its upper edge defined by the front edge of the light-shielding member 66Bd.

The light rays RayB that are emitted from the second light source 18*b* mainly containing coherent light can be shielded by the light-shielding member 66Bd in part and reflected by the same in part, and then projected through the projector lens 66*b* forward to form an additional light distribution pattern $P2_{Lo}$ that includes a cut-off line at its upper edge defined by the front edge of the light-shielding member 66Bd. The additional light distribution pattern $P2_{Lo}$ can be overlaid on the basic light distribution pattern $P1_{Lo}$ to form the low-beam light distribution pattern $P_{Lo}$ as a synthetic light distribution pattern.

The resulting low-beam light distribution pattern $P_{Lo}$ can have a relatively high center light intensity (near the crossing point of H line and V line on the virtual vertical screen) and be formed with an excellent distant visibility because of the same reason as that in the second exemplary embodiment.

A description will now be given of a vehicle lighting fixture according to a third exemplary embodiment with reference to the drawings.

Figure 34:
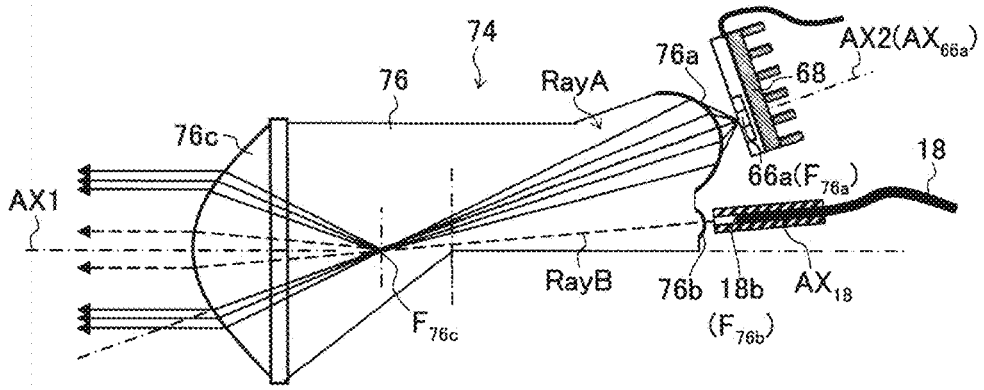
FIG. 34 is a vertical cross-sectional view illustrating a vehicle lighting fixture 74 according to a third exemplary embodiment of the presently disclosed subject matter.

FIG. 34 is a vertical cross-sectional view illustrating a vehicle lighting fixture 74 according to the third exemplary embodiment of the presently disclosed subject matter.

Hereinafter, points of the third exemplary embodiment different from those of the vehicle lighting fixture 10 of the first exemplary embodiment will be mainly described, and the same or similar components of the third exemplary embodiment as or to those of the vehicle lighting fixture 10 of the first exemplary embodiment will be denoted by the same reference numbers and descriptions therefor will be omitted as appropriate.

The vehicle lighting fixture 74 can be configured to form a high-beam light distribution pattern $P_{Hi}$ (corresponding to the predetermined light distribution pattern of the presently disclosed subject matter) by overlaying the basic light distribution pattern $P1_{Hi}$ and the additional light distribution pattern $P2_{Hi}$ as illustrated in FIGS. 24A to 24C. As illustrated in FIG. 34, the vehicle lighting fixture 74 can include a first light source 66*a*, a lens member 76, an SC light source 12 (not illustrated in FIG. 34) configured to output SC light containing light in a visible wavelength region, a removal member 14 configured to remove (cut) light other than the light in a predetermined visible wavelength region (for example, 450 nm to 700 nm) from the SC light output from the SC light source 12, a transmission optical fiber 18 configured to transmit the SC light output from the SC light source 12 to the lens member 76, etc.

The lens member 76 can have a shape extending along a first reference axis AX1 extending in a front-rear direction of a vehicle body. The lens member 76 can be formed from a transparent resin such as a polycarbonate resin or an acrylic resin, or glass.

The lens member 76 can include a first incident face 76*a* and a second incident face 76*b* at its rear end portion, and an emission face 76*c* at its front end portion with a rear-side focal point $F_{76c}$.

The first incident face 76*a* can be configured to allow light rays RayA emitted from the first light source 66*a* disposed near the first incident face 76*a* to enter the lens member 76 and have a free curved surface projected toward the first light source 66*a*. The surface shape of the first incident face 76*a* can be designed such that the light rays RayA emitted from the first light source 66*a* and entering the lens member 76 can be converged at or near the rear-side focal point $F_7$ of the emission face 76*c* and closer to a second reference axis AX2 at least in the vertical direction. Herein, the second reference axis AX2 can be set so as to pass the center of the first light source 66*a* (specifically, a reference point $F_{66a}$ of the first light source 66*a*) and a point near the rear-side focal point $F_{76c}$ of the emission face 76*c* and be inclined forward and obliquely downward with respect to the first reference axis AX1. The first incident face 76*a* can be disposed at a position of the rear end portion of the lens member 76 above and apart from the first reference axis AX1.

The second incident face 76*b* can be configured to allow light rays RayB emitted from the second light source 18*b* disposed near the second incident face 76*b* to enter the lens member 76 and have a free curved surface projected toward the second light source 18*b*. The surface shape of the second incident face 76*b* can be designed such that the light rays RayB emitted from the second light source 18*b* and entering the lens member 76 can be converged at or near the rear-side focal point $F_{76c}$ of the emission face 76*c*. The second incident face 76*b* can be disposed at a position of the rear end portion of the lens member 76 between the first incident face 76*a* and the first reference axis AX1.

Corresponding to the light rays emitted from the second light source 18*b* having a narrower directivity angle than the first light source 66*a*, the second incident face 76*b* can be made smaller in size than the first incident face 76*a*.

The first light source 66*a* can have an emission face facing to the first incident face 76*a* and be fixed to a holding member 68 such as a heat dissipation plate to be disposed at or near the first incident face 76*a* (or the reference point $F_{66a}$ of the first light source 66*a* being disposed at or near the first incident face 76*a*). Furthermore, the first light source 66*a* can have an optical axis $AX_{66a}$ that is substantially coincident with the second reference axis AX2.

In this manner, the first incident face 76*a* and the emission face 76*c* can constitute the first optical system of the presently disclosed subject matter. Specifically, the light rays RayA emitted from the first light source 66*a* mainly containing incoherent light can enter the lens member 76 through the first incident face 76*a* and be converged at or near the rear-side focal point $F_{76c}$ of the emission face 76*c* and closer to the second reference axis AX2 and then projected through the emission face 76*c* forward to form the basic light distribution pattern $P1_{Hi}$ on the virtual vertical screen.

The transmission optical fiber 18 can be held by a holding member such as a sleeve while an emission end face 18*b* (serving as the second light source 18*b*) of the transmission optical fiber 18 faces to the second incident face 76*b* to be disposed at or near the second incident face 76*b* (or a reference point $F_{76b}$ thereof). The transmission optical fiber 18 can have an optical axis $AX_{18}$ tilted forward and obliquely downward with respect to the first reference axis AX1, for example, by an inclined angle of about 5 degrees.

The emission face 76*c* can be configured to be a convex lens face projected forward and can invert and project a light intensity distribution formed at or near the rear-side focal point $F_{76c}$ of the emission face 76*c* to form an additional light distribution pattern $P2_{Hi}$.

From the SC light containing light in the visible wavelength region output from the SC light source 12 (specifically, mainly containing coherent light), the light other than the light in the predetermined visible wavelength region (for example, 450 nm to 700 nm) can be removed in advance by the removal member 14. Then, the SC light can be condensed by the condenser lens 20 and allowed to be incident on the incident end face 18*a* of the transmission optical fiber 18. The SC light then can be transmitted through the transmission optical fiber 18 to reach and exit through the emission end face 18*b* (see a dotted line showing the light rays RayB in FIG. 34). Then the SC light can enter the lens member 76 through the second incident face 76*b* and be converged at or near the rear-side focal point $F_{76c}$ of the emission face 76*c* and projected through the emission face 76*c* forward, thereby forming the additional light distribution pattern $P2_{Hi}$ on the virtual vertical screen. The additional light distribution pattern $P2_{Hi}$ can be overlaid on the basic light distribution pattern $P1_{Hi}$ to form the high-beam light distribution pattern $P_{Hi}$ as a synthetic light distribution pattern. Here, the second incident face 76*b* and the emission face 76*c* can constitute the second optical system of the presently disclosed subject matter.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

The vehicle lighting fixture according to the present exemplary embodiment can form the basic light distribution pattern $P1_{Hi}$ with the light mainly containing incoherent light and the additional light distribution pattern $P2_{Hi}$ with the light mainly containing coherent light overlaid with each other. The resulting predetermined light distribution can be formed with an excellent distant visibility as a high-beam light distribution pattern $P_{Hi}$.

A description will now be given of a modified example of the vehicle lighting fixture with reference to the drawing.

Figure 35:
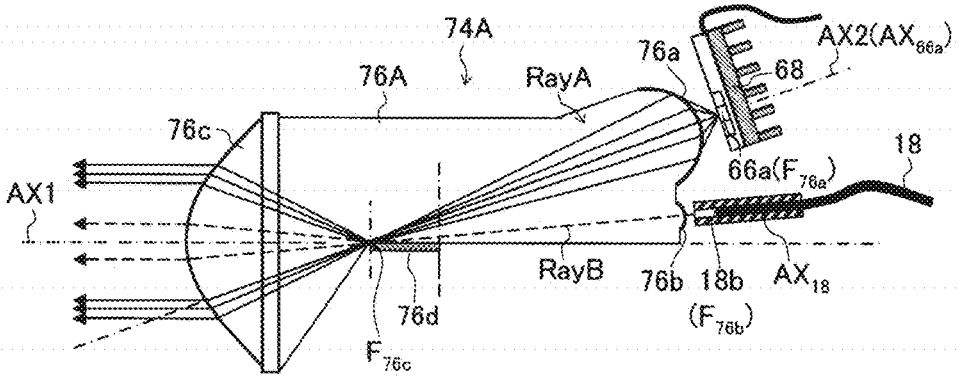
FIG. 35 is a vertical cross-sectional view illustrating a vehicle lighting fixture 74A as a modified example.

FIG. 35 is a vertical cross-sectional view illustrating a vehicle lighting fixture 74A as a modified example.

The vehicle lighting fixture 74A can be configured to form a low-beam light distribution pattern $P_{Lo}$ (corresponding to the predetermined light distribution pattern of the presently disclosed subject matter) by overlaying a basic light distribution pattern $P1_{Lo}$ and an additional light distribution pattern $P2_{Lo}$ as illustrated in FIG. 32. The vehicle lighting fixture 74A can further include a reflecting face 76*d* in addition to the components of the vehicle lighting fixture 74 of the third exemplary embodiment.

Hereinafter, points of the modified example different from those of the vehicle lighting fixture 74 of the third exemplary embodiment will be mainly described, and the same or similar components of the modified example as or to those of the vehicle lighting fixture 74 of the third exemplary embodiment will be denoted by the same reference numbers and descriptions therefor will be omitted as appropriate.

The lens member 76A can be configured to include the reflecting face 76*d* disposed between the front and rear end portions of the lens member 76A.

The reflecting face 76*d* can be configured as a planar reflecting surface extending substantially horizontally from the position at or near the rear-side focal point $F_{76c}$ of the emission face 76*c* rearward.

The light rays RayA that are emitted from the first light source 66*a* mainly containing incoherent light and enter the lens member 76A through the first incident face 76*a* can be shielded by the reflecting face 76*d* in part and reflected by the same in part, and then projected through the emission face 76*c* forward to form a basic light distribution pattern $P1_{Lo}$, which includes a cut-off line at its upper edge defined by the front edge of the reflecting face 76*d*, on a virtual vertical screen.

The light rays RayB that are emitted from the second light source 18*b* mainly containing coherent light and enter the lens member 76A through the second incident face 76*b* can be shielded by the reflecting face 76*d* in part and reflected by the same in part, and then projected through the emission face 76*c* forward to form an additional light distribution pattern $P2_{Lo}$ that includes a cut-off line at its upper edge defined by the front edge of the reflecting face 76*d*. The additional light distribution pattern $P2_{Lo}$ can be overlaid on the basic light distribution pattern $P1_{Lo}$ to form the low-beam light distribution pattern $P_{Lo}$ as a synthetic light distribution pattern.

The resulting low-beam light distribution pattern $P_{Lo}$ can have a relatively high center light intensity (near the crossing point of H line and V line on the virtual vertical screen) and be formed with an excellent distant visibility because of the same reason as that in the second exemplary embodiment.

A description will now be given of another modified example of the vehicle lighting fixture with reference to the drawings.

Figure 36:
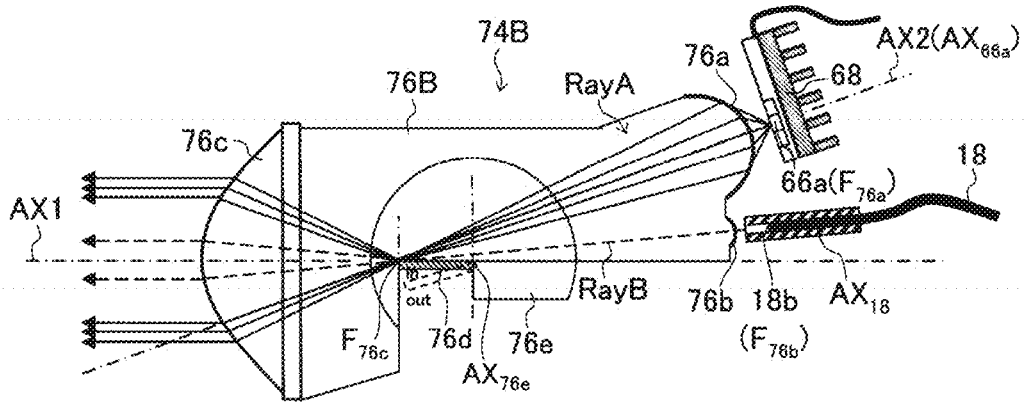
FIG. 36 is a vertical cross-sectional view illustrating a vehicle lighting fixture 74B as another modified example.

FIG. 36 is a vertical cross-sectional view illustrating a vehicle lighting fixture 74B as another modified example.

As illustrated, the vehicle lighting fixture 74B can be configured to selectively project high-beam light rays and low-beam light rays, and include a rotatable lens part 76*e* in addition to the components of the vehicle lighting fixture 74 of the third exemplary embodiment.

Hereinafter, points of the modified example different from those of the vehicle lighting fixture 74 of the third exemplary embodiment will be mainly described, and the same or similar components of the modified example as or to those of the vehicle lighting fixture 74 of the third exemplary embodiment will be denoted by the same reference numbers and descriptions therefor will be omitted as appropriate.

The vehicle lighting fixture 74B can include a lens member 76B having a rotatable lens part 76*e* disposed between its front and rear end portions.

The rotatable lens part 76*e* can be configured to include a reflecting face 76*e* and be rotatably supported by the lens member 76B around a rotational axis $AX_{76e}$ extending in a direction perpendicular to the paper surface of the drawing of FIG. 36.

Rotation of the rotatable lens part 76*e* can be controlled by an actuator such as a stepping motor so that the rotatable lens part 76*e* can be rotated and stopped at a high-beam position "out" in FIG. 36 when the vehicle lighting fixture 74B projects high-beam light rays while the rotatable lens part 76*e* can be rotated and stopped at a low-beam position "in" in FIG. 36 when the vehicle lighting fixture 74B projects low-beam light rays.

The high-beam position can be set such that the reflecting face 76*d* of the rotatable lens part 76*e* does not shield the light that is emitted from the first light source 66*a* and enters the lens member 76B and the light that is emitted from the second light source 18*b*. The low-beam position can be set such that the reflecting face 76*d* of the rotatable lens part 76*e* does shield the light that is emitted from the first light source 66*a* and enters the lens member 76B and the light that is emitted from the second light source 18*b*, specifically, the reflecting face 76*d* of the rotatable lens part 76*e* extends substantially horizontally from the position at or near the rear-side focal point $F_{76c}$ of the emission face 76*c* rearward.

When the rotatable lens part 76*e* is rotated and stopped at the high-beam position, the light rays RayA that are emitted from the first light source 66*a* mainly containing incoherent light and enter the lens member 76B through the first incident face 76*a* can be projected through the emission face 76*c* forward to form a basic light distribution pattern $P1_{Hi}$ on a virtual vertical screen.

The light rays RayB that are emitted from the second light source 18*b* mainly containing coherent light and enter the lens member 76B through the second incident face 76*b* can be projected through the emission face 76*c* forward to form an additional light distribution pattern $P2_{Hi}$ on the virtual vertical screen. The additional light distribution pattern P2 can be overlaid on the basic light distribution pattern $P1_{Hi}$ to form the high-beam light distribution pattern $P_{Hi}$ as a synthetic light distribution pattern.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

On the other hand, when the rotatable lens part 76*e* is rotated and stopped at the low-beam position, the light rays RayA that are emitted from the first light source 66*a* mainly containing incoherent light and enter the lens member 76B through the first incident face 76*a* can be shielded by the reflecting face 76*d* of the rotatable lens part 76*e* in part and internally (totally) reflected by the same in part, and then projected through the emission face 76*c* forward to form a basic light distribution pattern $P1_{Lo}$ that includes a cut-off line at its upper edge defined by the front edge of the reflecting face 76*d*.

The light rays RayB that are emitted from the second light source 18*b* mainly containing coherent light and enter the lens member 76B through the second incident face 76*b* can be shielded by the reflecting face 76*d* of the rotatable lens part 76*e* in part and internally (totally) reflected by the same in part, and then projected through the emission face 76*c* forward to form an additional light distribution pattern $P2_{Lo}$ that includes a cut-off line at its upper edge defined by the front edge of the reflecting face 76*d* of the rotatable lens part 76*e*. The additional light distribution pattern $P2_{Lo}$ can be overlaid on the basic light distribution pattern $P1_{Lo}$ to form the low-beam light distribution pattern $P_{Lo}$ as a synthetic light distribution pattern.

The resulting low-beam light distribution pattern $P_{Lo}$ can have a relatively high center light intensity (near the crossing point of H line and V line on the virtual vertical screen) and be formed with an excellent distant visibility because of the same reason as that in the second exemplary embodiment.

A description will now be given of a vehicle lighting fixture according to a fourth exemplary embodiment with reference to the drawings.

Figure 37:
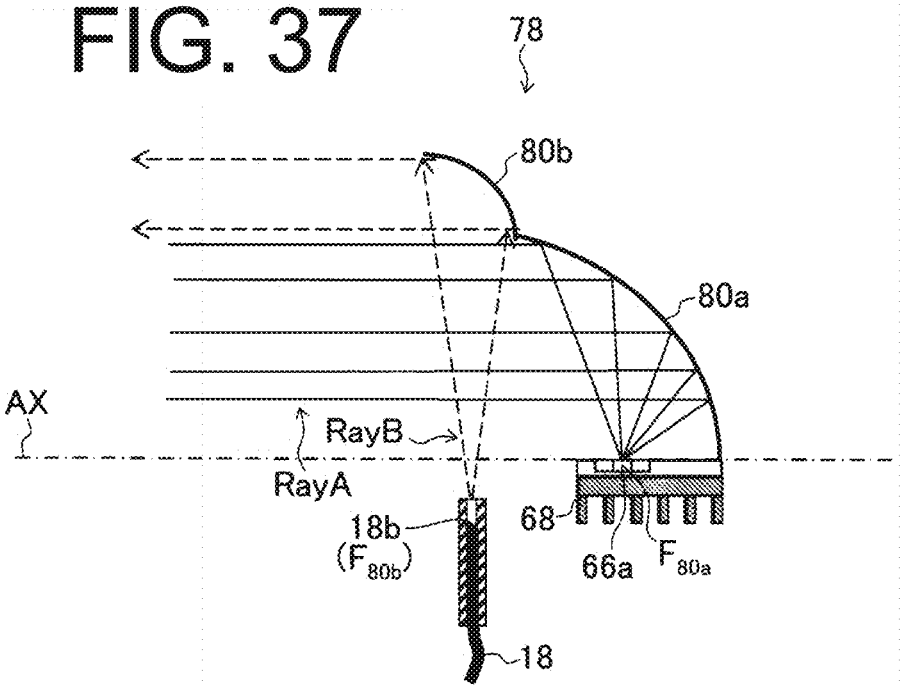
FIG. 37 is a vertical cross-sectional view illustrating a vehicle lighting fixture 78 according to a fourth exemplary embodiment of the presently disclosed subject matter.

FIG. 37 is a vertical cross-sectional view illustrating a vehicle lighting fixture 78 according to the fourth exemplary embodiment of the presently disclosed subject matter.

Hereinafter, points of the fourth exemplary embodiment different from those of the vehicle lighting fixture 10 of the first exemplary embodiment will be mainly described, and the same or similar components of the fourth exemplary embodiment as or to those of the vehicle lighting fixture 10 of the first exemplary embodiment will be denoted by the same reference numbers and descriptions therefor will be omitted as appropriate.

The vehicle lighting fixture 78 can be configured to form a high-beam light distribution pattern $P_{Hi}$ (corresponding to the predetermined light distribution pattern of the presently disclosed subject matter) by overlaying the basic light distribution pattern $P1_{Hi}$ and the additional light distribution pattern $P2_{Hi}$ as illustrated in FIGS. 24A to 24C. As illustrated in FIG. 37, the vehicle lighting fixture 78 can include a first light source 66*a*, a first reflector 80*a*, a second reflector 80*b*, an SC light source 12 (not illustrated in FIG. 37) configured to output SC light containing light in a visible wavelength region, a removal member 14 (not illustrated in FIG. 37) configured to remove (cut) light other than the light in a predetermined visible wavelength region (for example, 450 nm to 700 nm) from the SC light output from the SC light source 12, a transmission optical fiber 18 configured to transmit the SC light output from the SC light source 12 to the second reflector 80*b*, etc. Note that when the surface shapes of the respective first and second reflectors 80*a* and 80*b* are adjusted appropriately, the vehicle lighting fixture 78 can be configured to be a low-beam vehicle lighting fixture to form a low-beam light distribution pattern $P_{Lo}$ (corresponding to the predetermined light distribution pattern of the presently disclosed subject matter) by overlaying the basic light distribution pattern $P1_{Lo}$ and the additional light distribution pattern $P2_{Lo}$ as illustrated in FIG. 32.

The vehicle lighting fixture 78 can have a reference axis AX (or referred to as an optical axis) extending in a front-rear direction of a vehicle body. The first light source 66*a* can be disposed to face upward (the light emission face faces upward) and be fixed to a holding member 68 such as a heat dissipation plate at or near the reference axis AX and at or near a focal point $F_{80a}$ of the first reflector 80*a*.

The first reflector 80*a* can be a paraboloid of revolution (or a free curved surface equivalent thereto) with the focal point $F_{80a}$ thereof at or near the first light source 66*a*. The first reflector 80*a* can be configured so as to reflect the light rays emitted from the first light source 66*a* forward to form the basic light distribution pattern $P1_{Hi}$ on the virtual vertical screen.

The first reflector 80*a* can be shaped as a dome shape to cover the first light source 66*a* from its side to its top so as to receive the light emitted upward (in the radial direction) from the first light source 66*a* except for the area where the reflected light from the first reflector 80*a* passes. The first reflector 80*a* can be fixed to the holding member 68 at its lower peripheral edge.

In this manner, the first reflector 80*a* can constitute the first optical system of the presently disclosed subject matter. Specifically, the light rays RayA emitted from the first light source 66*a* mainly containing incoherent light can be reflected by the first reflector 80*a* and then projected forward to form the basic light distribution pattern $P1_{Hi}$ on the virtual vertical screen.

The transmission optical fiber 18 can be held by a holding member such as a sleeve while an emission end face 18*b* (serving as the second light source 18*b*) of the transmission optical fiber 18 faces upward to be disposed in front of the front end edge of the first reflector 80*a* and below the reference axis AX.

The second reflector 80*b* can be a paraboloid of revolution (or a free curved surface equivalent thereto) with a focal point $F_{80b}$ thereof at or near the second light source 18*b*. The second reflector 80*b* can be configured so as to reflect the light rays emitted from the second light source 18*b* forward to form the additional light distribution pattern $P2_{Hi}$ on the virtual vertical screen.

The second reflector 80*b* can be disposed at a position so as to receive the light emitted upward (in the radial direction) from the second light source 18*b* where the second reflector 80*b* does not shield the light reflected off from the first reflector 80*a*.

The first and second reflectors 80*a* and 80*b* can be formed as an integrated single part or separately formed as respective individual parts for combined use. When the first and second reflectors 80*a* and 80*b* are formed integrally as a single reflecting member, it is possible to reduce the parts number, simplify the assembly steps, and reduce the assembly errors when compared with the case where the first and second reflectors 80*a* and 80*b* are constituted as separate reflecting members.

From the SC light containing light in the visible wavelength region output from the SC light source 12 (specifically, mainly containing coherent light), the light other than the light in the predetermined visible wavelength region (for example, 450 nm to 700 nm) can be removed in advance by the removal member 14. Then, the SC light can be condensed by the condenser lens 20 (see FIG. 17) and allowed to be incident on the incident end face 18*a* of the transmission optical fiber 18. The SC light then can be transmitted through the transmission optical fiber 18 to reach and exit through the emission end face 18*b* (see a dotted line showing the light rays RayB in FIG. 37). Then the SC light can be reflected by the second reflector 80*b* forward, thereby forming the additional light distribution pattern $P2_{Hi}$ on the virtual vertical screen. The additional light distribution pattern $P2_{Hi}$ can be overlaid on the basic light distribution pattern $P1_{Hi}$ to form the high-beam light distribution pattern $P_{Hi}$ as a synthetic light distribution pattern. Here, the second incident face 80*b* can constitute the second optical system of the presently disclosed subject matter.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

The vehicle lighting fixture according to the present exemplary embodiment can form the basic light distribution pattern $P1_{Hi}$ with the light mainly containing incoherent light and the additional light distribution pattern $P2_{Hi}$ with the light mainly containing coherent light overlaid with each other. The resulting predetermined light distribution can be formed with an excellent distant visibility as a high-beam light distribution pattern $P_{Hi}$.

A description will now be given of a modified example of the vehicle lighting fixture with reference to the drawing.

Figure 38:
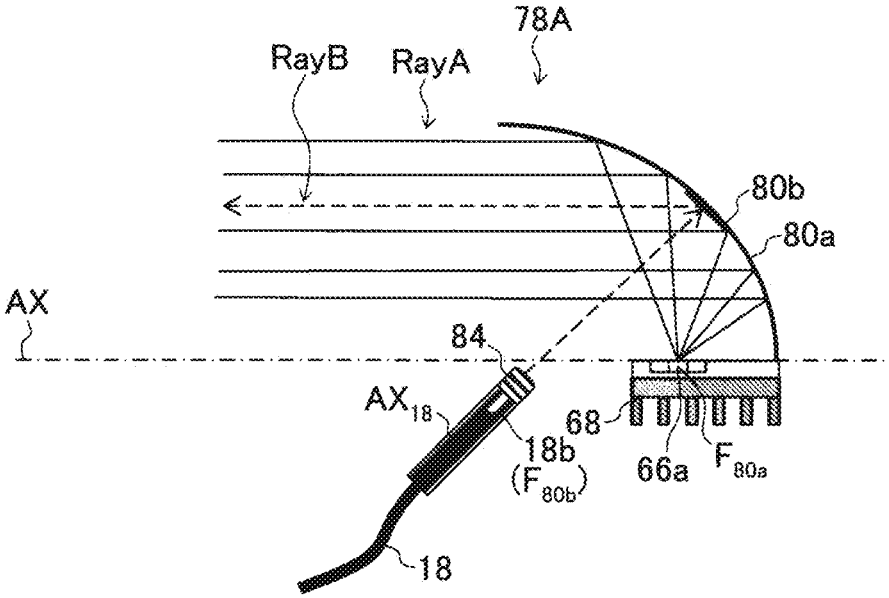
FIG. 38 is a vertical cross-sectional view illustrating a vehicle lighting fixture 78A as a modified example.

FIG. 38 is a vertical cross-sectional view illustrating a vehicle lighting fixture 78A as a modified example.

As illustrated, the vehicle lighting fixture 78A can be configured to form a high-beam light distribution pattern $P_{Hi}$ (corresponding to the predetermined light distribution pattern of the presently disclosed subject matter) by overlaying the basic light distribution pattern $P1_{Hi}$ and the additional light distribution pattern $P2_{Hi}$ as illustrated in FIG. 24. The vehicle lighting fixture 78A can be configured on the basis of the components of the vehicle lighting fixture 78 of the fourth exemplary embodiment except that part of the first reflector 80*a* is configured to serve as the second reflector 80*b* and the optical axis AX18 of the transmission optical fiber 18 is inclined rearward and obliquely upward with respect to the reference axis AX.

According to this modified example, as in the fourth exemplary embodiment, the light rays RayA that are emitted from the first light source 66*a* mainly containing incoherent light and reflected by the first reflector 80*a* can form the basic light distribution pattern $P1_{Hi}$ on a virtual vertical screen. Furthermore, the light rays RayB that are emitted from the second light source 18*b* mainly containing coherent light and reflected by the second reflector 80*b* can form the additional light distribution pattern $P2_{Hi}$. The additional light distribution pattern $P2_{Hi}$ can be overlaid on the basic light distribution pattern $P1_{Hi}$ to form the high-beam light distribution pattern $P_{Hi}$ as a synthetic light distribution pattern.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

A description will now be given of another modified example of the vehicle lighting fixture with reference to the drawing.

Figure 39:
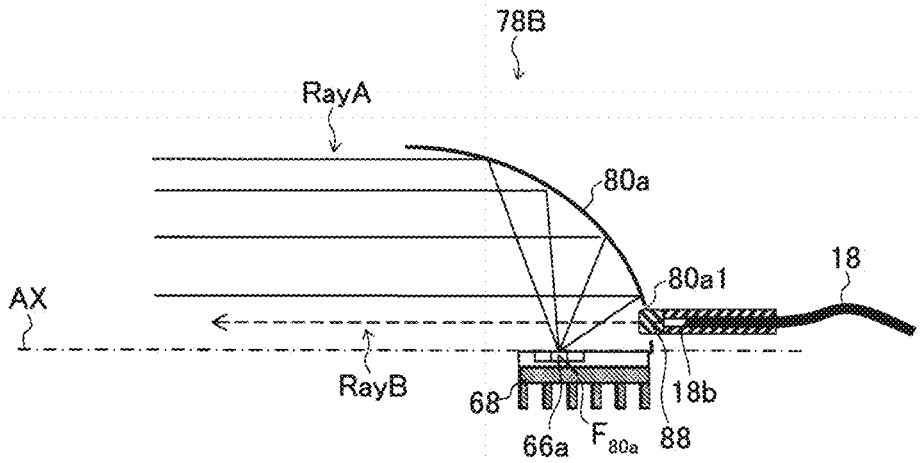
FIG. 39 is a vertical cross-sectional view illustrating a vehicle lighting fixture 78B as another modified example.

FIG. 39 is a vertical cross-sectional view illustrating a vehicle lighting fixture 78B as another modified example.

As illustrated, the vehicle lighting fixture 78B can be configured to form a high-beam light distribution pattern $P_{Hi}$ (corresponding to the predetermined light distribution pattern of the presently disclosed subject matter) by overlaying the basic light distribution pattern $P1_{Hi}$ and the additional light distribution pattern $P2_{Hi}$ as illustrated in FIG. 24. The vehicle lighting fixture 78B can be configured on the basis of the components of the vehicle lighting fixture 78 of the fourth exemplary embodiment except that the second reflector 80*b* in the vehicle lighting fixture 78 is omitted, the emission end portion of the transmission optical fiber 18 faces a through hole 80*a*1 formed in the first reflector 80*a* at an area closer to the reference axis AX, and a condenser lens 88 configured to condense the light from the second light source 18*b* is disposed between the second light source 18*b* and the through hole 80*a*1.

According to this modified example, as in the fourth exemplary embodiment, the light rays RayA that are emitted from the first light source 66*a* mainly containing incoherent light and reflected by the first reflector 80*a* can form the basic light distribution pattern $P1_{Hi}$ on a virtual vertical screen. Furthermore, the light rays RayB that are emitted from the second light source 18*b* mainly containing coherent light can form the additional light distribution pattern $P2_{Hi}$. The additional light distribution pattern $P2_{Hi}$ can be overlaid on the basic light distribution pattern $P1_{Hi}$ to form the high-beam light distribution pattern $P_{Hi}$ as a synthetic light distribution pattern.

The resulting high-beam light distribution pattern $P_{Hi}$ can have a relatively high center light intensity (near the crossing point of H line and V line on the virtual vertical screen) and be formed with an excellent distant visibility because of the same reason as that in the second exemplary embodiment.

A description will now be given of a vehicle lighting fixture according to a fifth exemplary embodiment with reference to the drawings.

Figure 40:
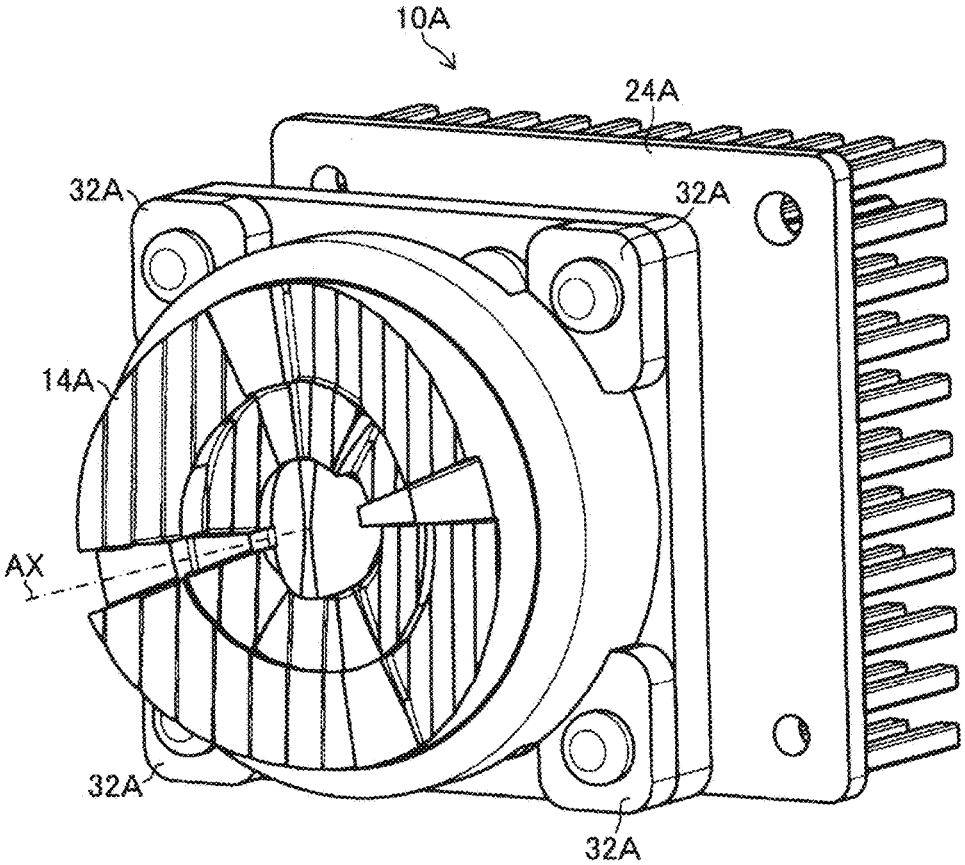
FIG. 40 is a perspective view illustrating a vehicle lighting fixture 10A according to still another exemplary embodiment of the presently disclosed subject matter.
Figure 41:
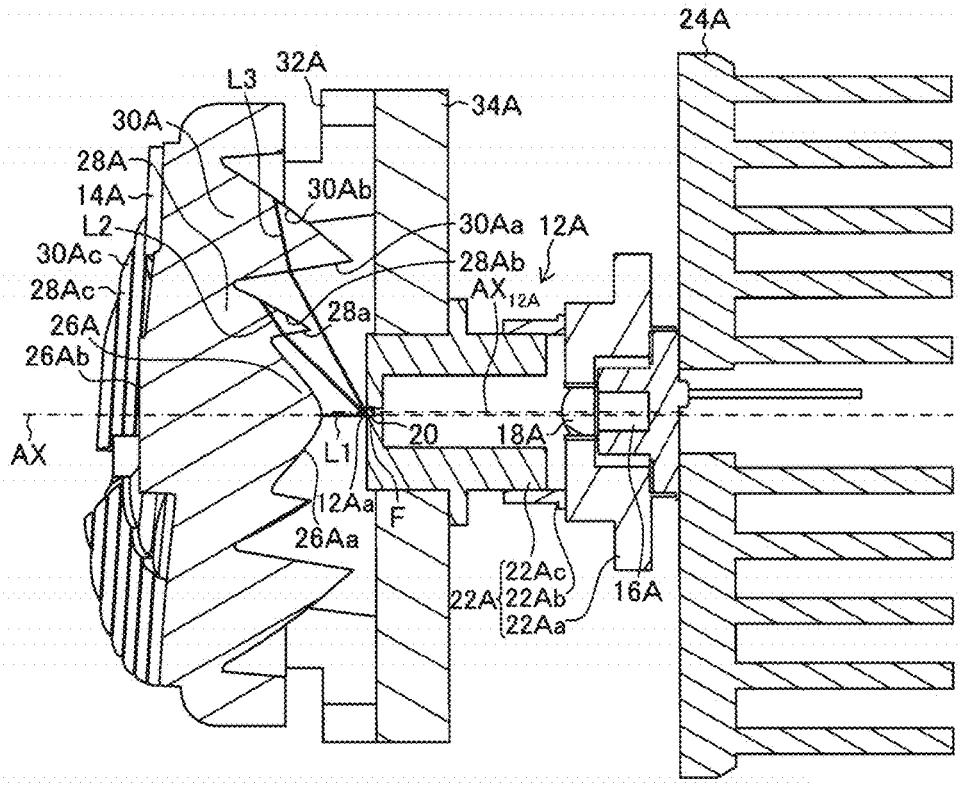
FIG. 41 is a vertical cross-sectional view of the vehicle lighting fixture 10A.
Figure 42:
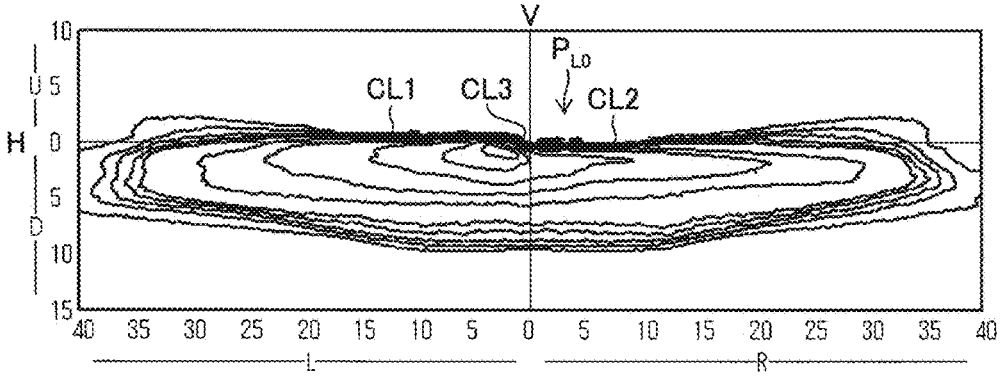
FIG. 42 is a diagram illustrating an example of a low-beam light distribution pattern $P_{Lo}$ formed on a virtual vertical screen by the vehicle lighting fixture 10A.

FIG. 40 is a perspective view illustrating a vehicle lighting fixture 10A according to the fifth exemplary embodiment of the presently disclosed subject matter, FIG. 41 is a vertical cross-sectional view of the vehicle lighting fixture 10A, and FIG. 42 is a diagram illustrating an example of a low-beam light distribution pattern $P_{Lo}$ formed on a virtual vertical screen, which is assumed to be disposed in front of a vehicle body about 25 meters away from the vehicle body, by the vehicle lighting fixture 10A.

Hereinafter, points of the fifth exemplary embodiment different from those of the vehicle lighting fixture 10 of the first exemplary embodiment will be mainly described, and the same or similar components of the fifth exemplary embodiment as or to those of the vehicle lighting fixture 10 of the first exemplary embodiment will be denoted by the same reference numbers and descriptions therefor will be omitted as appropriate.

As illustrated in FIGS. 40 and 41, the vehicle lighting fixture 10A with a reference axis AX (or optical axis) extending in a front-rear direction of a vehicle body can include a light source 12A and a lens member 14A. The light source 12A can have an emission face 12Aa and disposed on the reference axis AX so that the emission face 12Aa faces forward. The lens member 14A can be disposed in front of the emission face 12Aa of the light source 12A. The vehicle lighting fixture 10A can be configured as a vehicle headlamp configured to form a low-beam light distribution pattern $P_{Lo}$ by the light rays that are emitted from the light source 12A and pass through the lens member 14A. The low-beam light distribution pattern $P_{Lo}$ can include, at its upper end edge, a left horizontal cut-off line CL1, a right horizontal cut-off line CL2, and an inclined cut-off line CL3 between the left and right horizontal cut-off lines CL1 and CL2 as illustrated in FIG. 42. The above-mentioned configuration is not restrictive, and the vehicle lighting fixture can be configured to be a vehicle headlamp configured to form a high-beam light distribution pattern $P_{Hi}$, other vehicle headlamp such as a fog lamp, etc.

The light source 12A can be configured to include a laser light source 16A, a condenser lens 18A, a wavelength converting member 20A, a holder 22A configured to hold these members, etc. The holder 22A can be configured to include a lens holder 22Aa configured to hold the condenser lens 18A; a ring 22A to be fixed to the lens holder 22Aa; and a connection flange 22Ac to be fixed to the ring 22Ab.

The laser light source 16A can be configured to emit blue laser light (for example, with a wavelength of 450 nm) and be a can-package type semiconductor laser light source including a laser diode (LD element) packaged. The laser light source 16A may be another type laser light source, for example, emitting near UV rays (for example, with a wavelength of 405 nm). The vehicle lighting fixture 10A can further include a heat sink 24A to which the laser light source 16A can be fixed so that the heat generated by the laser light source 16A can dissipate therethrough.

The wavelength converting member 29A can be configured to receive the laser light that is emitted from the laser light source 16A and condensed by the condenser lens 18A and partly convert the laser light into light having a wavelength different from that of the laser light. Specifically, the wavelength converting member 29A can be configured to a plate or laminate-shaped phosphor that can be excited by the blue laser light (wavelength: 450 nm) to emit yellow light. The wavelength converting member 20A can have a rectangular emission face 12Aa with an aspect ratio of 1:2, for example, a size of a vertical length 0.4 mm and a horizontal length 0.8 mm).

The wavelength converting member 20A may be a plate or laminate-shaped phosphor that can be excited by near UV laser light (wavelength: 405 nm) to emit red, green, and blur light.

In this exemplary embodiment, when blue laser light is emitted, the wavelength converting member 20A can emit white light (pseud white light) produced by mixing blue laser light and yellow light as a result of excitation of the wavelength converting member 20A by the blue laser light. In an alternative example, when near UV laser light is emitted, the corresponding wavelength converting member can emit white light (pseud white light) produced by mixing three color light (red, green, and blue light) as a result of excitation of the wavelength converting member by the near UV laser light.

Note that the light source 12A may be a semiconductor light emitting element such a white LED light source or light emitting element with other systems as long as it can include a rectangular emission face.

The directivity characteristics of the light emitted from the emission face 12Aa of the light source 12A is Lambertian and can be represented by $I(\theta)=I_0\times\cos\theta$. This shows how the light emitted from the emission face 12Aa of the light source 12A is spread. Here, the $I(\theta)$ represents a light intensity when observed in a direction inclined by an angle $\theta$ with respect to the optical axis $AX_{12}$ of the light source 12A, and $I_0$ represents a light intensity on the optical axis $AX_{12}$. The light source 12A can be configured such that the light intensity on the optical axis $AX_{12}$ ($\theta$=0 (zero)) takes the maximum value. Note that the optical axis $AX_{12}$ of the light source 12A can pass through the center of the emission face 12Aa and extend in a direction perpendicular to the emission face 12Aa.

The light source 12A can be fixed to a lens holder 34A such that the emission face 12Aa faces forward, and the lower end edge (longer side) of the emission face 12Aa is coincident with a horizontal line perpendicular to the reference axis AX and is located at a reference point F of the lens member 14A in terms of optical designing.

The lens member 14A can be configured to include a central lens part 26A, an intermediate lens part 28A, an outer lens part 30A, a flange part 32A, and the reference point F in terms of optical designing. The central lens part 26A can be disposed on the reference axis AX. The intermediate lens part 28A can be disposed to surround the central lens part 26A. Furthermore, the outer lens part 30A can be disposed to surround the intermediate lens part 28A. The lens member 14A can be fixed to the lens holder 34A at its flange part 32A to be disposed in front of the emission face 12Aa of the light source 12A. The lens member 14A can be formed from a transparent resin such as a polycarbonate or acrylic resin, or a glass material.

Figure 43:
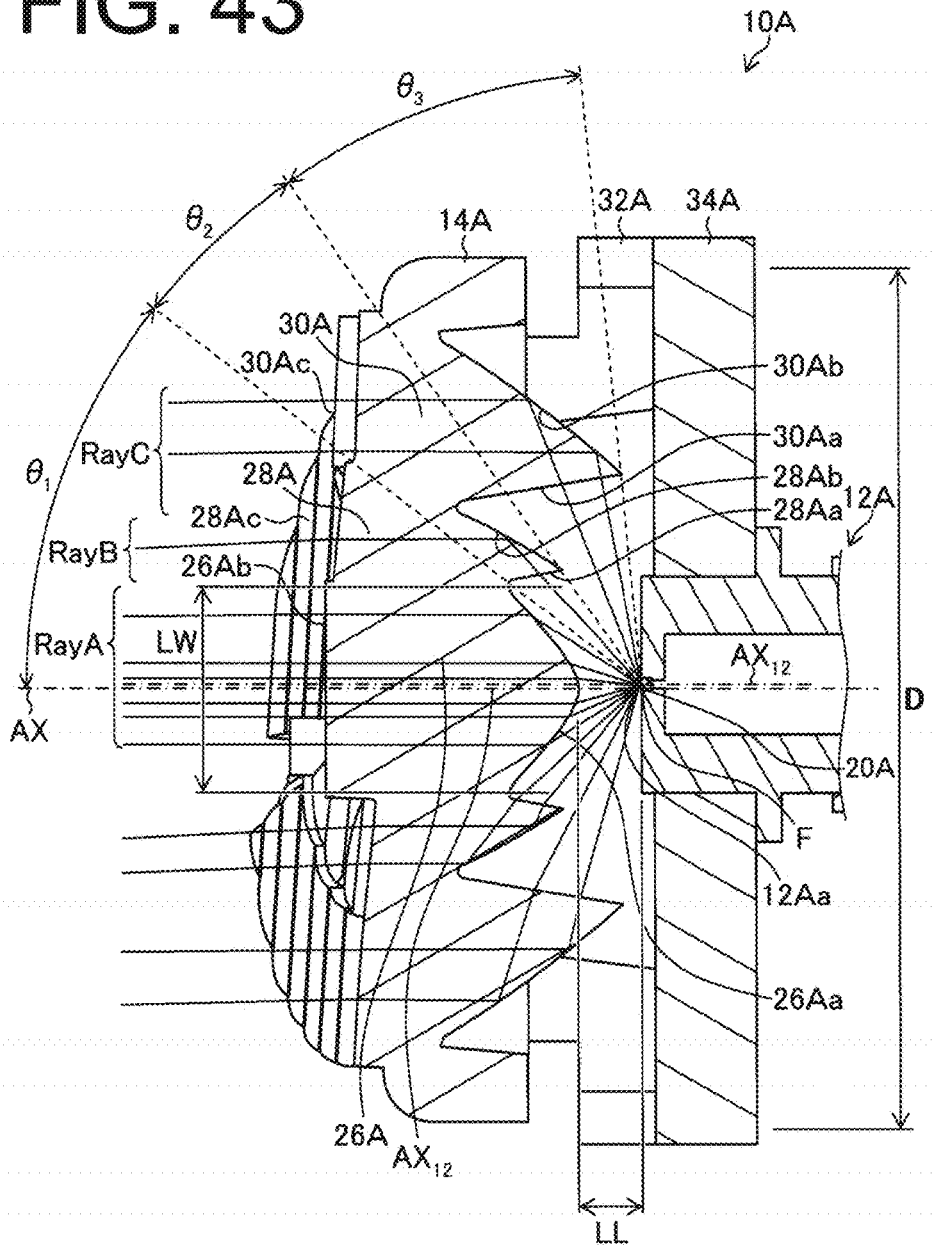
FIG. 43 is a vertical cross-sectional view illustrating acceptance angles $\theta_1$ to $\theta_3$ of a lens member 14A.

FIG. 43 is a vertical cross-sectional view illustrating acceptance angles $\theta_1$ to $\theta_3$ of the lens member 14A.

As illustrated, the lens member 14A may have a diameter D of 32 mm, for example, and the central lens part 26A can be formed to have a central incident face 26Aa, and configured such that a distance LL between the top of the central incident face 26Aa of the central lens part 26A and the emission face 12Aa of the light source 12A may be 2.5 mm, for example. Furthermore, the diameter D of the lens member 14 and the distance LL between the top of the central incident face 26Aa of the central lens part 26A and the emission face 12Aa of the light source 12A may be 12:1, for example. Furthermore, the central lens part 26A can have a diameter LW, and a ratio of the diameter LW and the distance LL between the top of the central incident face 26Aa of the central lens part 26A and the emission face 12Aa of the light source 12A may be 3.4:1, for example. Here, the acceptance angle $\theta_1$ of the central lens part 26A may be 0 to 38 degrees, the acceptance angle $\theta_2$ of the intermediate lens part 28A may be 38 to 57 degrees (back focus of the lens at 45 degrees being 3.3 (in terms of LL ratio)), and the acceptance angle $\theta_2$ of the intermediate lens part 28A may be 38 to 57 degrees (back focus of the lens at 45 degrees being 3.3 (in terms of LL ratio)).

First, the configuration of the central lens part 26A will be described.

The central lens part 26A can be configured to include a central incident face 26Aa formed at the rear end portion of the central lens part 26A facing to the emission face 12Aa of the light source 12A, and a central emission face 26Ab formed at the front end portion of the central lens part 26A.

Figure 45:
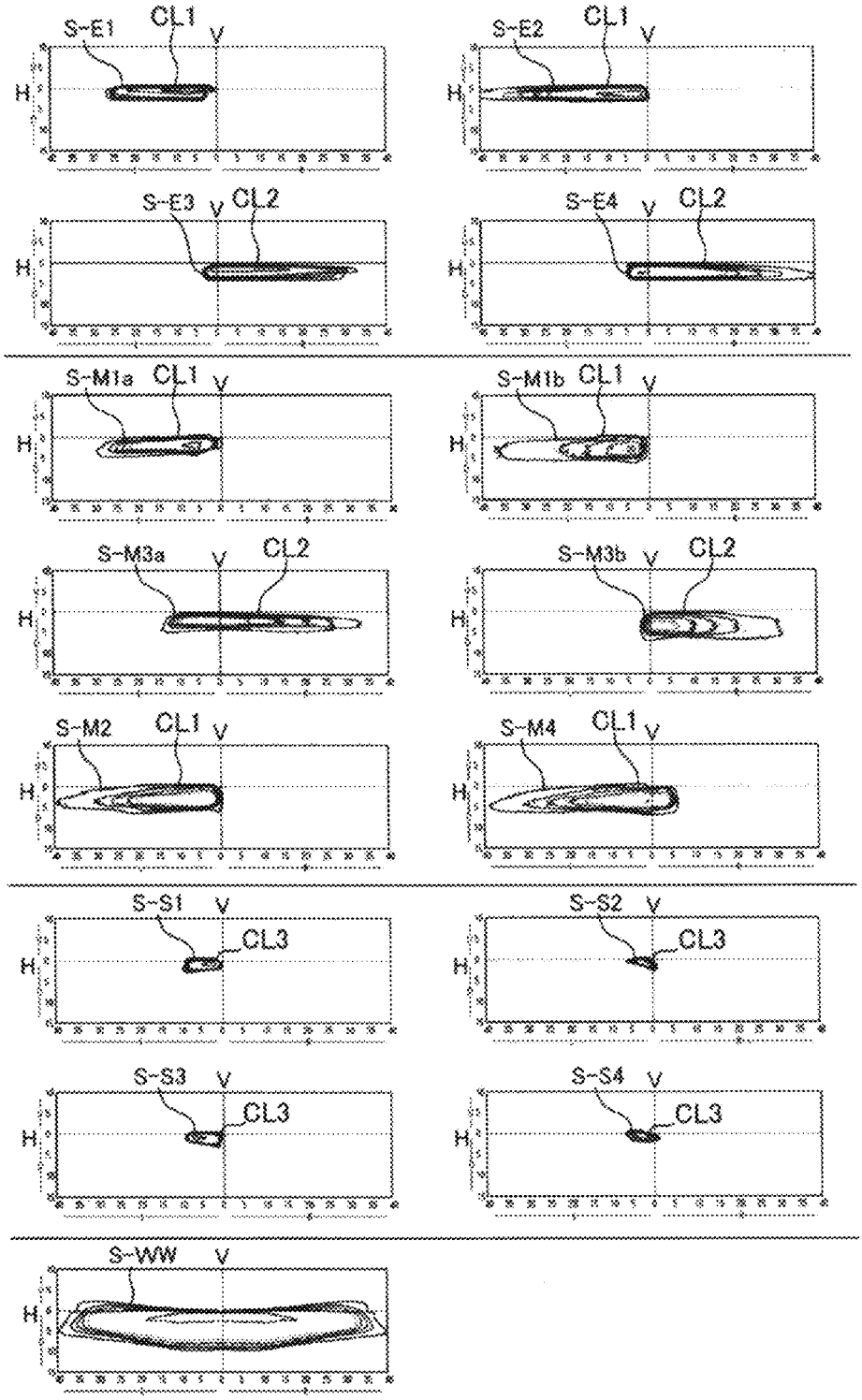
FIG. 45 includes various light distribution patterns formed on the virtual vertical screen by the emission light through the lens member 14A.

The central lens part 26A can form a diffused pattern S-WW (or a first light distribution pattern as illustrated in FIG. 45) by allowing light rays RayA that are emitted from the light source 12A to enter the central lens part 26A through the central incident face 26Aa and are projected through the central emission face 26Ab forward.

Specifically, as illustrated in FIG. 43, the central incident face 26Aa can be formed as a convex surface toward the light source 12 in a circular region around the reference axis AX at the rear end portion of the central lens part 26A facing to the light source 12A. The central incident face 26Aa with this configuration can receive the light rays RayA emitted from the light source 12A in a narrow angle direction with respect to the optical axis $AX_{12}$ (the acceptance angle $\theta_1$ of the central lens part 26A being 0 to 38 degrees) with the light rays RayA having a relatively high light intensity.

With this configuration, the central incident face 26Aa can collimate the incident light rays RayA from the light source 12A.

It is desirable to provide a light-shielding film or reflecting film in an area of the central incident face 26Aa where, when the wavelength converting member 20A is dropped off from the holder 22A, the laser light emitted from the laser light source 16A and condensed by the condenser lens 18A is directly incident. This can ensure the failsafe function when the wavelength converting member 20A is dropped off from the holder 22A. Even in this case, since the distance LL between the central lens part 26A and the emission face 12Aa of the light source 12A is extremely short, the size of the light-shielding film or reflecting film can be minimized.

The central emission face 26Ab can project the light rays RayA entering the central lens part 26A through the central incident face 26Aa and be formed in a circular region around the reference axis AX at the front end portion of the central lens part 26A.

A description will next be given of the relationship between the central emission face 26A and the image of the light source.

Figure 44:
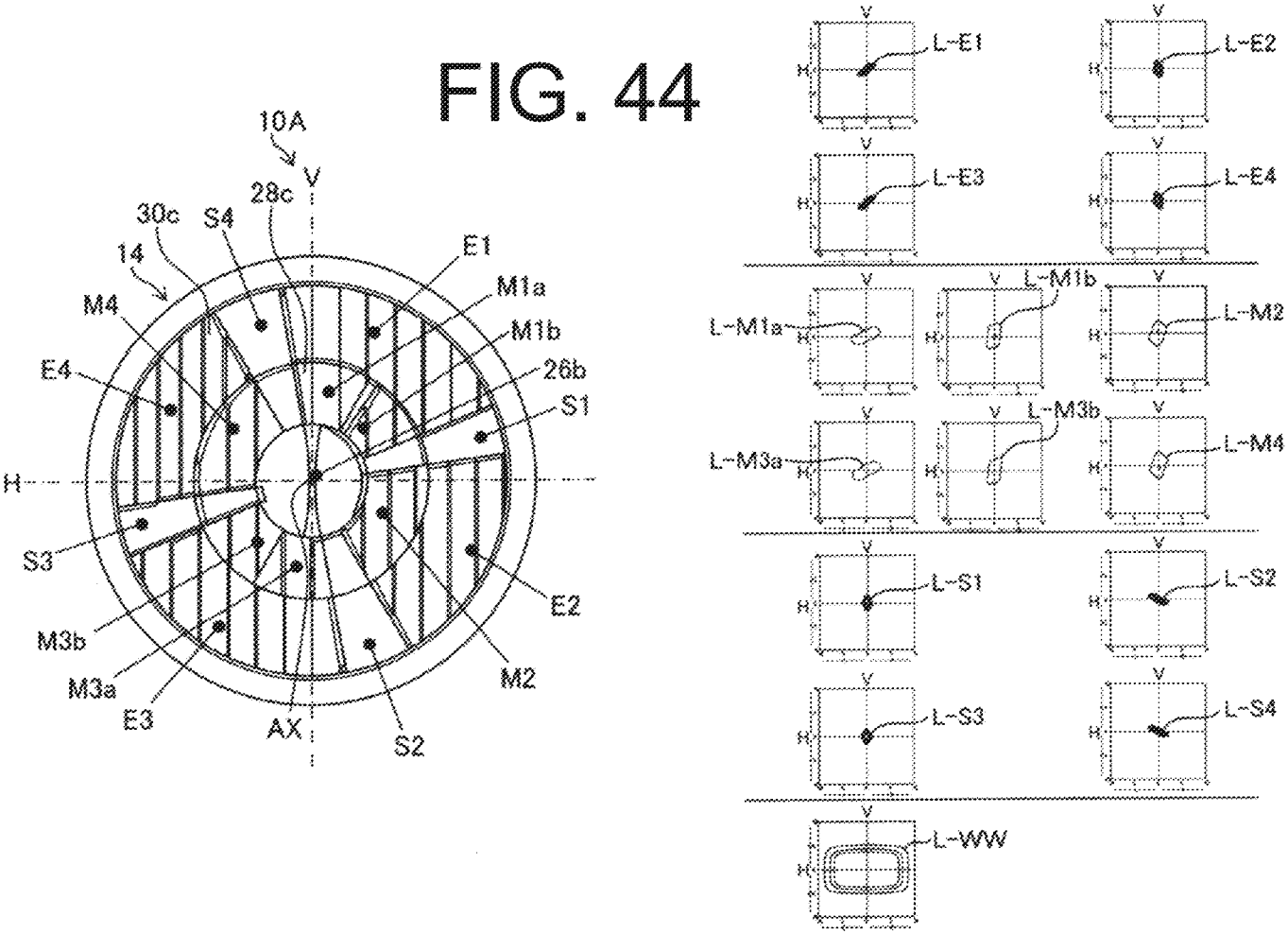
FIG. 44 includes a front view of the vehicle lighting fixture 10A and light source images to be formed on the virtual vertical screen by emission light through the lens member 14A.

FIG. 44 includes a front view of the vehicle lighting fixture 10A and light source images to be formed on the virtual vertical screen by emission light through the lens body 14. Furthermore, FIG. 45 includes various light distribution patterns formed on the virtual vertical screen by the emission light through the lens body 14A.

If the central emission face 26Ab is a plane surface perpendicular to the reference axis AX, a light source image L-WW formed by the emission light rays RayA through the central emission face 26Ab is as illustrated in FIG. 44.

Actually, the central emission face 26Ab is not a plane surface, but can be configured to form a diffused pattern S-WW (see FIG. 45 as the first light distribution pattern) by the emission light rays RayA through the central emission face 26Ab uniformly diffused in the horizontal direction. As illustrated in FIG. 45, the diffused pattern S-WW extends by 40 degrees to L and R directions at both ends thereof. The surface shape of the central emission face 26Ab is thus adjusted to form such a diffused pattern S-WW.

The diffused pattern S-WW can have a region along the horizontal line H with higher brightness than other regions. This is because, the lower end edge (long side) of the emission face 12Aa of the light source 12A is located at or near the reference point F of the lens member 14A in terms of the optical designing, meaning that the entire light source 12A is disposed above the reference point F.

Further, in this case the diffused pattern S-WW can be formed by bluish light toward the optical axis $AX_{12}$ to improve the visibility by peripheral field of vision. For example, this can be done as follows. When a light source using a blue laser light source 16A and a yellow wavelength converting member 20A is used as the light source 12A, the travelling distance of laser light passing through the wavelength converting member 20A changes depending on the travelling direction. As a result, the light travelling toward the optical axis $AX_{12}$ may become bluish while the light traveling in a larger angle with respect to the optical axis $AX_{12}$ may become yellowish.

The configuration of the intermediate lens part 28A will next be described.

As illustrated in FIG. 43, the intermediate lens part 28A can be configured to include an intermediate incident face 28Aa, an intermediate reflecting face 28Ab, and an intermediate emission face 28Ac. The intermediate incident face 28Aa can be formed at the rear end portion of the intermediate lens part 28A to surround the central lens part 26A. The intermediate reflecting face 28Ab can be formed at the rear end portion of the intermediate lens part 28A to surround the intermediate incident face 28Aa. The intermediate emission face 28Ac can be formed at the rear end portion of the intermediate lens part 28A to surround the central emission face 26Ab.

The intermediate lens part 28A can form narrower patterns S-M1*a*, S-M1*b*, S-M2, S-M3*a*, S-M3*b*, S-M4, S-S1, S-S2, S-S3, and S-S4 than the diffused pattern S-WW (or a second light distribution pattern as illustrated in FIG. 45) by allowing light rays RayB that are emitted from the light source 12A to enter the intermediate lens part 28A through the intermediate incident face 28Aa, internally (totally) reflected by the intermediate reflecting face 28Ab, and then projected through the intermediate emission face 28Ac forward.

Specifically, as illustrated in FIG. 43, the intermediate incident face 28Aa with this configuration can receive the light rays RayB emitted from the light source 12A in a middle angle direction with respect to the optical axis $AX_{12}$ (the acceptance angle $\theta_2$ of the intermediate lens part 28A being 38 to 57 degrees) with the light rays RayB having a relatively low light intensity.

The intermediate reflecting face 28Ab can receive the light rays RayB entering the intermediate lens part 28A through the intermediate incident face 28Aa and internally (totally) reflect the same to the intermediate emission face 28Ac.

The intermediate reflecting face 28Ab can be configured to collimate the light rays RayB entering the intermediate lens part 28A through the intermediate incident face 28Aa parallel to the reference axis AX.

The intermediate emission face 28Ac can be configured to project the light rays RayB totally reflected by the intermediate reflecting face 28Ab.

As illustrated in FIG. 44, the intermediate emission face 28Ac can be sectioned to have a plurality of sector-shaped emission regions M1*a*, M1*b*, M2, M3*a*, M3*b*, M4, S1, S2, S3, and S4 by a plurality of border lines radially extending from the central lens part 26A.

Among the sector-shaped emission regions M1*a*, M1*b*, M2, M3*a*, M3*b*, M4, S1, S2, S3, and S4, the emission regions S1, S2, S3, and S4 where one side of the light source image by the emission light rays RayB is inclined by an angle of an inclined cut-off line CL3 or smaller can be disposed at or near the horizontal line H and the vertical line V For example, the emission region S1 can be disposed at a sector-shaped region with an angle range from 7.5 degrees to 22.5 degrees on the right side with respect to the vertical line V and above the horizontal line H when viewed from its front side. The emission region S3 can be disposed at a sector-shaped region with an angle range from 7.5 degrees to 22.5 degrees on the left side with respect to the vertical line V and below the horizontal line H when viewed from its front side. The emission region S2 can be disposed at a sector-shaped region with an angle range from 10 degrees to 30 degrees on the right side with respect to the vertical line V and below the horizontal line H when viewed from its front side. The emission region S4 can be disposed at a sector-shaped region with an angle range from 10 degrees to 30 degrees on the left side with respect to the vertical line V and above the horizontal line H when viewed from its front side.

Next, a description will be given of the relationship between the emission regions S1, S2, S3, and S4 and the light source images.

If the emission regions S1, S2, S3, and S4 each are a plane surface perpendicular to the reference axis AX, the light source images L-S1, L-S2, L-S3, and L-S4 formed by the emission light rays RayB through the emission regions S1, S2, S3, and S4 are as illustrated in FIG. 44.

Actually, the emission regions S1, S2, S3, and S4 are not a plane surface, but can be configured to form the light source images L-S1, L-S2, L-S3, and L-S4 (see FIG. 45 as the condensed light patterns S-S1, S-S2, S-S3, and S-S4) by the emission light rays RayB through the emission regions S1, S2, S3, and S4 such that one sides of the respective light source images L-S1, L-S2, L-S3, and L-S4 are along the inclined cut-off line CL3 while the entire light source images L-S1, L-S2, L-S3, and L-S4 are disposed below the inclined cut-off line CL3. This arrangement can form the inclined cut-off line CL3 clearly.

Next, a description will be given of the relationship between the emission regions M1*a*, M1*b*, M2, and M4 and the light source images.

If the emission regions M1*a*, M1*b*, M2, and M4 each are a plane surface perpendicular to the reference axis AX, the light source images L-M1*a*, L-M1*b*, L-M2, and L-M4 formed by the emission light rays RayB through the emission regions M1*a*, M1*b*, M2, and M4 are as illustrated in FIG. 44.

Actually, the emission regions M1*a*, M1*b*, M2, and M4 are not a plane surface, but can be configured to dispose diffused patterns S-M1*a*, S-M1*b*, S-M2, and S-M4 (see FIG. 45 as the second light distribution pattern) by horizontally diffusing the emission light rays RayB through the emission regions M1*a*, M1*b*, M2, and M4 such that upper end edges thereof are along the left horizontal cut-off line CL1 while the entire diffused patterns S-M1*a*, S-M1*b*, S-M2, and S-M4 are disposed below the left horizontal cut-off line CL1. For example, the emission regions M1*a*, M1*b*, M2, and M4 may be formed to include an optical element such as a prism or a lens cut configured to horizontally diffuse the emission light rays RayB through the emission regions M1*a*, M1*b*, M2, and M4. This arrangement can form the left horizontal cut-off line CL1 clearly.

In FIG. 45, the diffused pattern S-M1*a* extends at a position of an angle of about 30 degrees in terms of the dimension in the horizontal direction. This can be achieved by adjusting the surface shape of the emission region M1*a*. By appropriately adjusting so, the horizontal dimension of the diffused pattern S-M1*a* can be desirably controlled. With the same manner, the diffused patterns S-M1*b*, S-M2, and S-M4 can be adjusted.

In FIG. 45, the entire diffused pattern S-M1*a* is disposed below the left horizontal cut-off line CL1. This can be achieved by adjusting the inclination angle of the emission region M1*a*. By appropriately adjusting so, the diffused pattern S-M1*a* can be desirably disposed on an appropriate position of the virtual vertical screen. With the same manner, the diffused patterns S-M1*b*, S-M2, and S-M4 can be adjusted.

Next, a description will be given of the relationship between the emission regions M3*a* and M3*b* and the light source images.

If the emission regions M3*a* and M3*b* each are a plane surface perpendicular to the reference axis AX, the light source images L-M3*a* and L-M3*b* formed by the emission light rays RayB through the emission regions M3*a* and M3*b* are as illustrated in FIG. 44.

Actually, the emission regions M3*a* and M3*b* are not a plane surface, but can be configured to dispose diffused patterns S-M3*a* and S-M3*b* (see FIG. 45 as the second light distribution pattern) by horizontally diffusing the emission light rays RayB through the emission regions M3*a* and M3*b* such that upper end edges thereof are along the right horizontal cut-off line CL2 while the entire diffused patterns S-M3*a* and S-M3*b* are disposed below the right horizontal cut-off line CL2. For example, the emission regions M3*a* and M3*b* may be formed to include an optical element such as a prism or a lens cut configured to horizontally diffuse the emission light rays RayB through the emission regions M3*a* and M3*b*. This arrangement can form the right horizontal cut-off line CL2 clearly.

In FIG. 45, the diffused pattern S-M3*a* extends at a position of an angle of about 50 degrees in terms of the dimension in the horizontal direction. This can be achieved by adjusting the surface shape of the emission region M3*a*. By appropriately adjusting so, the horizontal dimension of the diffused pattern S-M3*a* can be desirably controlled. With the same manner, the diffused pattern S-M3*b* can be adjusted.

In FIG. 45, the entire diffused pattern S-M3*a* is disposed below the right horizontal cut-off line CL2. This can be achieved by adjusting the inclination angle of the emission region M3*a*. By appropriately adjusting so, the diffused pattern S-M3*a* can be desirably disposed on an appropriate position of the virtual vertical screen. With the same manner, the diffused pattern S-M3*b* can be adjusted.

In FIG. 45, the diffused patterns S-M3*a* and S-M3*b* extend to the own lane side at their left end portions. This configuration can compensate the light intensity at the area of a road in front of the vehicle body to ensure the uniformity of the light distribution.

The configuration of the outer lens part 30A will next be described.

As illustrated in FIG. 43, the outer lens part 30A can be configured to include an outer incident face 30Aa, an outer reflecting face 30Ab, and an outer emission face 30Ac. The outer incident face 30Aa can be formed at the rear end portion of the outer lens part 30A to surround the intermediate lens part 28A. The outer reflecting face 30Ab can be formed at the rear end portion of the outer lens part 30A to surround the outer incident face 30Aa. The outer emission face 30Ac can be formed at the rear end portion of the outer lens part 30A to surround the intermediate emission face 28Ac.

The outer lens part 30A can form narrower patterns S-E1, S-E2, S-E3, S-E4, S-S1, S-S2, S-S3, and S-S4 than the diffused pattern S-WW (or the second light distribution pattern as illustrated in FIG. 45) by allowing light rays RayC that are emitted from the light source 12A to enter the outer lens part 30A through the outer incident face 30Aa, internally (totally) reflected by the outer reflecting face 30Ab, and then projected through the outer emission face 30Ac forward.

Specifically, as illustrated in FIG. 43, the outer incident face 30Aa with this configuration can receive the light rays RayC emitted from the light source 12A in a middle angle direction with respect to the optical axis $AX_{12}$ (the acceptance angle $\theta_3$ of the outer lens part 30A being 57 to 85 degrees) with the light rays RayC having a relatively low light intensity.

The outer reflecting face 30Ab can receive the light rays RayC entering the outer lens part 30A through the outer incident face 30Aa and internally (totally) reflect the same to the outer emission face 30Ac.

The outer reflecting face 30Ab can be configured to collimate the light rays RayC entering the outer lens part 30A through the outer incident face 30Aa parallel to the reference axis AX.

The outer emission face 30Ac can be configured to project the light rays RayC totally reflected by the outer reflecting face 30Ab.

As illustrated in FIG. 44, the outer emission face 30Ac can be sectioned to have a plurality of sector-shaped emission regions E1, E2, E3, E4, S1, S2, S3, and S4 by a plurality of border lines radially extending from the central lens part 26A.

Among the sector-shaped emission regions E1, E2, E3, E4, S1, S2, S3, and S4, the emission regions S1, S2, S3, and S4 where one side of the light source image by the emission light rays RayC is inclined by the angle of the inclined cut-off line CL3 or smaller can be disposed at or near the horizontal line H and the vertical line V. The description for the emission regions S1, S2, S3, and S4 has already been given, and is omitted here.

Next, a description will be given of the relationship between the emission regions E1 and E2 and the light source images.

If the emission regions E1 and E2 each are a plane surface perpendicular to the reference axis AX, the light source images L-E1 and L-E2 formed by the emission light rays RayC through the emission regions E1 and E2 are as illustrated in FIG. 44.

Actually, the emission regions E1 and E2 are not a plane surface, but can be configured to dispose diffused patterns S-E1 and S-E2 (see FIG. 45 as the second light distribution pattern) by horizontally diffusing the emission light rays RayC through the emission regions E1 and E2 such that upper end edges thereof are along the left horizontal cut-off line CL1 while the entire diffused patterns S-E1 and S-E2 are disposed below the left horizontal cut-off line CL. For example, the emission regions E1 and E2 may be formed to include an optical element such as a prism or a lens cut configured to horizontally diffuse the emission light rays RayC through the emission regions E1 and E2. This arrangement can form the left horizontal cut-off line CL1 clearly.

In FIG. 45, the diffused pattern S-E1 extends at a position of an angle of about 25 degrees in terms of the dimension in the horizontal direction. This can be achieved by adjusting the surface shape of the emission region E1. By appropriately adjusting so, the horizontal dimension of the diffused pattern S-E1 can be desirably controlled. With the same manner, the diffused pattern S-E2 can be adjusted.

In FIG. 45, the entire diffused pattern S-E1 is disposed below the left horizontal cut-off line CL1. This can be achieved by adjusting the inclination angle of the emission region E1. By appropriately adjusting so, the diffused pattern S-E1 can be desirably disposed on an appropriate position of the virtual vertical screen. With the same manner, the diffused pattern S-E2 can be adjusted.

Next, a description will be given of the relationship between the emission regions E3 and E4 and the light source images.

If the emission regions E3 and E4 each are a plane surface perpendicular to the reference axis AX, the light source images L-E3 and L-E4 formed by the emission light rays RayC through the emission regions E3 and E4 are as illustrated in FIG. 44.

Actually, the emission regions E3 and E4 are not a plane surface, but can be configured to dispose diffused patterns S-E3 and S-E4 (see FIG. 45 as the second light distribution pattern) by horizontally diffusing the emission light rays RayC through the emission regions E3 and E4 such that upper end edges thereof are along the right horizontal cut-off line CL2 while the entire diffused patterns S-E3 and S-E4 are disposed below the right horizontal cut-off line CL2. For example, the emission regions E3 and E4 may be formed to include an optical element such as a prism or a lens cut configured to horizontally diffuse the emission light rays RayC through the emission regions E3 and E4. This arrangement can form the right horizontal cut-off line CL2 clearly.

In FIG. 45, the diffused pattern S-E3 extends at a position of an angle of about 35 degrees in terms of the dimension in the horizontal direction. This can be achieved by adjusting the surface shape of the emission region E3. By appropriately adjusting so, the horizontal dimension of the diffused pattern S-E3 can be desirably controlled. With the same manner, the diffused pattern S-E4 can be adjusted.

In FIG. 45, the entire diffused pattern S-E3 is disposed below the right horizontal cut-off line CL2. This can be achieved by adjusting the inclination angle of the emission region E3. By appropriately adjusting so, the diffused pattern S-E3 can be desirably disposed on an appropriate position of the virtual vertical screen. With the same manner, the diffused pattern S-E4 can be adjusted.

In FIG. 45, the diffused patterns S-E3 and S-E4 extend to the own lane side at their left end portions. This configuration can compensate the light intensity at the area of a road in front of the vehicle body to ensure the uniformity of the light distribution.

The low-beam light distribution pattern $P_{Lo}$ as illustrated in FIG. 42 can be formed as a synthetic light distribution pattern by overlaying the condensed patterns S-S1, S-S2, S-S3, and S-S4 and the diffused patterns S-M1*a*, S-M1*b*, S-M2, S-M3*a*, S-M3*b*, S-M4, S-E1, S-E2, S-E3, S-E4, and S-WW, illustrated in FIG. 45, on one another.

Accordingly, the low-beam light distribution pattern $P_{Lo}$ can include the left horizontal cut-off line CL1, right horizontal cut-off line CL2, and inclined cut-off line CL3 at its upper end edge.

The left horizontal cut-off line CL1 can be formed by disposing the diffused patterns S-M1*a*, S-M1*b*, S-M2, S-M4, S-E1, and S-E2 entirely below the left horizontal cut-off line CL1 while their upper end edges are along the left horizontal cut-off line CL1.

The right horizontal cut-off line CL2 can be formed by disposing the diffused patterns S-M3*a*, S-M3*b*, S-E3, and S-E4 entirely below the right horizontal cut-off line CL2 while their upper end edges are along the right horizontal cut-off line CL2.

The inclined cut-off line CL3 can be formed by disposing the light source images L-S1, L-S2, L-S3, and L-S4 (diffused patterns S-S1, S-S2, S-S3, and S-S4) entirely below the inclined cut-off line CL3 while their one sides are along the inclined cut-off line CL3.

As illustrated in FIG. 44, the light source image (L-WW) formed by the outgoing light rays RayA from the central lens part 26 (through the central emission face 26Ab), the light source images (L-M1*a*, L-M1*b*, L-M2, L-M3*a*, L-M3*b*, and L-M4) formed by the outgoing light rays RayB from the intermediate lens part 28A (through the intermediate emission face 28Ac), and the light source images (L-E1, L-E2, L-E3, and L-E4) formed by the outgoing light rays RayC from the outer lens part 30A (through the outer emission face 30Ac) can be light source images having lesser brightness in this order. This is because the distance L1 (optical path length, see FIG. 41) between the light source 12A (emission face 12Aa) and the central lens part 26A (deflection portion), the distance L2 (optical path length, see FIG. 41) between the light source 12A (emission face 12Aa) and the intermediate lens part 28A (deflection portion), and the distance L3 (optical path length, see FIG. 41) between the light source 12A (emission face 12Aa) and the outer lens part 30A (deflection portion) become longer in this order. For example, L1 can be 2.5 mm in a direction of an angle of 0 (zero) degrees with respect to the reference axis AX, L2 can be 8.25 mm in a direction of an angle of 45 degrees with respect to the reference axis AX, and L3 can be 11.25 mm in a direction of an angle of 75 degrees with respect to the reference axis AX.

These small and bright light source images can be condensed or diffused to form the respective condensed patterns S-S1, S-S2, S-S3, and S-S4 and diffused patterns S-M1*a*, S-M1*b*, S-M2, S-M3*a*, S-M3*b*, S-M4, S-E1, S-E2, S-E3, and S-E4 that are disposed along the cut-off lines CL1, CL2, and CL3. In addition to this, the region of the diffused pattern S-WW along the horizontal line H can be brighter than the other regions. As a result, the low-beam light distribution pattern $P_{Lo}$ having the regions near the cut-off lines CL1, CL2, and CL3 being relatively brighter and an excellent distant visibility can be formed in position.

Furthermore, the vehicle lighting fixture 10A can form the low-beam light distribution pattern $P_{Lo}$ with excellent sense of feeling showing an optical gradation from the position near the cut-off lines CL1, CL2, and CL3 to the lower portion.

As described, the present exemplary embodiment can achieve the vehicle lighting fixture 10A that can be configured to include the light source 12A and the lens member 14A provided in front of the lens member 12A and is miniaturized more than a conventional vehicle lighting fixture (for example, those described in Japanese Patent Application Laid-Open No. 2009-283299). In particular, the thinning in the direction of the reference axis AX can be achieved.

This is because the central lens part 26A can form the first light distribution pattern (diffused pattern S-WW) wider than the second light distribution pattern (S-M1*a*, S-M1*b*, S-M2, S-M3*a*, S-M3*b*, S-M4, S-S1, S-S2, S-S3, and S-S4, as illustrated in FIG. 45) by the outgoing light rays RayA through the central emission face 26Ab of the central lens part 26A, and thus, the distance between the emission face 12Aa of the light source 12A and the central lens part 26A can be shortened more than the conventional vehicle lighting fixture described in the aforementioned JP publication.

Furthermore, the present exemplary embodiment can form the hot-zone region and the cut-off lines CL1, CL2, and CL3 of the light distribution pattern by the optical system utilizing total reflection (by the intermediate reflecting face 28Ab and the outer reflecting face 30Ab), and thus, the color unevenness caused by color aberration near the cut-off lines CL1, CL2, and CL3 can be suppressed. Specifically, although the respective incident faces 28Aa and 30Aa and the respective emission faces 28Ac and 30Ac may refract the light, the color separation can be suppressed due to the flat face shapes thereof.

A description will now be given of modified examples.

The previous exemplary embodiment can use the lens parts 26A, 28A, and 30A shaped in a circular shape when viewed from its front side as illustrated in FIG. 44. The shapes of the respective lens parts 26A, 28A, and 30A may be any other shape such as an oval or the like.

The previous exemplary embodiment can use the intermediate and outer lens parts 28A and 30A as surrounding lens parts. The number of the surrounding lens parts may be one (for example, the vehicle lighting fixture can be composed of a single lens part 28A) or three or more.

A description will now be given of still another modified example.

Figure 46:
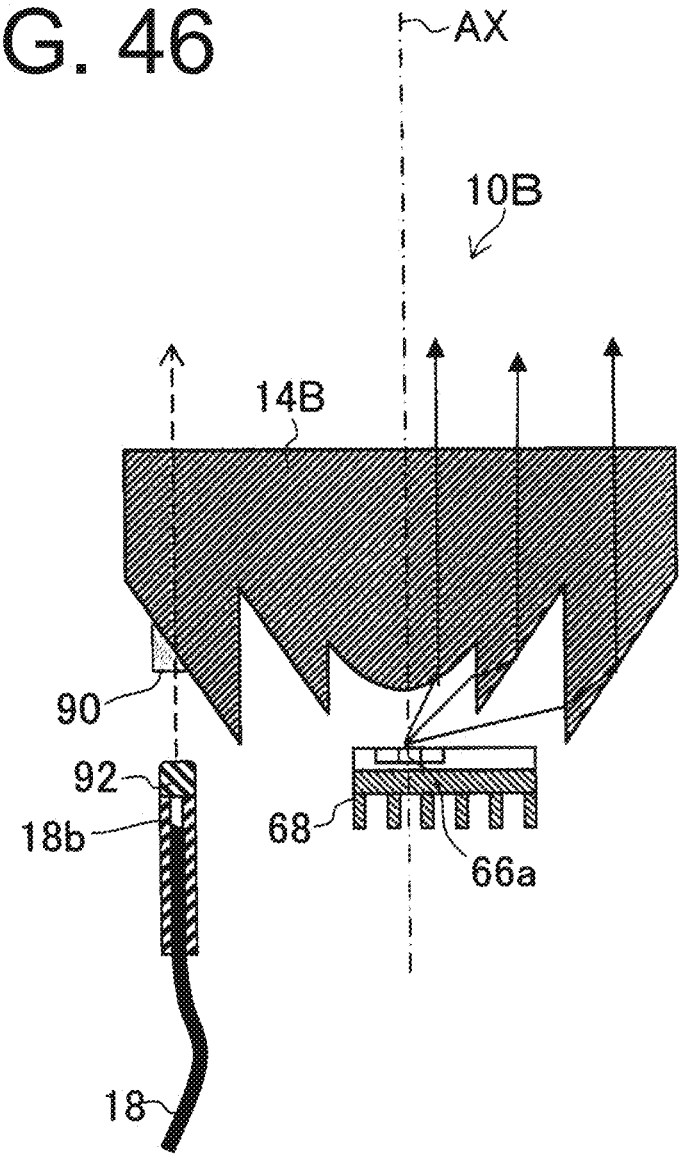
FIG. 46 is a schematic cross-sectional view illustrating a vehicle lighting fixture 10B as another modified example.

FIG. 46 is a schematic cross-sectional view illustrating a vehicle lighting fixture 10B as another modified example.

As illustrated, the vehicle lighting fixture 10B can be configured to form a low-beam light distribution pattern $P_{Lo}$ (corresponding to the predetermined light distribution pattern of the presently disclosed subject matter, as illustrated in FIG. 42) by overlaying the basic light distribution pattern (for example, the synthetic light distribution pattern obtained by overlaying the condensed patterns S-S1, S-S2, S-S3, and S-S4 and the diffused patterns S-M1*a*, S-M1*b*, S-M2, S-M3*a*, S-M3*b*, S-M4, S-E1, S-E2, S-E3, S-E4, and S-WW as illustrated in FIG. 45) and the additional light distribution pattern (for example, the diffused pattern S-E1 illustrated in FIG. 45). The vehicle lighting fixture 10B can be configured to include, in addition to the components of the vehicle lighting fixture 10A of the fifth exemplary embodiment, an SC light source 12 (as illustrated in FIG. 17) configured to output SC light containing light in a visible wavelength region, a removal member 14 (as illustrated in FIG. 17) configured to remove (cut) light other than the light in a predetermined visible wavelength region (for example, 450 nm to 700 nm) from the SC light output from the SC light source 12, a transmission optical fiber 18 configured to transmit the SC light output from the SC light source 12 to the lens member 14B through an emission end face 18*b* serving as a second light source 18*b*, etc.

Hereinafter, points of the modified example different from those of the vehicle lighting fixture 10A of the fifth exemplary embodiment will be mainly described, and the same or similar components of the modified example as or to those of the vehicle lighting fixture 10A of the fifth exemplary embodiment will be denoted by the same reference numbers and descriptions therefor will be omitted as appropriate.

The lens member 14B can be configured to include, in addition to the components of the lens member 14A of the fifth exemplary embodiment, an incident face part 90.

The incident face part 90 can be a face on which the light from the second light source 18*b* can be incident to enter the lens member 14B, and formed in a region corresponding to a designed emission region of the front face. For example, the incident face part 90 can be formed in a rear-side region corresponding to the emission region E1 of the lens member 14B. Therefore, the emission end face 18*b* of the transmission optical fiber 18 serving as the second light source 18*b* should be disposed to face to the incident face part 90.

A condenser lens 92 can be disposed between the second light source 18*b* and the incident face part 90 to condense the light from the second light source 18*b*.

At least one of the incident face part 90 and the condenser lens 92 can have a surface shape so that the light emitted from the second light source 18*b* and entering the lens body 14B can be collimated with respect to the reference axis AX.

FIG. 46 illustrates the case where the first light source 66*a* as described in the previous exemplary embodiments is used. Instead, the light source 12A as described in the previous exemplary embodiments may be used.

With this modified example, the light rays from the first light source 66*a* mainly containing incoherent light can form the basic light distribution pattern (for example, the synthetic light distribution pattern obtained by overlaying the condensed patterns S-S1, S-S2, S-S3, and S-S4 and the diffused patterns S-M1*a*, S-M1*b*, S-M2, S-M3*a*, S-M3*b*, S-M4, S-E1, S-E2, S-E3, S-E4, and S-WW as illustrated in FIG. 45) on the virtual vertical screen while the light rays from the second light source 18*b* mainly containing coherent light can form the additional light distribution pattern (for example, the diffused pattern S-E1 illustrated in FIG. 45) on the virtual vertical screen. The additional light distribution pattern can be overlaid on the basic light distribution pattern to form the low-beam light distribution pattern $P_{Lo}$ as a synthetic light distribution pattern as illustrated in FIG. 42. Here, the central lens part 26A, intermediate lens part 28B, and outer lens part 30A can constitute the first optical system of the presently disclosed subject matter, and the condenser lens 92, the incident face part 90, and the emission region E1 can constitute the second optical system of the presently disclosed subject matter.

The low-beam light distribution pattern $P_{Lo}$ can have a relatively high light intensity near the cut-off line on the own-lane side and be formed with an excellent distant visibility because of the same reason as that in the second exemplary embodiment.

Furthermore, the resulting low-beam light distribution pattern $P_{Lo}$ with the excellent distant visibility can be formed by overlaying the additional light distribution pattern formed mainly with coherent light on the basic light distribution pattern formed mainly with incoherent light.

The incident face part 90 may be formed in any other region corresponding to a region other than the emission region E1 on the rear face of the lens member 14B. By adjusting the position thereof, the light intensity at a particular point of the low-beam light distribution pattern $P_{Lo}$ other than the region near the cut-off line on the own-lane side can be relatively increased.

Furthermore, the number of the incident face part 90 may be two or more. For example, the incident face parts 90 can be formed in regions corresponding to the emission regions S1, S2, S3, and S4 on the rear surface of the lens member 14B. This can achieve the relatively higher center light intensity within the low-beam light distribution pattern $P_{Lo}$.

The numerical values presented in the exemplary embodiments and modified examples do not limit the scope of the presently disclosed subject matter and are mere illustrative, and can be various values.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

a supercontinuum light source having any of a pulse laser light source and a continuous wave (CW) laser light source, and a nonlinear optical medium configured to convert corresponding one of pulse laser light output from the pulse laser light source and continuous wave laser light output from the continuous wave laser light source into supercontinuum light for output, the supercontinuum light source having a directivity characteristic narrower than Lambertian light; and an optical system configured to control light emitted from the supercontinuum light source to form a predetermined light distribution pattern for a vehicle, wherein the light controlled by the optical system substantially contains coherent light; further comprising:

a second light source configured to mainly emit incoherent light; and a second optical system configured to control the light emitted from the second light source to form a second light distribution pattern, and wherein the vehicle lighting fixture forms an first light distribution pattern by the light substantially containing coherent light, the second light distribution pattern is wider than the first light distribution pattern, and the first light distribution pattern and the second light distribution pattern are overlaid on each other to form a predetermined light distribution pattern.

2. The vehicle lighting fixture according to claim 1, wherein the optical system comprises an incoherent device configured to reduce coherency of the light emitted from the supercontinuum light source.

3. The vehicle lighting fixture according to claim 1, wherein the first light source is selected from the group consisting of an incandescent bulb, a halogen bulb, an HID bulb, and a light source configured by a combination of a semiconductor light emitting element and a wavelength converting member.

4. The vehicle lighting fixture according to claim 1, wherein the nonlinear optical medium is a conversion optical fiber configured to convert the pulse laser light output from the pulse laser light source or the CW laser light output from the CW laser light source into the supercontinuum light for output.

5. The vehicle lighting fixture according to claim 1, further comprising a transmission optical fiber configured to transmit the supercontinuum light from the supercontinuum light source to the optical system and have an emission end face, and wherein the optical system controls the supercontinuum light exiting through the emission end face of the transmission optical fiber.

6. The vehicle lighting fixture according to claim 1, further comprising a removal member configured to remove from the supercontinuum light light other than light in a predetermined visible wavelength region, and wherein the optical system controls the light that is the supercontinuum light excluding the light other than light in the predetermined visible wavelength region.

7. The vehicle lighting fixture according to claim 6, wherein the removal member is any one of an optical filter and a dichroic mirror.

8. A vehicle lighting fixture configured to form a predetermined light distribution by overlaying a basic light distribution pattern and an additional light distribution pattern narrower than the basic light distribution pattern, the vehicle lighting fixture comprising:

a first light source configured to mainly emit incoherent light;

a first optical system configured to control the light emitted from the first light source to form the basic light distribution pattern;

a second light source configured to mainly emit coherent light having a higher luminance and a narrower directivity angle than those of the first light source; and a second optical system configured to control the light emitted from the second light source to form the additional light distribution pattern; wherein the first light source is selected from the group consisting of an incandescent bulb, a halogen bulb, an HID bulb, and a light source configured by a combination of a semiconductor light emitting element and a wavelength converting member, and the second light source is a supercontinuum light source configured to output supercontinuum light including light in a visible wavelength region, wherein the supercontinuum light source includes any one of a pulse laser light source and a CW laser light source, and a nonlinear optical medium configured to convert a pulse laser light output from the pulse laser light source or a CW laser light output from the CW laser light source into the supercontinuum light for output.

9. The vehicle lighting fixture according to claim 8, wherein the nonlinear optical medium is a conversion optical fiber configured to convert the pulse laser light output from the pulse laser light source or the CW laser light output from the CW laser light source into the supercontinuum light for output.

10. The vehicle lighting fixture according to claim 8, further comprising a transmission optical fiber configured to transmit the supercontinuum light from the supercontinuum light source to the second optical system and have an emission end face, and wherein the second optical system controls the supercontinuum light exiting through the emission end face of the transmission optical fiber.

11. The vehicle lighting fixture according to claim 8, further comprising a transmission optical fiber configured to transmit the supercontinuum light from the supercontinuum light source to the second optical system and have an emission end face, and wherein the second optical system controls the supercontinuum light exiting through the emission end face of the transmission optical fiber.

12. The vehicle lighting fixture according to claim 9, further comprising a transmission optical fiber configured to transmit the supercontinuum light from the supercontinuum light source to the second optical system and have an emission end face, and wherein the second optical system controls the supercontinuum light exiting through the emission end face of the transmission optical fiber.

13. The vehicle lighting fixture according to claim 9, wherein the conversion optical fiber has an emission end face and the second optical system controls the supercontinuum light exiting through the emission end face of the conversion optical fiber.

14. The vehicle lighting fixture according to claim 8, comprising a removal member configured to remove from the supercontinuum light light other than light in a predetermined visible wavelength region, and wherein the second optical system controls the light that is the supercontinuum light excluding the light other than light in the predetermined visible wavelength region.

15. The vehicle lighting fixture according to claim 8, comprising a removal member configured to remove from the supercontinuum light light other than light in a predetermined visible wavelength region, and wherein the second optical system controls the light that is the supercontinuum light excluding the light other than light in the predetermined visible wavelength region.

16. The vehicle lighting fixture according to claim 9, comprising a removal member configured to remove from the supercontinuum light light other than light in a predetermined visible wavelength region, and wherein the second optical system controls the light that is the supercontinuum light excluding the light other than light in the predetermined visible wavelength region.

17. The vehicle lighting fixture according to claim 10, comprising a removal member configured to remove from the supercontinuum light light other than light in a predetermined visible wavelength region, and wherein the second optical system controls the light that is the supercontinuum light excluding the light other than light in the predetermined visible wavelength region.

* * * * *